US009835306B2

(12) United States Patent
Kang

(10) Patent No.: US 9,835,306 B2
(45) Date of Patent: Dec. 5, 2017

(54) LED ILLUMINATION APPARATUS

(71) Applicant: Seoul Semiconductor Co., Ltd., Ansan-si (KR)

(72) Inventor: Ki Tae Kang, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 115 days.

(21) Appl. No.: 14/672,513

(22) Filed: Mar. 30, 2015

(65) Prior Publication Data

US 2015/0204507 A1 Jul. 23, 2015

Related U.S. Application Data

(63) Continuation of application No. 14/463,028, filed on Aug. 19, 2014, which is a continuation of application (Continued)

(30) Foreign Application Priority Data

Nov. 26, 2010 (KR) ..... 10-2010-0118952
Mar. 9, 2011 (KR) ..... 10-2011-0020948

(Continued)

(51) Int. Cl.
*F21V 1/00* (2006.01)
*F21V 3/00* (2015.01)

(Continued)

(52) U.S. Cl.
CPC ..... *F21V 3/00* (2013.01); *F21K 9/232* (2016.08); *F21K 9/238* (2016.08); *F21K 9/60* (2016.08);

(Continued)

(58) Field of Classification Search
CPC ... F21K 9/232; F21K 9/60; F21K 9/62; F21K 9/64; F21V 23/005; F21V 3/0472; F21V 9/16; F21Y 2101/00; F21Y 2115/10
See application file for complete search history.

(56) References Cited

U.S. PATENT DOCUMENTS 1,545,711 A 7/1925 Townsend
1,877,785 A 9/1932 Andrews (Continued)

FOREIGN PATENT DOCUMENTS

JP 2001-155510 6/2001
JP 2003-258319 9/2003

(Continued)

OTHER PUBLICATIONS

Non-Final Office Action dated Oct. 7, 2016, in U.S. Appl. No. 14/463,028.

(Continued)

*Primary Examiner* — Ali Alavi
(74) *Attorney, Agent, or Firm* — H.C. Park & Associates, PLC

(57) ABSTRACT

An LED illumination apparatus according to an exemplary embodiment of the present invention includes a substrate, a light source disposed on the substrate, a cover unit, wherein the cover unit is configured to cover the light source, which is disposed on the substrate, and a reflector which is configured to extend from the cover unit inside to the upper substrate, whereby a light generated by the light source illuminates an area below a bottom side of the substrate.

20 Claims, 46 Drawing Sheets

Related U.S. Application Data

No. 13/305,157, filed on Nov. 28, 2011, now Pat. No. 8,840,269.

(30) Foreign Application Priority Data

Mar. 11, 2011 (KR) ..... 10-2011-0021965
May 25, 2011 (KR) ..... 10-2011-0049504
Sep. 7, 2011 (KR) ..... 10-2011-0090835

(51) Int. Cl.

| | |
|---|---|
| ***F21V 7/00*** | (2006.01) |
| ***F21V 9/16*** | (2006.01) |
| ***F21V 3/02*** | (2006.01) |
| ***F21V 29/70*** | (2015.01) |
| ***F21V 29/74*** | (2015.01) |
| ***F21V 3/04*** | (2006.01) |
| ***F21V 5/00*** | (2015.01) |
| ***F21V 7/04*** | (2006.01) |
| ***F21V 7/09*** | (2006.01) |
| ***F21V 23/00*** | (2015.01) |
| ***F21K 9/232*** | (2016.01) |
| ***F21K 9/60*** | (2016.01) |
| ***F21K 9/62*** | (2016.01) |
| ***F21K 9/64*** | (2016.01) |
| ***F21K 9/238*** | (2016.01) |
| *F21V 13/02* | (2006.01) |
| *F21V 29/00* | (2015.01) |
| *F21V 17/10* | (2006.01) |
| *F21V 17/12* | (2006.01) |
| *F21Y 105/12* | (2016.01) |
| *F21Y 105/10* | (2016.01) |
| *F21Y 115/10* | (2016.01) |
| *F21Y 103/33* | (2016.01) |
| *F21Y 107/60* | (2016.01) |

(52) U.S. Cl.

CPC ..... *F21K 9/62* (2016.08); *F21K 9/64* (2016.08); *F21V 3/02* (2013.01); *F21V 3/049* (2013.01); *F21V 3/0472* (2013.01); *F21V 5/00* (2013.01); *F21V 7/00* (2013.01); *F21V 7/0016* (2013.01); *F21V 7/0058* (2013.01); *F21V 7/04* (2013.01); *F21V 7/09* (2013.01); *F21V 9/16* (2013.01); *F21V 23/005* (2013.01); *F21V 29/70* (2015.01); *F21V 29/74* (2015.01); *F21V 13/02* (2013.01); *F21V 17/101* (2013.01); *F21V 17/12* (2013.01); *F21V 29/20* (2013.01); *F21Y 2103/33* (2016.08); *F21Y 2105/10* (2016.08); *F21Y 2105/12* (2016.08); *F21Y 2107/60* (2016.08); *F21Y 2115/10* (2016.08); *Y10S 362/80* (2013.01)

(56) References Cited

U.S. PATENT DOCUMENTS

| | | | | |
|---|---|---|---|---|
| 3,875,561 | A | 4/1975 | Scarpino et al. | |
| 5,642,933 | A | 7/1997 | Hitora | |
| 5,707,130 | A | 1/1998 | Zwick et al. | |
| 5,769,532 | A | 6/1998 | Sasaki | |
| 5,929,788 | A | 7/1999 | Vukosic | |
| 6,183,100 | B1 | 2/2001 | Suckow et al. | |
| 6,364,506 | B1 | 4/2002 | Gallo | |
| 6,464,373 | B1 | 10/2002 | Petrick | |
| 6,476,726 | B1 | 11/2002 | Pederson | |
| 6,637,921 | B2 | 10/2003 | Coushaine | |
| 6,932,496 | B2 | 8/2005 | Rizkin et al. | |
| 7,021,801 | B2 | 4/2006 | Mohacsi | |
| 7,111,958 | B2 * | 9/2006 | Coman | F21S 9/022 362/153.1 |
| 7,118,262 | B2 | 10/2006 | Negley | |
| 7,347,586 | B2 | 3/2008 | Izardel | |
| 7,473,937 | B2 | 1/2009 | Park et al. | |
| 7,479,662 | B2 | 1/2009 | Soules et al. | |
| 7,572,030 | B2 | 8/2009 | Booth et al. | |
| 7,588,351 | B2 | 9/2009 | Meyer | |
| 7,758,210 | B2 | 7/2010 | Peck | |
| 7,828,461 | B2 | 11/2010 | Mayer et al. | |
| 7,914,162 | B1 | 3/2011 | Huang | |
| 8,052,309 | B2 | 11/2011 | Dyson | |
| 8,167,466 | B2 | 5/2012 | Liu | |
| 8,226,270 | B2 | 7/2012 | Yamamoto et al. | |
| 8,227,964 | B2 | 7/2012 | Choi et al. | |
| 8,240,880 | B2 | 8/2012 | Chen et al. | |
| 8,317,364 | B2 | 11/2012 | Kim et al. | |
| 8,360,615 | B2 | 1/2013 | Rizkin et al. | |
| 8,506,113 | B2 | 8/2013 | Sanchez et al. | |
| 8,562,162 | B2 * | 10/2013 | Natsume | G02B 6/0018 362/559 |
| 8,820,962 | B2 * | 9/2014 | Kang | F21V 3/00 362/236 |
| 8,840,269 | B2 * | 9/2014 | Kang | F21V 3/00 362/236 |
| 9,052,067 | B2 | 6/2015 | Van De Ven et al. | |
| 9,316,386 | B2 | 4/2016 | Breidenassel et al. | |
| 2004/0256630 | A1 | 12/2004 | Cao | |
| 2005/0068777 | A1 | 3/2005 | Popovic | |
| 2006/0274526 | A1 | 12/2006 | Weston et al. | |
| 2007/0002572 | A1 | 1/2007 | Ewig et al. | |
| 2009/0021933 | A1 | 1/2009 | Mayer et al. | |
| 2009/0141474 | A1 | 6/2009 | Kolodin | |
| 2010/0220469 | A1 | 9/2010 | Ivey et al. | |
| 2011/0084297 | A1 * | 4/2011 | Ogata | B29C 33/0016 257/98 |
| 2011/0215345 | A1 | 9/2011 | Tarsa et al. | |
| 2011/0215696 | A1 | 9/2011 | Tong et al. | |
| 2011/0228514 | A1 | 9/2011 | Tong et al. | |
| 2011/0267800 | A1 * | 11/2011 | Tong | F21V 3/02 362/84 |
| 2012/0026740 | A1 | 2/2012 | Kim et al. | |
| 2012/0243235 | A1 | 9/2012 | Gao | |
| 2012/0273812 | A1 | 11/2012 | Takahashi et al. | |
| 2012/0275165 | A1 * | 11/2012 | Choi | F21K 9/00 362/294 |
| 2013/0083526 | A1 * | 4/2013 | Kadoriku | B29C 45/0055 362/235 |

FOREIGN PATENT DOCUMENTS

| | | |
|---|---|---|
| JP | 2009-170114 | 7/2009 |
| JP | 2010-086946 | 4/2010 |
| JP | 2010-118254 | 5/2010 |
| JP | 2010-533961 | 10/2010 |
| KR | 10-2010-0010321 | 2/2010 |
| WO | 2010/038982 | 4/2010 |

OTHER PUBLICATIONS

Extended European Search Report issued on Nov. 23, 2015, in European Patent Application No. 11843627.8.

Non-Final Office Action issued on Sep. 9, 2013 in U.S. Appl. No. 13/305,157.

Final Office Action issued on Mar. 18, 2014 in U.S. Appl. No. 13/305,157.

Notice of Allowance issued on May 27, 2014 in U.S. Appl. No. 13/305,157.

Non-Final Office Action issued on Sep. 9, 2013 in U.S. Appl. No. 13/921,633.

Final Office Action issued on Jan. 27, 2014 in U.S. Appl. No. 13/921,633.

Notice of Allowance issued on May 2, 2014 in U.S. Appl. No. 13/921,633.

Non-Final Office Action dated Feb. 9, 2017, in U.S. Appl. No. 14/672,508.

(56) References Cited

OTHER PUBLICATIONS

Final Office Action dated Feb. 15, 2017, in U.S. Appl. No. 14/463,028.
Notice of Allowance dated Apr. 11, 2017, in U.S. Appl. No. 14/463,028.
Non-Final Office Action dated May 23, 2017, in U.S. Appl. No. 14/671,349.
Notification of Reason for Refusal dated Mar. 30, 2017, in the Korean Application No. 10-2011-0049504.
Final Office Action dated Jul. 27, 2017, in U.S. Appl. No. 14/672,503.
Non-Final Office Action dated Aug. 10, 2017, in U.S. Appl. No. 14/671,481.
Non-Final Office Action dated Aug. 30, 2017, in U.S. Appl. No. 14/671,349.
Notice of Allowance dated Oct. 10, 2017, issued in the U.S. Appl. No. 14/463,028.

* cited by examiner

LED ILLUMINATION APPARATUS

CROSS REFERENCE TO RELATED APPLICATIONS

This application is a continuation of U.S. patent application Ser. No. 14/463,028, filed on Aug. 19, 2014, which is a continuation of U.S. patent application Ser. No. 13/305,157, filed on Nov. 28, 2011, and now issued as U.S. Pat. No. 8,840,269, and claims priority from and the benefit of Korean Patent Application No. 10-2010-0118952, filed on Nov. 26, 2010, Korean Patent Application No. 10-2011-0020948, filed on Mar. 9, 2011, Korean Patent Application No. 10-2011-0021965, filed on Mar. 11, 2011, Korean Patent Application No. 10-2011-0049504, filed on May 25, 2011, and Korean Patent Application No. 10-2011-0090835, filed on Sep. 7, 2011, which are all incorporated herein by reference for all purposes as if fully set forth herein.

BACKGROUND OF THE INVENTION

Field of the Invention

Exemplary embodiments of the present invention relate to a light emitting diode (LED) illumination apparatus, and more particularly, to an LED illumination apparatus which may realize wide light distribution by increasing the angular range of radiation and achieve uniform intensity of light and a variety of light distribution patterns to reduce the loss of light that is generated by a light source and is radiated to the outside.

Discussion of the Background

Incandescent lamps and fluorescent lamps are widely used for indoor or outdoor lighting. The incandescent lamps or fluorescent lamps have a problem in that they should be frequently replaced due to their short lifespan.

In order to solve this problem, an illumination apparatus using LEDs has been developed. LEDs, when applied to illumination apparatus, have excellent characteristics, such as good controllability, rapid response, high electricity-to-light conversion efficiency, long lifetime, low power consumption, and high luminance.

In particular, the LED has an advantage in that it consumes little power due to high electricity-to-light conversion efficiency. In addition, the LED has a rapid on-off because since no preheating time is necessary, attributable to the fact that its light emission is neither thermal light emission nor discharge light emission.

Furthermore, the LED has advantages in that it is resistant to and safe from impact since neither gas nor a filament is disposed therein, in that it consumes little electrical power, operates at high repetition and high pulses, decreases optic nerve fatigue, has a lifespan so long that it can be considered semi-permanent, and realizes illumination in various colors due to the use of a stable direct lighting mode, and in that it can be miniaturized since a small light source is used.

FIG. 1 is a perspective view that illustrates a typical LED illumination apparatus. In the LED illumination apparatus, a plurality of LED devices 11 is disposed on a substrate 12, which is disposed on a heat sink 13 such that the heat that is generated when the LED devices 11 emit light can be dissipated to the outside. Heat dissipation fins 14 protrude from the outer surface of the heat sink 13 so as to increase the area of heat dissipation. A socket 15 is connected to an external power source, and a transparent cover 16 protects the LED devices 11 from the external environment.

However, since the LED device 11 defines an angular range of radiation from 120° to 130° when emitting light, an LED illumination apparatus, which is realized using the LED devices 11, exhibits a light distribution, as illustrated in FIG. 9B, which is focused substantially in the forward direction but not in the backward direction.

Accordingly, the light distribution characteristic of the LED illumination apparatus is not as good as that of an incandescent lamp, that is, light distribution in which light is directed backward, as illustrated in FIG. 9A. This causes a problem in that a sufficient intensity of illumination is not guaranteed in indoor or outdoor spaces.

SUMMARY OF THE INVENTION

Exemplary embodiments of the present invention provide a Light Emitting Diode (LED) illumination apparatus.

Exemplary embodiments of the present invention also provide an LED illumination apparatus that can achieve a wide light distribution with an increased angular range of radiation by directing a portion of the light that is generated by the light source to the side and rear of the illumination apparatus.

Exemplary embodiments of the present invention also provide an LED illumination apparatus that has an increased angular range of radiation and achieves uniform intensity of light by positioning a reflector, which directs a portion of the light that is generated from a light source to the side and rear of the illumination apparatus, above and spaced apart from the light source.

Exemplary embodiments of the present invention also provide an LED illumination apparatus that can achieve uniform intensity of light by arranging a plurality of light sources in peripheral and inner areas of a substrate such that the light sources do not overlap each other.

Exemplary embodiments of the present invention also provide an LED illumination apparatus that achieves uniform intensity of light by designing a reflector, which reflects light that is generated from a plurality of light sources, in a multistage structure such that the light sources are arranged at different heights.

Exemplary embodiments of the present invention also provide an LED illumination apparatus that achieves a variety of light distribution patterns by radiating light that is generated by a first light source and light that is generated by a second light source to the outside through respective first and second covers, which are partitioned by a reflector and have different transmittances.

Exemplary embodiments of the present invention also provide an LED illumination apparatus that can be easily implemented since a fluorescent material, which converts light that is generated by an LED into white light, is contained in a cover.

Exemplary embodiments of the present invention also provide an LED illumination apparatus that achieves a variety of illumination patterns according to the mood by separating light that is generated by a first light source and light that is generated by a second light source from each other using a reflector, the first and second light sources being designed to generate different types of light.

Exemplary embodiments of the present invention also provide an LED illumination apparatus that guides light that is generated by a light source to the rear and reduces the interference of the light using a cover, which is provided above a heat sink on which a substrate is mounted, thereby reducing the loss of the light that is radiated to the rear is reduced.

Exemplary embodiments of the present invention also provide an LED illumination apparatus that decreases the distance between a light source and a cover, which surrounds the light source, by forming the cover to be aspheric, so that the loss of the light that is radiated to the front is reduced, thereby increasing the entire light efficiency.

An exemplary embodiment of the present invention provides an LED illumination apparatus that includes a substrate, a first light source disposed on a peripheral area of the substrate, a second light source disposed on an inner area of the substrate, and a reflector disposed between the first light source and the second light source, wherein the reflector is configured to reflect light that is generated by the first light source.

Another exemplary embodiment of the present invention also provides an LED illumination apparatus that includes a substrate, a plurality of first light emitting devices disposed on a peripheral area of the substrate, a reflector disposed on an inner area of the substrate, wherein the reflector has a first height to reflect light that is generated by the first light emitting devices, and a plurality of second light emitting devices disposed on an upper surface of the reflector such that the second light emitting devices are disposed at a second height different from the first light emitting devices. The second light emitting devices are electrically connected to the substrate. The second light emitting devices are alternately disposed with the first light emitting devices that are disposed adjacent to the second light emitting devices.

Another exemplary embodiment of the present invention also provides an LED illumination apparatus that includes a substrate, a light source comprising a first light source disposed on a peripheral area of the substrate and a second light source disposed on an inner area of the substrate, a reflector disposed on a boundary area between the first light source and the second light source and having a first height, wherein the reflector is configured to divide light that is generated by the first light source from light that is generated by the second light source, and a cover comprising a first cover unit to allow the light that is generated by the first light source to pass to an outside and a second cover unit to allow the light that is generated by the second light source to pass to an outside. The first and second cover units have different light transmittances.

Another exemplary embodiment of the present invention also discloses an LED illumination apparatus that includes a substrate, a light source, wherein the light source comprises a first light source and a second light source, which are disposed on the substrate, a reflector to reflect light that is generated by the first light source and the second light source, wherein the reflector is configured to partition an area of the first light source from an area of the second light source, a cover to allow the light that is generated by the light source to pass through, a heat sink disposed under the substrate, and an inclined guide surface formed on the heat sink. A slope of the guide surface increases from an edge of an upper surface toward a lower portion of the heat sink. The guide surface has a maximum outer diameter that is equal to or smaller than that of the cover.

According to embodiments of the invention, the reflector is disposed in the boundary area between the first light source, which is disposed on the substrate, and the second light source, which is disposed on the substrate in an area that is more inward than that of the first light source, to reflect light that is generated by the first light source toward the side and rear, thereby increasing the angular range of radiation. Consequently, the distribution of light that is generated by the first light source can be made similar to that of an incandescent lamp. Accordingly, the LED illumination apparatus can replace the incandescent lamp in lighting devices that use incandescent lamps without decreasing illumination efficiency. In addition, since a wide angular range can be achieved, the LED illumination apparatus can be used for main illumination rather than localized illumination, thereby increasing the range of use and applicability.

In addition, it is possible to increase the angular range and achieve uniform intensity of light by positioning a reflector, which directs a portion of the light that is generated by the light source toward the side and rear of the illumination apparatus, above and spaced apart from the light source, which is disposed on a substrate.

Furthermore, it is possible to achieve uniform intensity of light by arranging a plurality of light sources, which are disposed on the peripheral and inner areas of a substrate, such that they do not overlap each other.

In addition, it is possible to achieve uniform intensity of light by arranging a plurality of light sources, which are disposed on the peripheral and inner areas of the substrate, such that they do not overlap each other and are positioned at different heights.

In addition, it is possible to achieve a variety of light distribution patterns by radiating light that is generated by the first light source and light that is generated by the second light source to the outside through the respective first and second covers, which are partitioned by the reflector and have different transmittances.

Furthermore, it is possible to easily fabricate the LED illumination apparatus and improve productivity, since the fluorescent material, which converts light that is generated by the LED into white light, is contained in the cover.

In addition, it is possible to achieve a variety of illumination patterns according to the mood by separating light that is generated by the first light source and light that is generated by the second light source from each other using the reflector, the first and second light sources being designed to generate different types of light.

Furthermore, it is possible to guide light that is generated by the light source to the rear and reduce the interference of the light using the cover, which is provided above the heat sink on which the substrate is mounted, so that the loss of the light that is radiated to the rear is reduced, thereby increasing the entire light efficiency.

Moreover, it is possible to decrease the distance between the light source and the cover, which surrounds the light source, by forming the cover to be aspheric, so that the loss of the light that is radiated to the front is reduced, thereby increasing the entire light efficiency.

It is to be understood that both the foregoing general description and the following detailed description are exemplary and explanatory and are intended to provide further explanation of the invention as claimed.

BRIEF DESCRIPTION OF THE DRAWINGS

FIG. 6A, FIG. 6B, FIG. 6C, and FIG. 6D are cross-sectional views that illustrate several structures of the reflector employed in the present invention, in which FIG. 6A is a single curved structure, FIG. 6B is a combination of a straight vertical section and an inclined section, FIG. 6C is a combination of a curved section and an inclined section, and FIG. 6D is a combination of a straight vertical section and a curved section.

FIG. 7A, FIG. 7B, and FIG. 7C are cross-sectional views that illustrate several coupling states between the reflector and the substrate, which are employed in the present invention, in which FIG. 7A is a fitting type using a fitting protrusion, FIG. 7B is a faster type using a fastening member, and FIG. 7C is a bonding type using an adhesive.

FIG. 8A, FIG. 8B, and FIG. 8C are top plan views that illustrate several structures of the reflector employed in the present invention, in which FIG. 8A shows a reflector having a cavity, FIG. 8B shows a reflector having a wavy cross section, and FIG. 8C shows a reflector having a toothed cross section.

FIG. 34A, FIG. 34B, FIG. 34C, FIG. 34D, and FIG. 34E are cross-sectional views that illustrate several structures of the reflector employed in the tenth exemplary embodiment of the present invention, in which FIG. 34A is a single straight structure, FIG. 34B is a single curved structure, FIG. 34C is a combination of a straight vertical section and an inclined section, FIG. 34D is a combination of a curved section and an inclined section, and FIG. 34E is a combination of a straight vertical section and a curved section.

FIG. 35A, FIG. 35B, and FIG. 35C are cross-sectional views that illustrate several structures in which the reflector is coupled to the substrate in the LED illumination apparatus illustrated in FIG. 30, in which FIG. 35A shows a fitting type using a hook, FIG. 35B shows a fastening type using a fastening member, and FIG. 35C shows a bonding type using an adhesive.

FIG. 36A, FIG. 36B, and FIG. 36C are top plan views that illustrate several structures of the second surface of the reflector in the LED illumination apparatus illustrated in FIG. 30, in which FIG. 36A shows a reflector having a circular cross section, FIG. 36B shows a reflector having a wavy cross section, and FIG. 36C shows a reflector having a toothed cross section.

FIG. 43A, FIG. 43B, and FIG. 43C are graphs showing light distribution depending on the transmittances of the first and second covers in the LED illumination apparatus according to another embodiment of the present invention, in which FIG. 43A shows the case in which the first and second covers have the same transmittance, FIG. 43B shows the case in which the transmittance of the first cover is higher than that of the second cover, and FIG. 43C shows the case in which the transmittance of the second cover is lower than that of the first cover.

DETAILED DESCRIPTION OF THE ILLUSTRATED EMBODIMENTS

Figure 1:
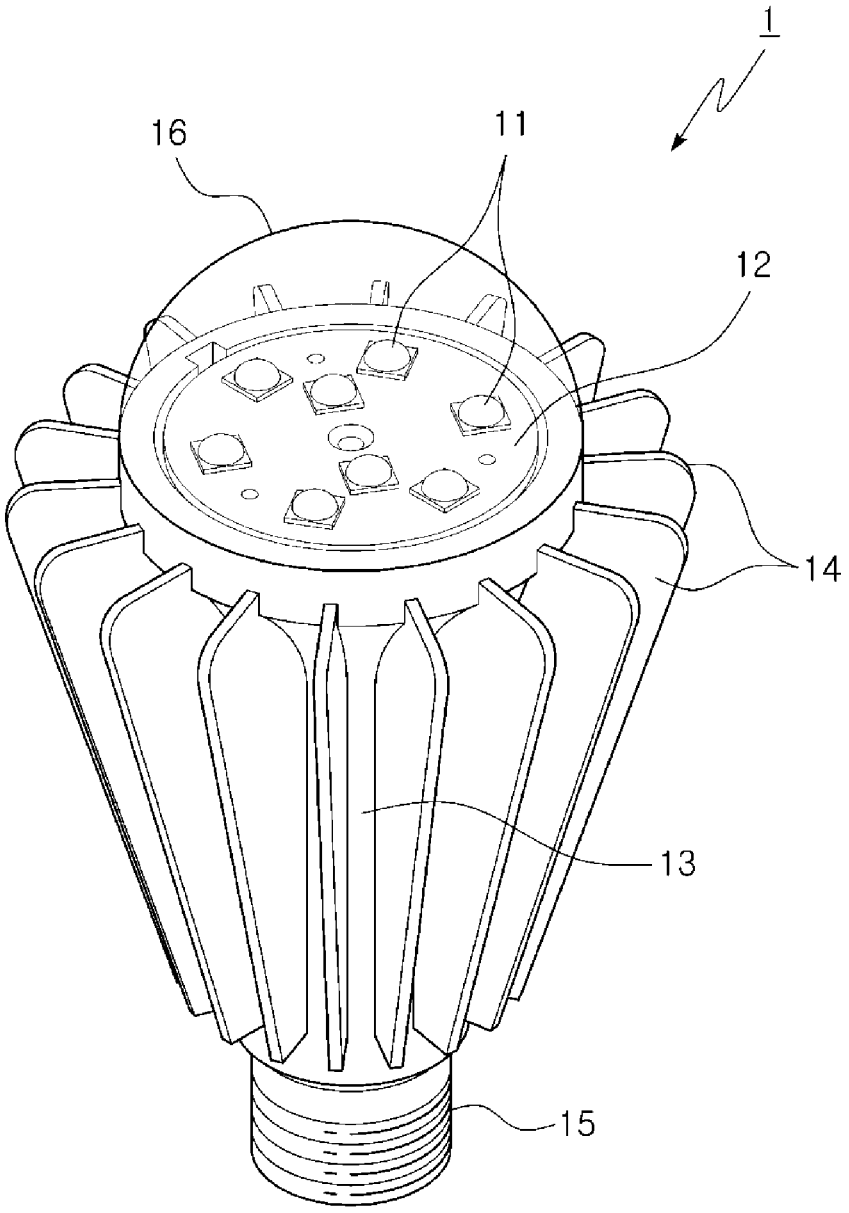
Prior art FIG.1
FIG. 1 is a perspective view that illustrates a typical LED illumination apparatus.

The invention is described more fully hereinafter with reference to the accompanying drawings, in which embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. In contrast, it will be understood that when an element such as a layer, film, region, or substrate is referred to as being "beneath" another element, it can be directly beneath the other element or intervening elements may also be present. Meanwhile, when an element is referred to as being "directly beneath" another element, there are no intervening elements present.

Throughout this document, reference should be made to the drawings, in which the same reference numerals and signs are used throughout the different drawings to designate the same or similar components.

As illustrated in FIG. 2 to FIG. 50, light emitting diode (LED) illumination apparatuses 100, 200, 300, 400, 500, 600, 700, 800, 900, 1000, 1100, and 1200 according to exemplary embodiments of the invention may include a substrate 110, a first light source 111, a second light source 112, and a reflector 130, 230, or 1030.

The substrate 110 may be a circuit board member, which has a certain circuit pattern disposed on an upper surface thereof, such that the circuit pattern is electrically connected to an external power, which is supplied through a power cable (not shown), and is electrically connected to the light sources 111 and 112.

The substrate 110 may be disposed on an upper surface of a heat sink 120, with a heat dissipation pad 121 interposed between the substrate 110 and the heat sink 120. The heat sink 120 may be made of a metal, such as aluminum (Al), having excellent heat conductivity, such that it can dissipate the heat that is generated when the light sources emit light to the outside.

The heat sink 120 may have a plurality of heat dissipation fins on the outer surface thereof to increase heat dissipation efficiency by increasing the heat dissipation area. The heat sink 120 may have a guide surface 124 on the upper portion thereof, the guide surface 124 being cut open from the inside to the outside. The guide surface 124 includes an inner portion 124A having a first slope, an outer portion 124B having a second slope that is greater than the first slope, and a middle portion 124C disposed between the first portion 124A and the second portion 124B. The guide surface 124 serves to increase the area through which the light travels in the backward direction, thereby increasing the angular range of radiation of the light while a portion of the light that is generated by the light sources is reflected to the side and rear by the reflector 130, 230, or 1030. The reflector 130, 230, or 1030 will be described later.

Although the substrate 110 has been illustrated and described as having the form of a disc conforming to the shape of a mounting area 122, i.e. the upper surface of the heat sink 120, other shape is also possible. For example, the substrate 110 may be formed as a polygonal plate, such as a triangular or rectangular plate.

In addition, although the substrate 110 has been illustrated and described as being bonded to the upper surface of the heat sink 120 via the heat dissipation pad 121, other configuration is also possible. It should be understood that the substrate 110 may be detachably assembled to the mounting area 122 of the heat sink 120 via a fastening member.

In addition, a light-transmitting cover 140 having a space S therein is disposed on the middle portion 124B of the guide surface 124 and covers the mounting area 122 of the heat sink 120. The light-transmitting cover 140 radiates the light that is emitted from the light sources to the outside while protecting the light sources. The light-transmitting cover 140 may be formed as a light spreading cover in order to radiate the light that is generated by the light sources to the outside by spreading.

Figure 26:
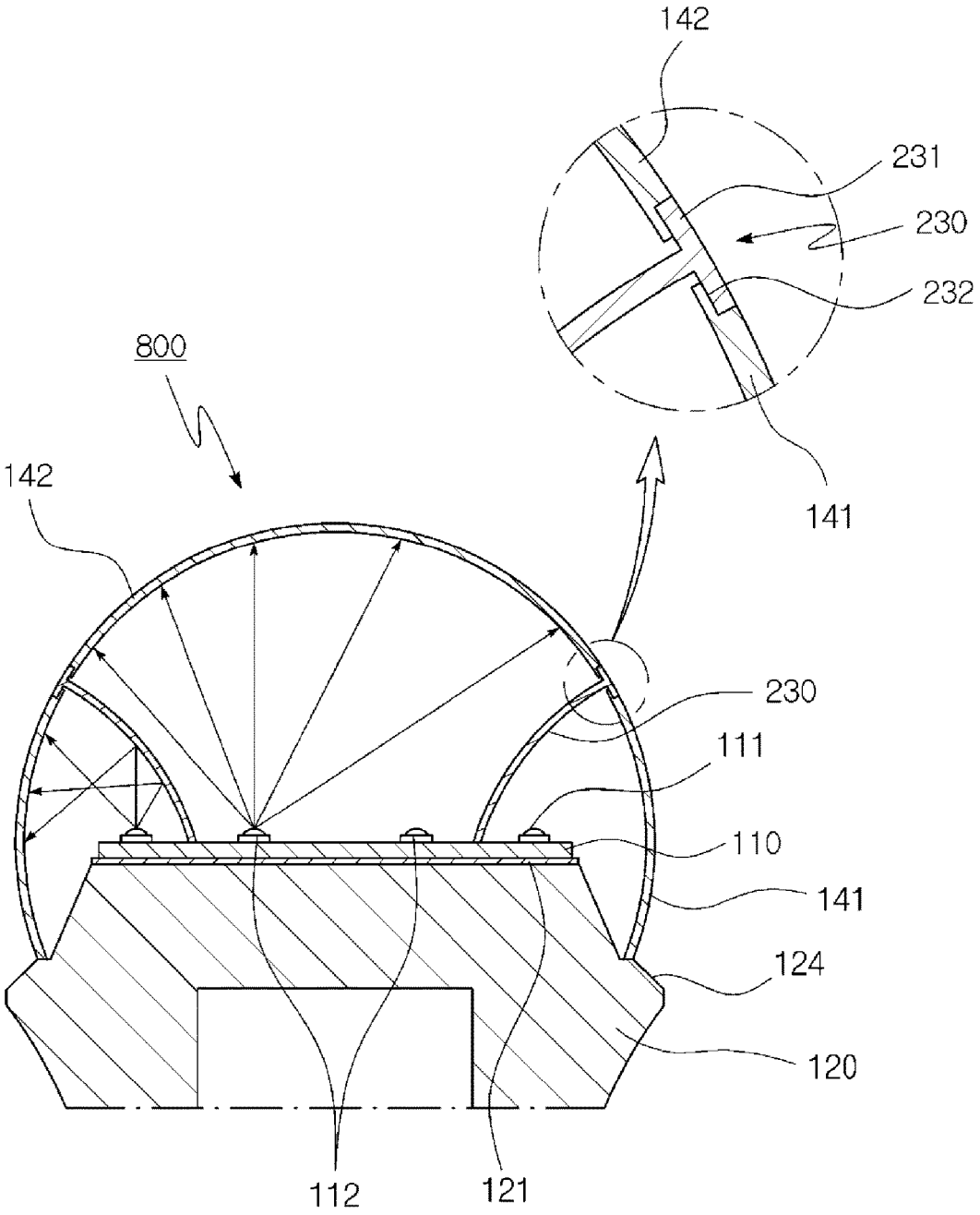
FIG. 26 is a detailed view that illustrates the reflection of light by the reflector and the travel of light in the LED illumination apparatus illustrated in FIG. 24.

Although the light-transmitting cover 140 has been illustrated and described as being hemispherical, other configuration is also possible. For example, the light-transmitting cover 140 may have an extension 231 as shown in FIG. 26, which extends from an intermediate portion in the height direction to the lower portion of the hemisphere, to increase the reflection area, in which light is reflected to the side and rear by the reflector 130, 230, or 1030, in the backward direction. The extension 231 may be bent inward at a certain angle such that it is positioned lower than the height at which the first light source 111 is disposed on the substrate 110, thereby increasing the area illuminated by the light emitted from the first light source 111.

The reflector 130 or 230 may be disposed on the upper portion of the substrate 110, as illustrated in FIG. 2 to FIG. 50, and serve to reflect the light that is generated by the first light source 111 to the side and rear.

The reflector 130 or 230 may be formed as a reflector plate having a certain height, and may be disposed on the boundary area between the one or more first light sources 111, which are disposed on the peripheral area of the substrate 110, and the one or more second light sources 112, which are disposed on the inner area of the substrate 110. The reflector 130 or 230 has a cross-sectional shape that can reflect the light that is generated by the first light source 111, which is arranged on the peripheral area, to the side and rear of the substrate 110.

Figure 10:
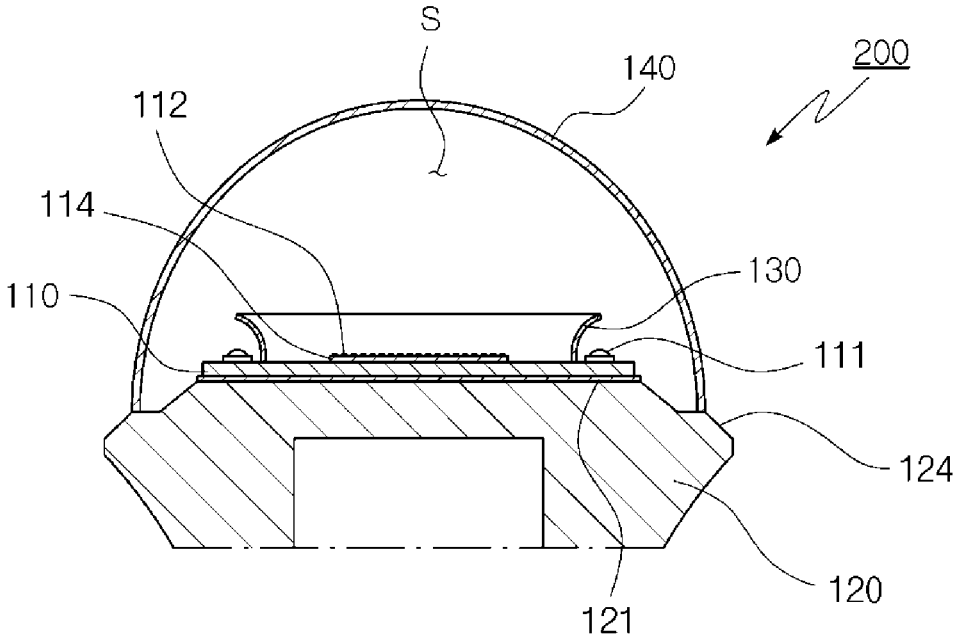
FIG. 10 is a cross-sectional view that illustrates the overall configuration of an LED illumination apparatus according to a second exemplary embodiment of the invention.

Here, the first light source 111 and the second light source 112 may be formed as a chip-on-board (COB) assembly, in which a plurality of LED chips are integrated on a board 114, as illustrated in FIG. 10, an LED package including lead frames, or a combination thereof.

Figure 2:
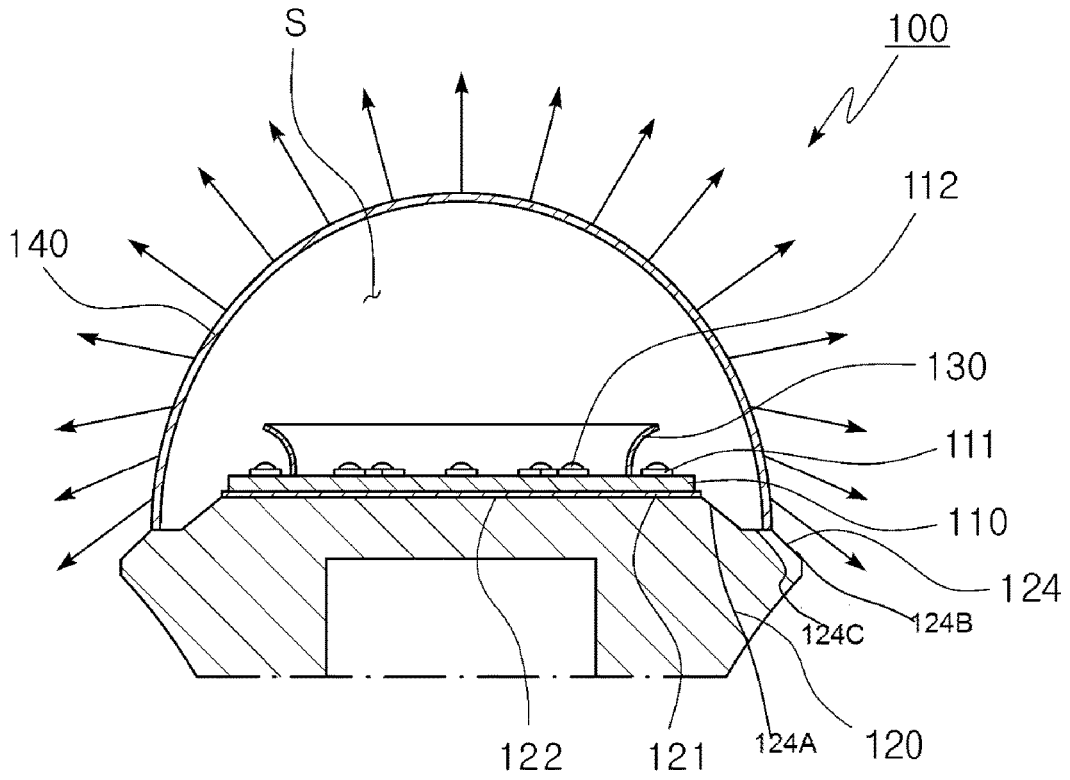
FIG. 2 is a cross-sectional view that illustrates the overall configuration of an LED illumination apparatus according to a first exemplary embodiment of the invention.
Figure 3:
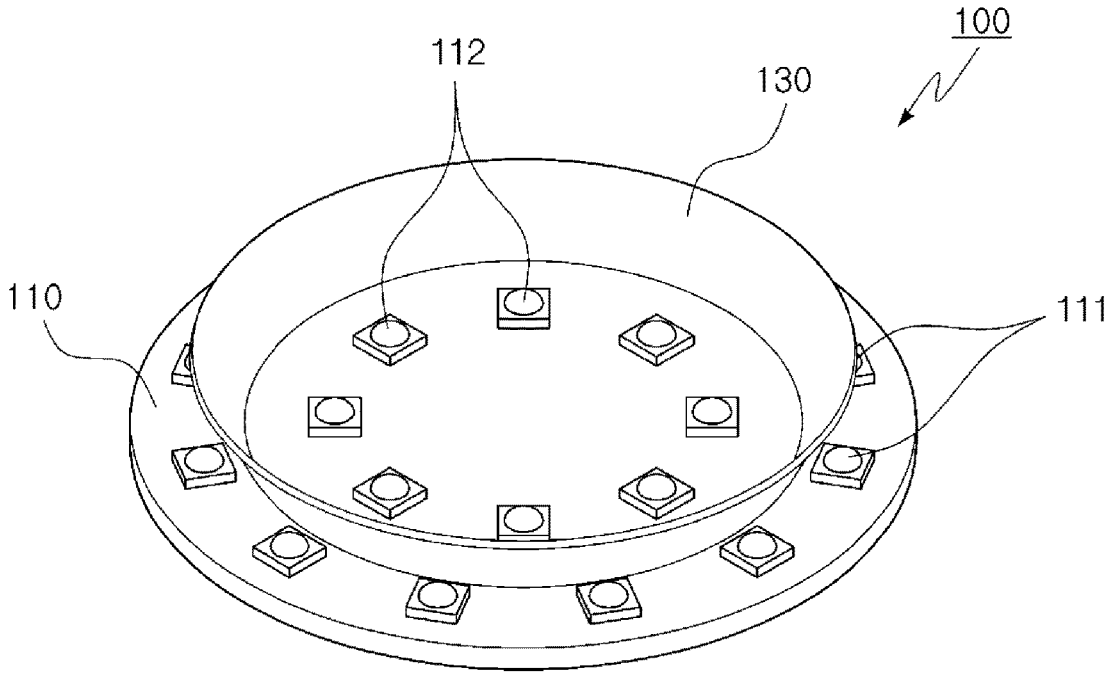
FIG. 3 is a perspective view that illustrates the LED illumination apparatus according to the first exemplary embodiment of the invention.

As illustrated in FIG. 2 and FIG. 3, the first light source 111, which may include a plurality of LED devices, is arrayed in a certain pattern on the peripheral area of the substrate 110, and the second light source 112, which may include a plurality of LED devices, is arrayed in another certain pattern on the inner area of the substrate 110.

Figure 4:
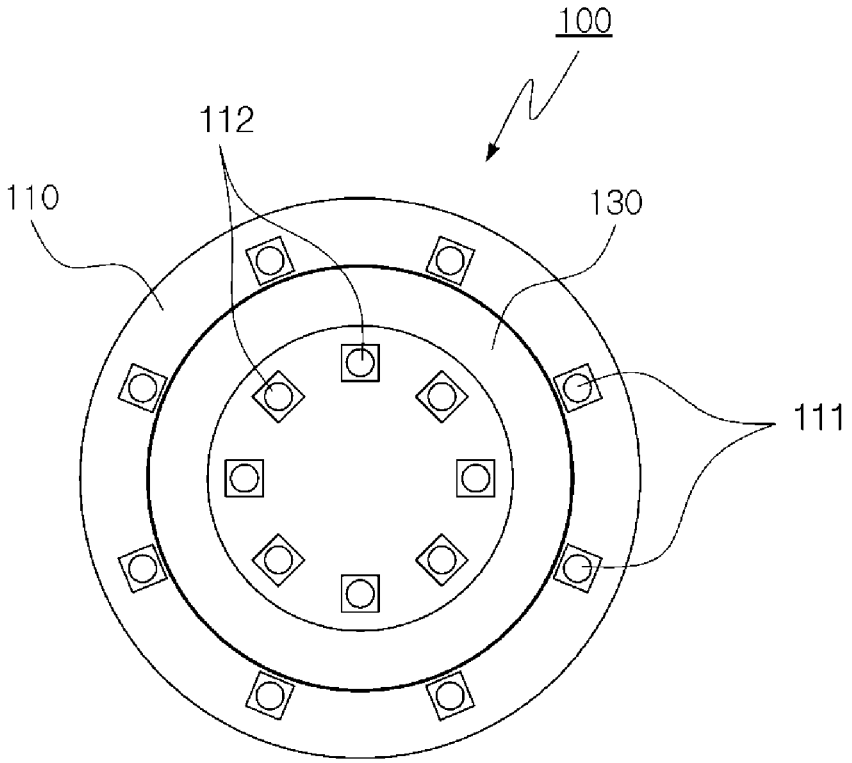
FIG. 4 is a top plan view that illustrates the layout of the light sources illustrated in FIG. 3.

In case the first light source 111 may include a plurality of first LED devices and the second light source 112 may include a plurality of second LED devices, the second LED devices 112 may be positioned such that they are alternately disposed with the first LED devices 111, which are disposed on the peripheral area of the substrate 110, as illustrated in FIG. 4. This is intended to make the light beams generated by the first LED devices 111 and the light beams generated by the second LED devices 112 to share the entire area of the light-transmitting cover 140, so that overall intensity of light is uniform.

Figure 11:
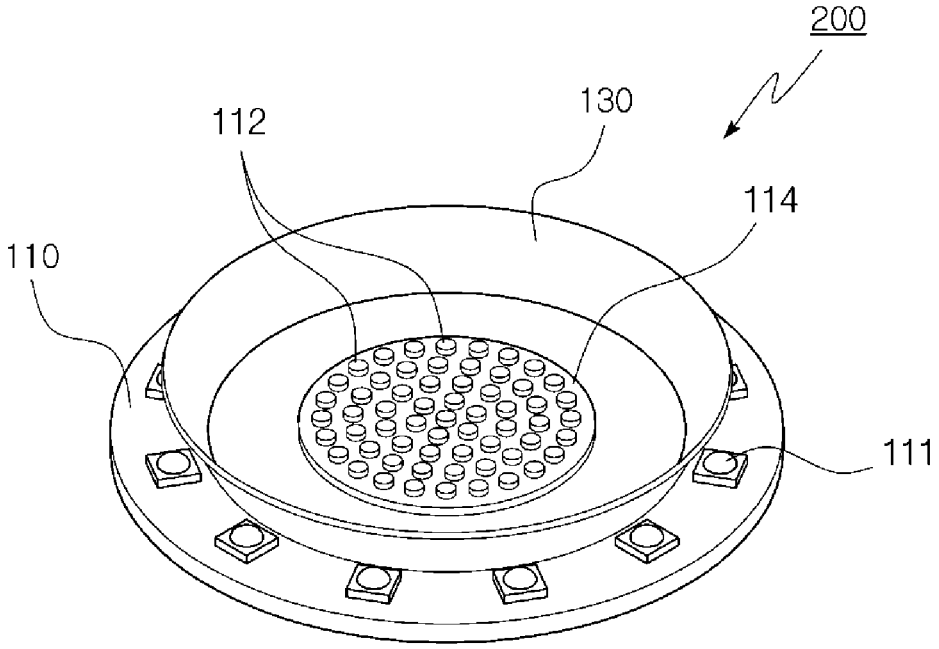
FIG. 11 is a perspective view of the LED illumination apparatus illustrated in FIG. 10.
Figure 12:
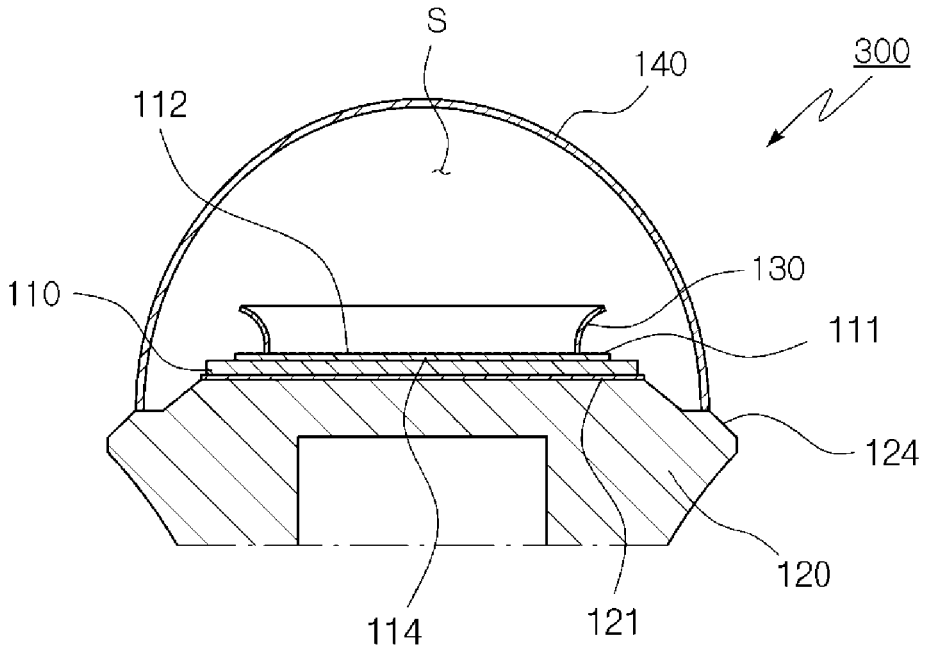
FIG. 12 is a cross-sectional view that illustrates the overall configuration of an LED illumination apparatus according to a third exemplary embodiment of the invention.
Figure 13:
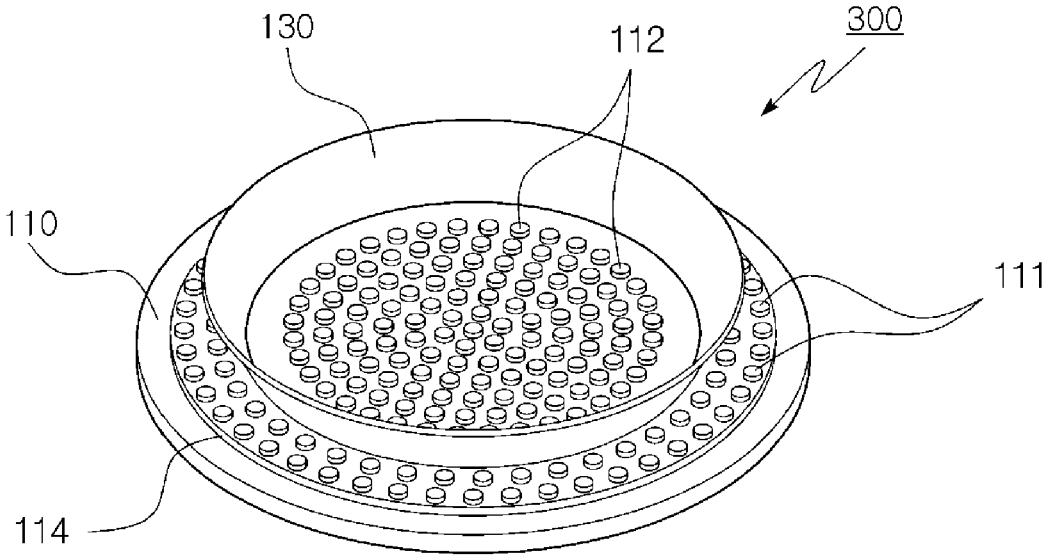
FIG. 13 is a perspective view of the LED illumination apparatus illustrated in FIG. 12.

In addition, as illustrated in FIG. 10 and FIG. 11, the second light source 112 in the inner area may be provided as a COB assembly, in which the LED chips are integrated. The first light source 111 in the peripheral area may include the packaged LED devices.

As illustrated in FIG. 12 to FIG. 15, both the first light source 111 at the peripheral area of the substrate 110 and the second light source 112 at the inner area may be provided as a COB assembly.

Here, if both the first light sources 111 and the second light sources 112 are formed as a COB assembly, the first light sources 111 and the second light sources 112 may be disposed on a board 114, such that the first light source 111, the second light source 112, and the reflector 130 may form a single device. In this case, the lower end of the reflector 130 is fixed to the upper surface of the board 114.

Figure 14:
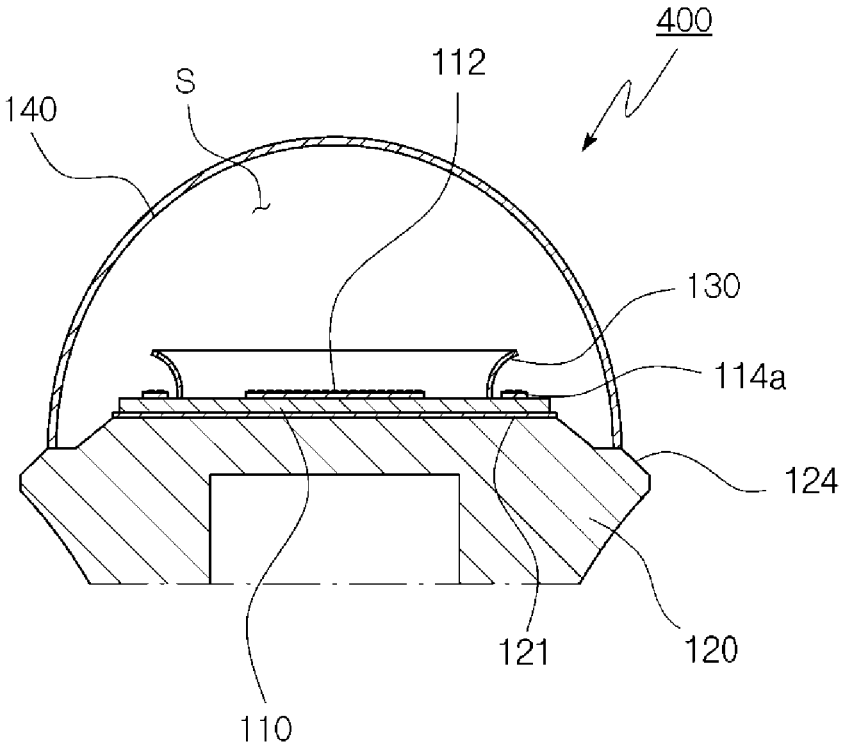
FIG. 14 is a cross-sectional view that illustrates the overall configuration of an LED illumination apparatus according to a fourth exemplary embodiment of the invention.
Figure 15:
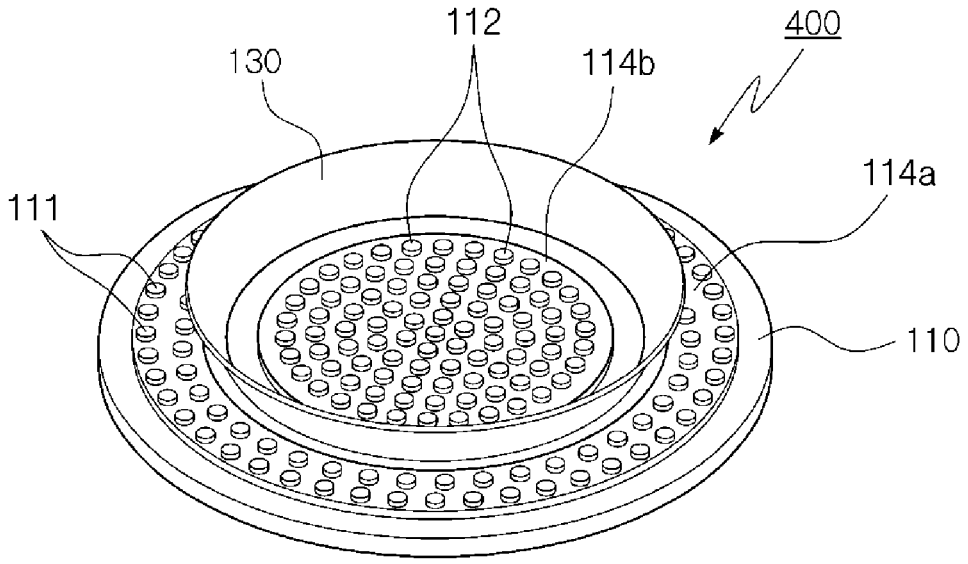
FIG. 15 is a perspective view of the LED illumination apparatus illustrated in FIG. 14.

In addition, as illustrated in FIG. 14 and FIG. 15, the board on which the LED chips 112 are disposed may be divided into two sections, including a first board 114*a*, which is disposed on the peripheral area of the substrate 110, and a second board 114*b*, which is disposed in the inner area of the substrate 110. The LED chips 111 that act as the first light source may be integrally disposed on the first board 114*a*, and the LED chips 112 that act as the second light source may be integrally disposed on the second board 114*b*. In this case, the reflector 130 is disposed at the boundary between the first board 114*a* and the second board 114*b*, and the lower end of the reflector 130 is fixed to the substrate 110, which is disposed under the first and second boards 123*a* and 123*b*.

Figure 5:
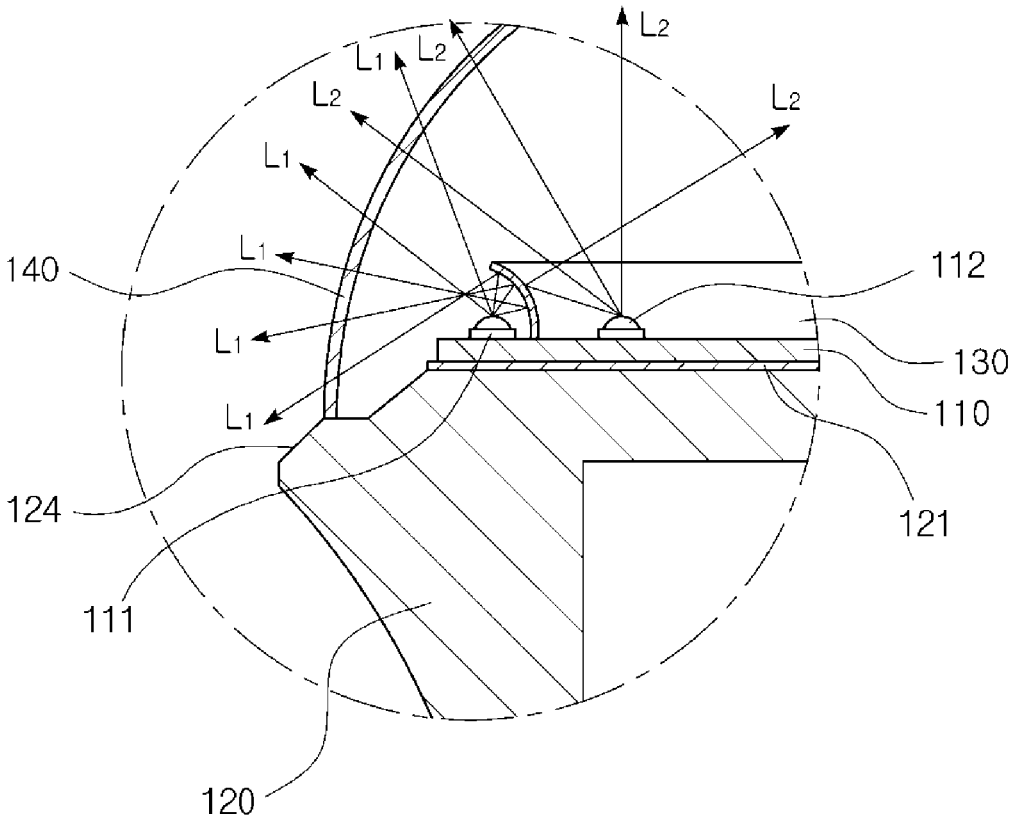
FIG. 5 is a detailed view that illustrates the reflection of light by the reflector and the travel of light in case the reflector employed in the present invention is disposed on the upper surface of the substrate.

In case the lower end of the reflector is fixed to the substrate 110 or the board 114 as illustrated in FIG. 14 to FIG. 15, a portion of light L1 that is generated by the first light source 111, which is disposed on the peripheral area of the substrate 110 or the board 114, is reflected by the outer surface of the reflector 130 so that it is radiated to the side and rear of the substrate 110 as illustrated in FIG. 5. At the same time, the remaining portion of the light L1 is not reflected by the reflector 130, 230 but is directly radiated toward the light-transmitting cover 140.

In addition, light L2 that is generated by the second light source 112, which is disposed on the inner area of the substrate 110, is radiated toward the light-transmitting cover 140, either after being reflected by the inner surface of the reflector 130 or without being reflected by the reflector 130, 230.

Here, the shape of the heat sink 120 should be designed to reduce interference of the portion of the light L1 that is generated by the first light source 111. Otherwise, the portion of the light L1 encounters interference by colliding with the heat sink 120 while traveling backward after being reflected by the outer surface of the reflector 130 or 230. For this, as described above, the guide surface 124, which has a downward slope at a certain angle, may be attached on the outer circumference of the heat sink 120 on which the substrate 110 is disposed.

The reflectors 130, 130*a*, 130*b*, 130*c*, 130*d*, and 230 may be provided in a variety of shapes that can realize an intended light distribution by allowing a portion of the light L1 that has been generated by the first light source 111 to be radiated directly to the front of the substrate 110 while the remaining portion of the light L1 is reflected to the side and rear.

Figure 6A:
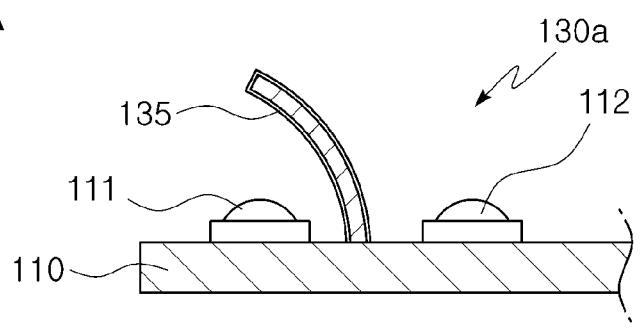

As illustrated in FIG. 6A, the reflector 130*a* may be configured as a curved reflector plate, in which a lower end thereof is fixed to the substrate 110, and an upper end thereof is oriented toward the first light source 111.

Figure 6B:
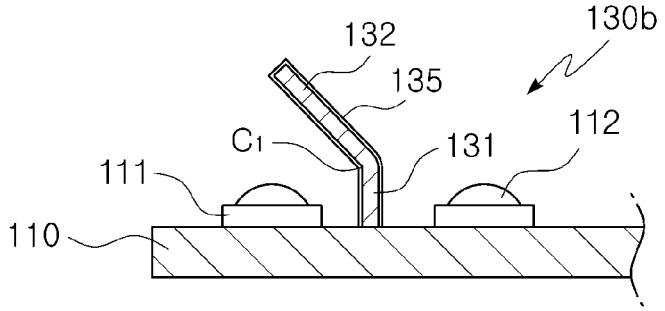

In addition, as illustrated in FIG. 6B, the reflector 130*b* may be configured as a reflector plate that has a vertical section 131 and an inclined section 132. The vertical section 131 vertically extends a certain height from a lower end thereof, which is fixed to the substrate 110. The inclined section 132 extends at a certain angle from an upper end of the vertical section 131 toward the first light source 111.

Figure 6C:
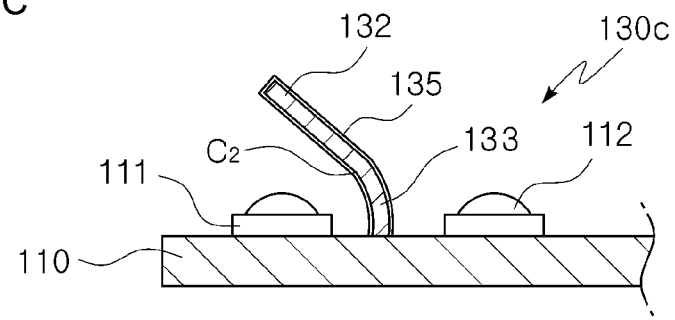

Furthermore, as illustrated in FIG. 6C, the reflector 130*c* may be configured as a reflector plate that has a lower curved section 131 and an inclined section 132. The lower curved section 131 is curved from a lower end thereof, which is fixed to the substrate 110, toward the first light source 111. The inclined section 132 extends at a certain angle from an upper end of the lower curved section 133 toward the first light source 111.

Figure 6D:
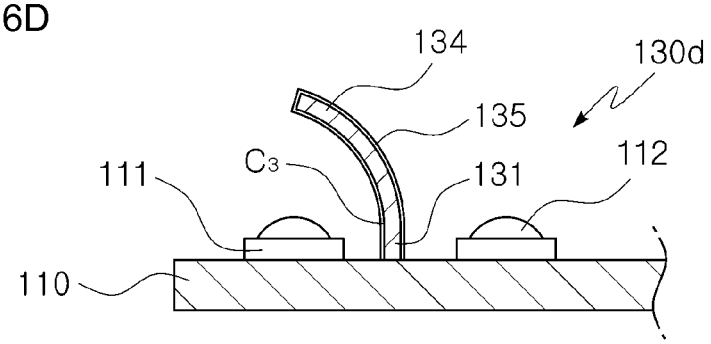

In addition, as illustrated in FIG. 6D, the reflector 130*d* may be configured as a reflector plate that has a vertical section 131 and an upper curved section 134. The vertical section 131 vertically extends a certain height from a lower end thereof, which is fixed to the substrate 110. The upper curved section 134 is curved from an upper end of the vertical section 131 toward the first light source 111.

The vertical section 131 and the inclined section 132 are connected to each other at a joint C1, the lower curved section 133 and the inclined section 132 are connected to each other at a joint C2, and the vertical section 131 and the upper curved section 134 are connected to each other at a joint C3. The joints C1, C2, and C3 be positioned at the same height as or higher than the first light source 111 so that the light L1 that is generated by the first light source 111 can be reflected to the side or rear.

Although the joints C1, C2, and C3 have been described as being integrally formed with respective reflectors 130*b*, 130*c*, and 130*d*, other configuration is also possible. The joints C1, C2, and C3 may be provided such that they can be assembled to the respective reflectors 130*b*, 130*c*, and 130*d*, depending on the design of the reflectors.

In each of the reflectors 130, 130*a*, 130*b*, 130*c*, 130*d*, and 230, which are provided in a variety of shapes as described above, the free end extends to the position directly above the first light source 111, such that a portion of the light L1 that is generated by the first light source 111 is radiated to the side and rear after being reflected by the reflector and the remaining portion of the light L1 is radiated to the front together with the light L2 that is generated by the second light source 112.

In addition, the reflectors 130, 130*a*, 130*b*, 130*c*, 130*d*, and 230 may be made of a resin or a metal, and one or more reflecting layers 135 may be attached on the outer surface of the reflectors 130, 130*a*, 130*b*, 130*c*, 130*d*, and 230 to increase reflection efficiency when reflecting light that is generated by a light source.

The reflecting layer 135 may be formed on the surface of the reflector with a certain thickness. For this, a reflective material, such as aluminum (Al) or chromium (Cr), may be applied to the surface of the reflector by a variety of methods, such as deposition, anodizing, or plating.

Although the reflecting layer 135 has been illustrated and described as being formed with a certain thickness on the entire outer surface of the reflector such that it can reflect a large portion of the light that is generated by the first and second light sources 111 and 112, other configuration is also possible. For example, the reflecting layer 135 may be formed only on the outer surface of the reflectors 130 and 230, which corresponds to the first light source 111, such that only the light L1 that is generated by the first light source 111 can be reflected.

In case the reflectors 130 and 230 are made of a metal, an insulating material or insulation may be provided between the surface of the substrate 110 and the lower end of the reflectors 130 and 230 to prevent short circuits.

The reflector 130 of this embodiment is provided as a reflector plate having a certain height, as illustrated in FIG. 2 to FIG. 8 and FIG. 10 to FIG. 16. The lower end of the reflector may be fixedly assembled to the substrate 110 or the board 114 by a variety of methods. An exemplary method is illustrated in FIG. 7.

Figure 7A:
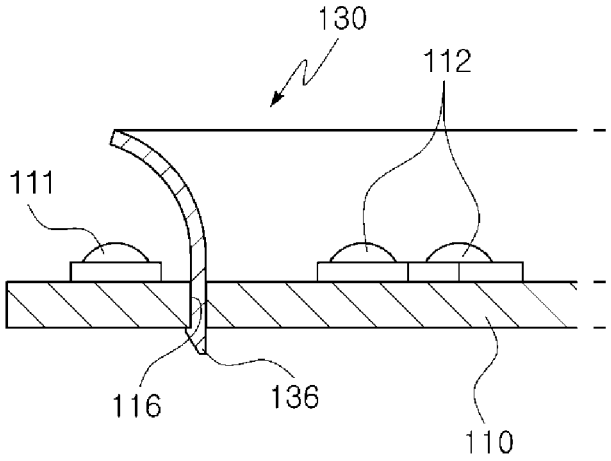

As illustrated in FIG. 7A, the reflector 130 may have a hook 136 on the lower end thereof. The hook 136 may be fitted into an assembly hole 116, which penetrates the substrate 110. In this configuration, the hook 136 generates a holding force, thereby preventing the lower end of the reflector 130 from being dislodged.

Figure 7B:
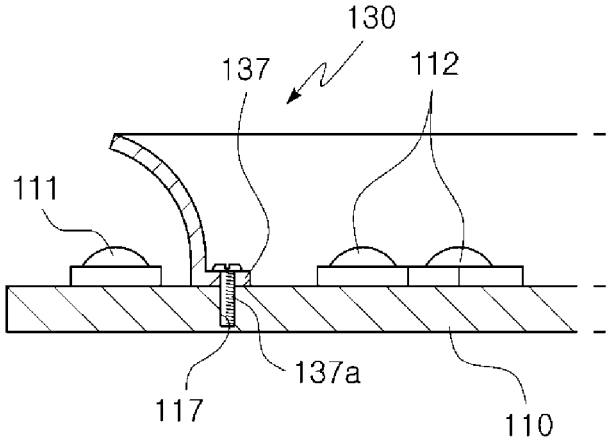

As illustrated in FIG. 7B, the reflector 130 has a coupling section 137, which is bent from the lower end thereof to the side. The coupling section 137 may be fastened to a coupling hole 117, which penetrates the substrate 110, via a fastening member 137*a*.

Although the coupling section 137 has been illustrated as being bent toward the second light source 112 such that it can increase reflection efficiency by reducing interference with the light that is generated by the first light source 111, other configuration is also possible. For example, the coupling section 137 may be bent toward the first light source 111.

Figure 7C:
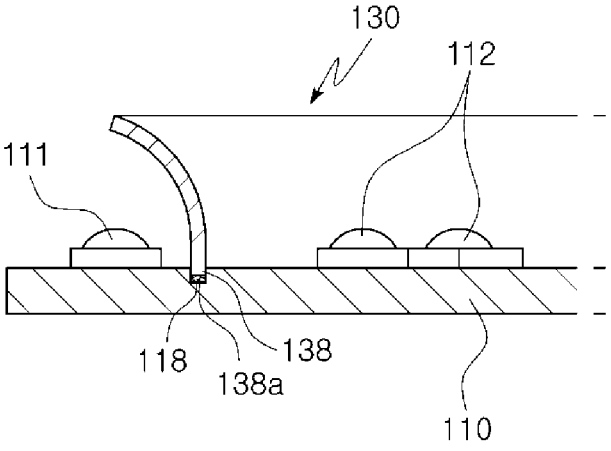

In addition, as illustrated in FIG. 7C, the reflector 130 has a fitting protrusion 138 on the lower end thereof. The fitting protrusion 138 is fitted into a recess 118, which is depressed into the upper surface of the substrate 110 to a certain depth, and is fixedly bonded thereto via an adhesive 138*a*.

Here, each of the assembly hole 116, the coupling hole 117, and the recess 118, which are formed in the substrate 110, should be configured such that it does not overlap a pattern circuit, which is printed on the upper surface of the substrate in order to supply electrical power to the first light source 111. Two or more hooks 136 corresponding to the assembly holes 116 may be provided on the lower end of the reflector 130 such that they are spaced apart from each other at a certain interval. Two or more coupling sections 137 corresponding to the coupling holes 117 and two or more fitting protrusions 138 corresponding to the recesses 118 may be provided on the lower end of the reflector 130 in a similar manner.

Figure 16:
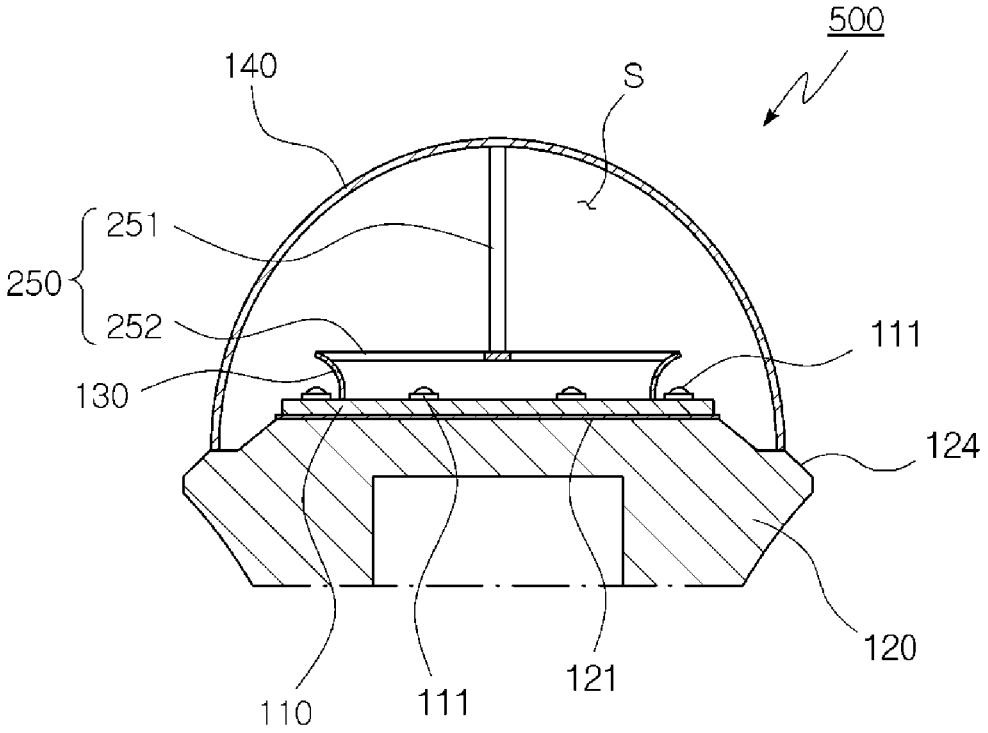
FIG. 16 is a cross-sectional view that illustrates the overall configuration of an LED illumination apparatus according to a fifth exemplary embodiment of the invention.
Figure 17:
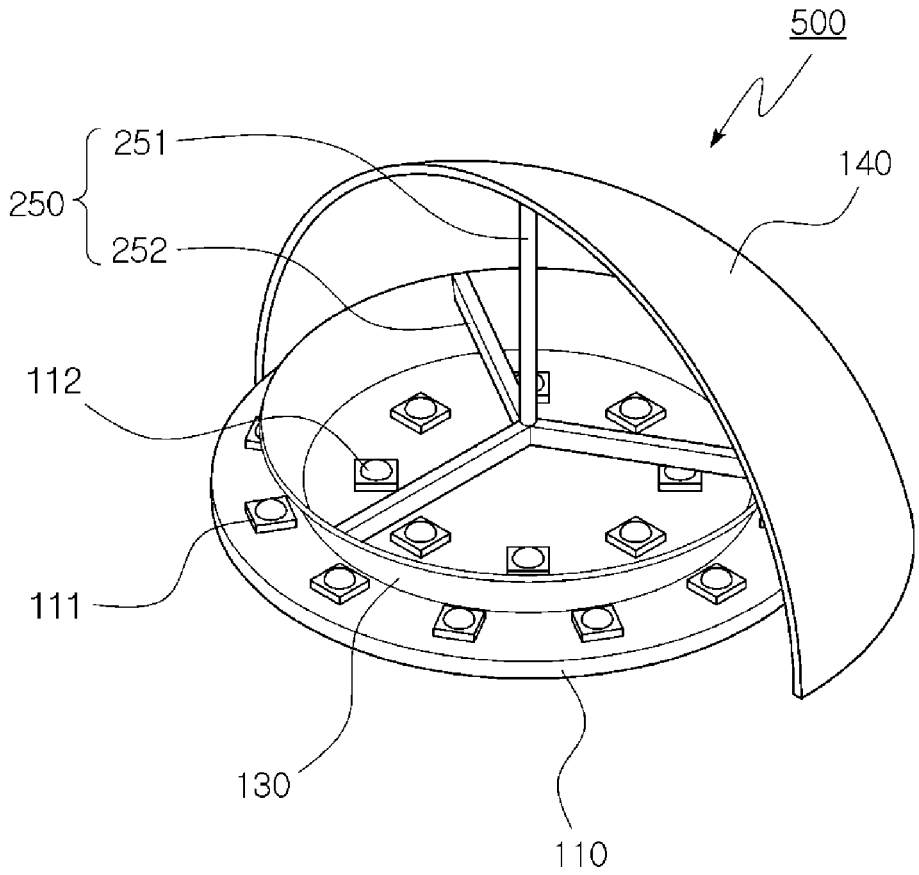
FIG. 17 is a perspective view of the LED illumination apparatus illustrated in FIG. 16.

In another embodiment of the LED illumination apparatus 500 of the present invention, as illustrated in FIG. 16 and FIG. 17, the reflector 130 may be supported by support members 250, which connect the reflector 130 to the light-transmitting cover 140, with the lower end thereof being fixed to the upper surface of the substrate 110.

For this, the support members 250 may include a vertical member 251, which has a certain height, and horizontal members 252, which are connected to the lower end of the vertical member 251. Specifically, the vertical member 251 has a certain length, the upper end of the vertical member 251 is connected to the light-transmitting cover 140, and the lower end of the vertical member 251 is connected to the horizontal members 252, which are disposed across the reflector 130.

The horizontal members 252 may be provided as a plurality of members, which extend in transverse directions from the center of the reflector 130. The point at which the horizontal members 252 are connected to each other may be connected to the lower end of the vertical member 251, and the horizontal members 252 may be radially disposed in order to maintain the balance of force.

The sum of the vertical length of the vertical member 251 and the height of the reflector 130 may the same as or greater than the maximum height from the substrate 110 to the light-transmitting cover 140, and the upper end of the vertical member 251 may be connected to the center of the light-transmitting cover 140. Furthermore, the lower end of the vertical member 251 may be disposed on the center of the reflector 130.

Consequently, when the light-transmitting cover 140 and the heat sink 120 are coupled to each other, the horizontal member 252 and the reflector 130 are pressed and supported downward by the vertical member 251 so that the lower end of the reflector 130 remains in contact with the upper surface of the substrate 110, thereby locating the reflector 130 in the boundary area between the first light source 111 and the second light source 112.

The reflector 130, which is connected to the light-transmitting cover 140 by the support members 250, may be formed integrally with the light-transmitting cover 140, or may be configured such that the intermediate portion or the upper end of the vertical member 251 is detachably assembled to the light-transmitting cover 140.

In an exemplary embodiment, the vertical member 251 may be configured as two separate members, in which the adjoining ends of the two members are detachably assembled to each other via screw fastening or interference fitting.

As illustrated in FIG. 18 to FIG. 23, in other embodiments of the LED illumination apparatuses 600 and 700 of the present invention, the reflector 130, which reflects light that is generated by the first light source 111 to the side or rear, may be spaced apart a certain height from the substrate 110.

For this, support members 250 and spacer members 260 are provided such that the lower end of the reflector 130 is located in a boundary area between the first light source 111 and the second light source 112.

Figure 18:
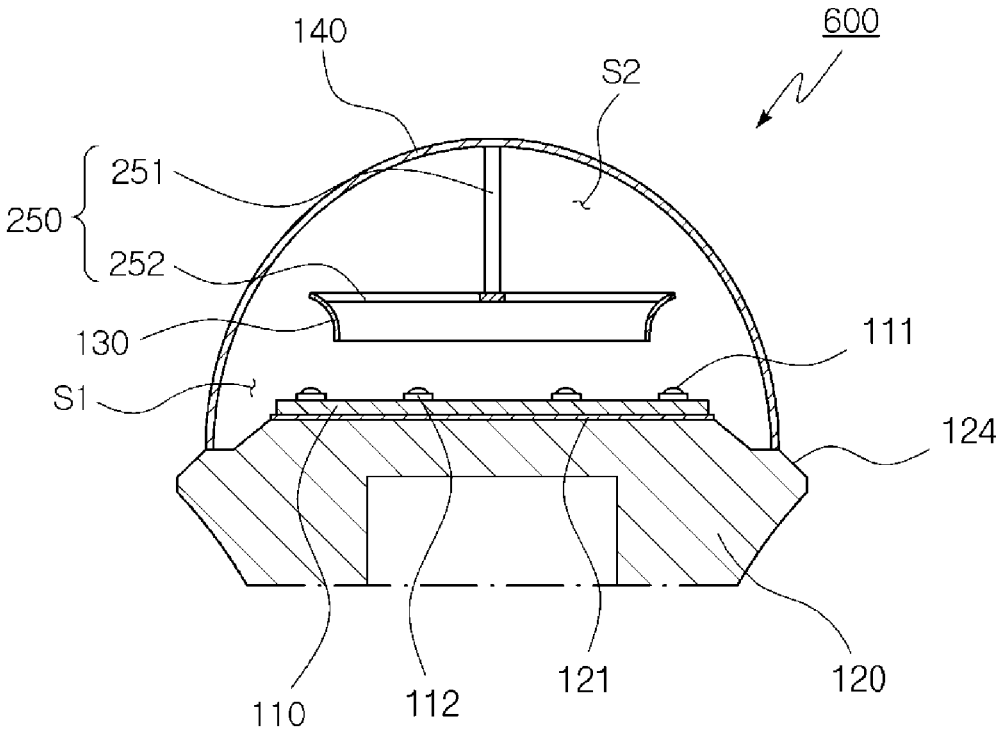
FIG. 18 is a cross-sectional view that illustrates the overall configuration of an LED illumination apparatus according to a sixth exemplary embodiment of the invention.
Figure 19:
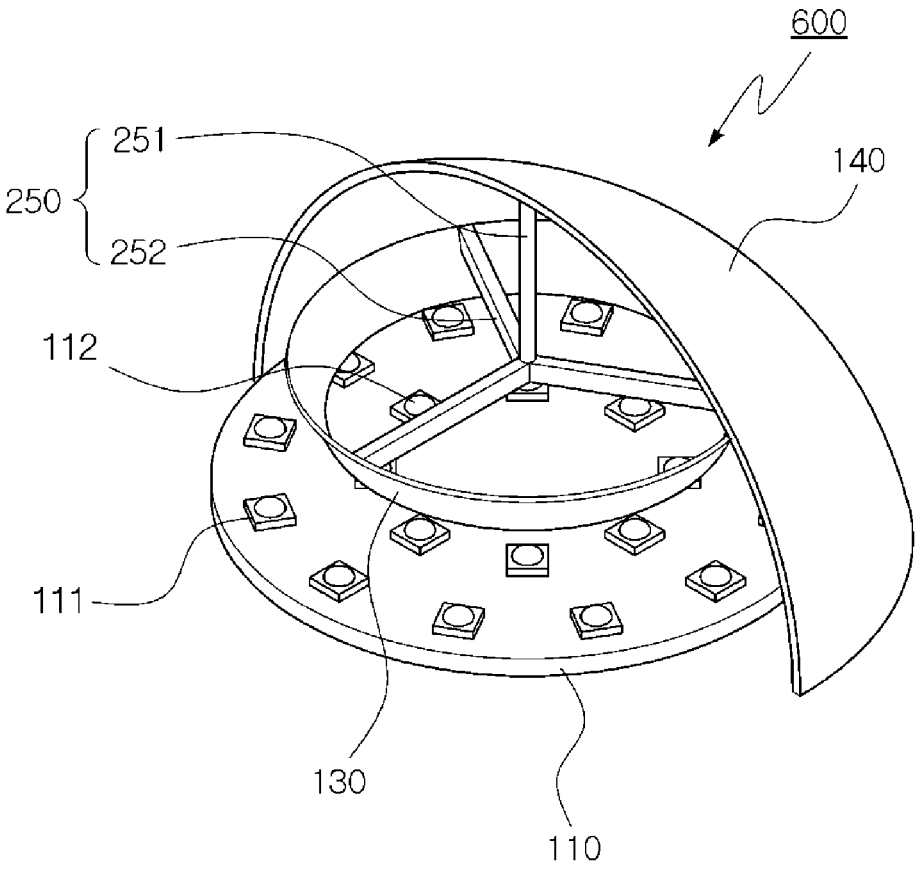
FIG. 19 is a perspective view of the LED illumination apparatus illustrated in FIG. 18.

As described above, the support members 250 may include a vertical member 251 and one or more horizontal members 252. An end of the vertical member 251 is connected to the light-transmitting cover 140, and the horizontal members 252 extend from the lower end of the vertical member 251 as shown in FIG. 18 and FIG. 19.

Like the support members 250 illustrated in FIG. 16 and FIG. 17, the support members 250 are configured such that the vertical member 251 extends a certain height and the horizontal members 252 are connected to the lower end of the vertical member 251. The upper end of the vertical member 251 is connected to the light-transmitting cover 140, and the lower end of the vertical member 251 is connected to the horizontal members 252, which are disposed across the reflector 130.

The horizontal members 252 may be provided as a plurality of members, which extend in transverse directions from the center of the reflector 130. The point at which the horizontal members 252 are connected to each other is connected to the lower end of the vertical member 251. The horizontal members 252 may be radially disposed in order to maintain the balance of force.

The sum of the vertical length of the vertical member 251 and the height of the reflector 130 may be smaller than the maximum height from the substrate 110 to the light-transmitting cover 140 such that the lower end of the reflector 130 is spaced apart a certain length from the substrate 110, thereby defining a space S3 between the lower end of the reflector 130 and the upper surface of the substrate 110.

Consequently, when the light-transmitting cover 140 is coupled to the heat sink 120, the horizontal members 252 and the reflector 130 are disposed in the space S in the light-transmitting cover 140 while they are spaced apart a certain height from the upper surface of the substrate 110 by the vertical member 251.

The reflector 130, which is connected to the light-transmitting cover 140 by the support members 250, may be formed integrally with the light-transmitting cover 140, or may be configured such that the intermediate portion or the upper end of the vertical member 251 is detachably assembled to the light-transmitting cover 140.

In an exemplary embodiment, the vertical member 251 may be configured as two separate members, in which the adjoining ends of the two members may be detachably assembled to each other via screw fastening or interference fitting.

Figure 21:
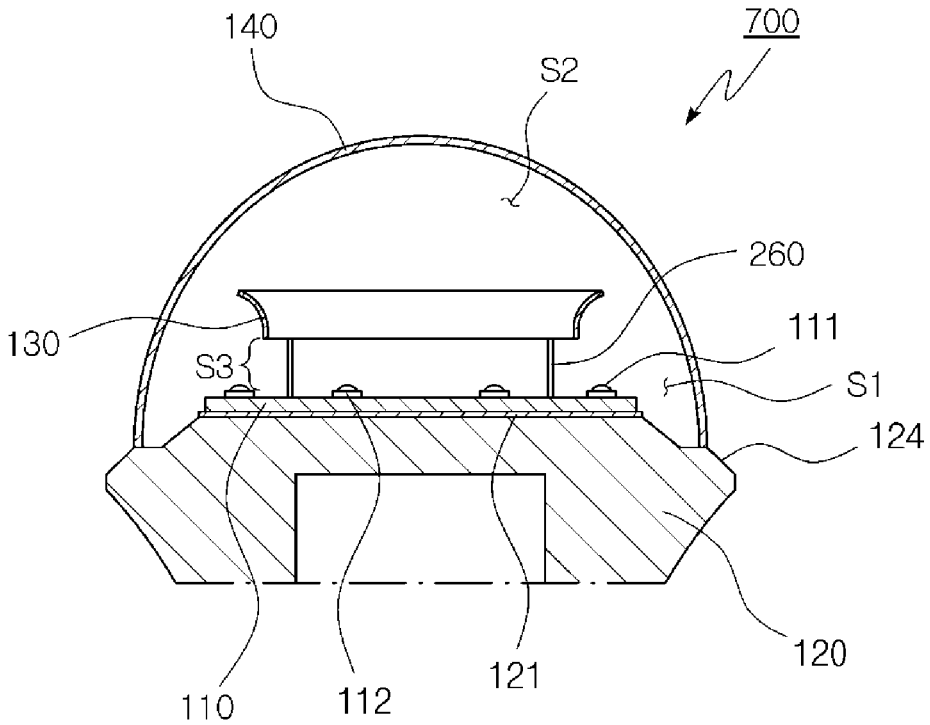
FIG. 21 is a cross-sectional view that illustrates the overall configuration of an LED illumination apparatus according to a seventh exemplary embodiment of the invention.
Figure 22:
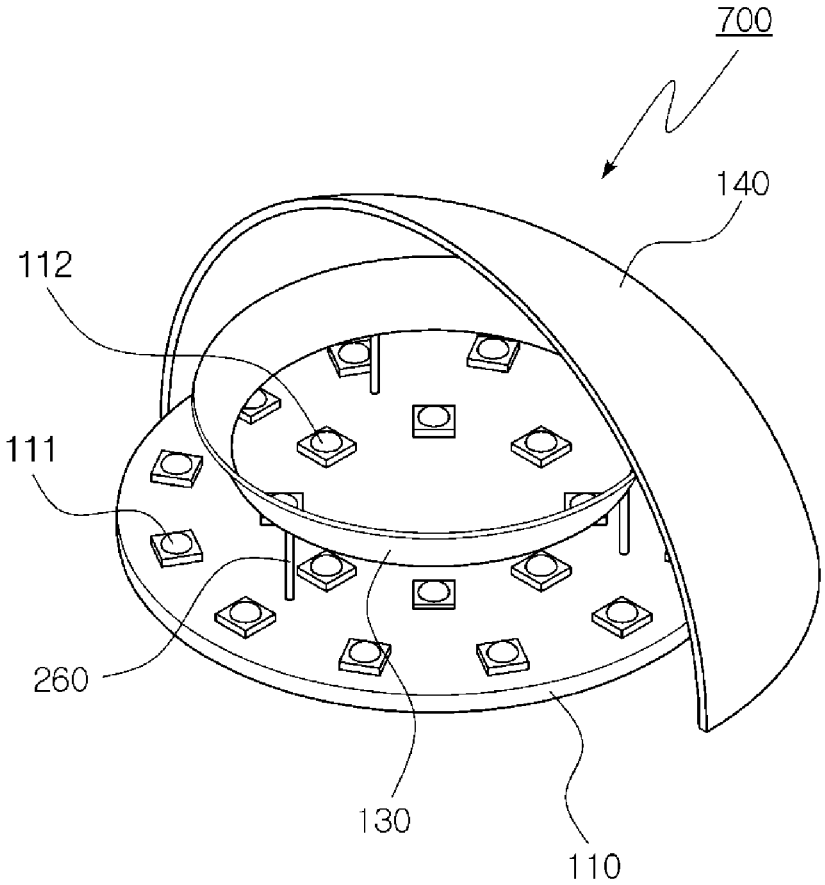
FIG. 22 is a perspective view of the LED illumination apparatus illustrated in FIG. 21.

Another configuration of the reflector 130 and the substrate 110 is illustrated in FIG. 21 and FIG. 22, wherein the reflector 130 is spaced apart a certain height from the substrate 110 to define a space S3 between the lower end of the reflector 130 and the upper surface of the substrate 110.

Here, provided are one or more spacer members 260 having a certain height, which connect the lower end of the reflector 130 to the upper end of the substrate 110, such that the reflector 130 is spaced apart a certain height from the substrate 110. For structural stability, the spacer members 260 may be two or more members, which are radially disposed.

The upper end of the spacer member 260 is connected to the lower end of the reflector 130 and the lower end of the spacer member 260 is fixed to the upper surface of the substrate 110. It should be appreciated that the lower end of the spacer member 260 may be fixed to the substrate 110 by a plurality of structures, as illustrated in FIG. 7.

Figure 20:
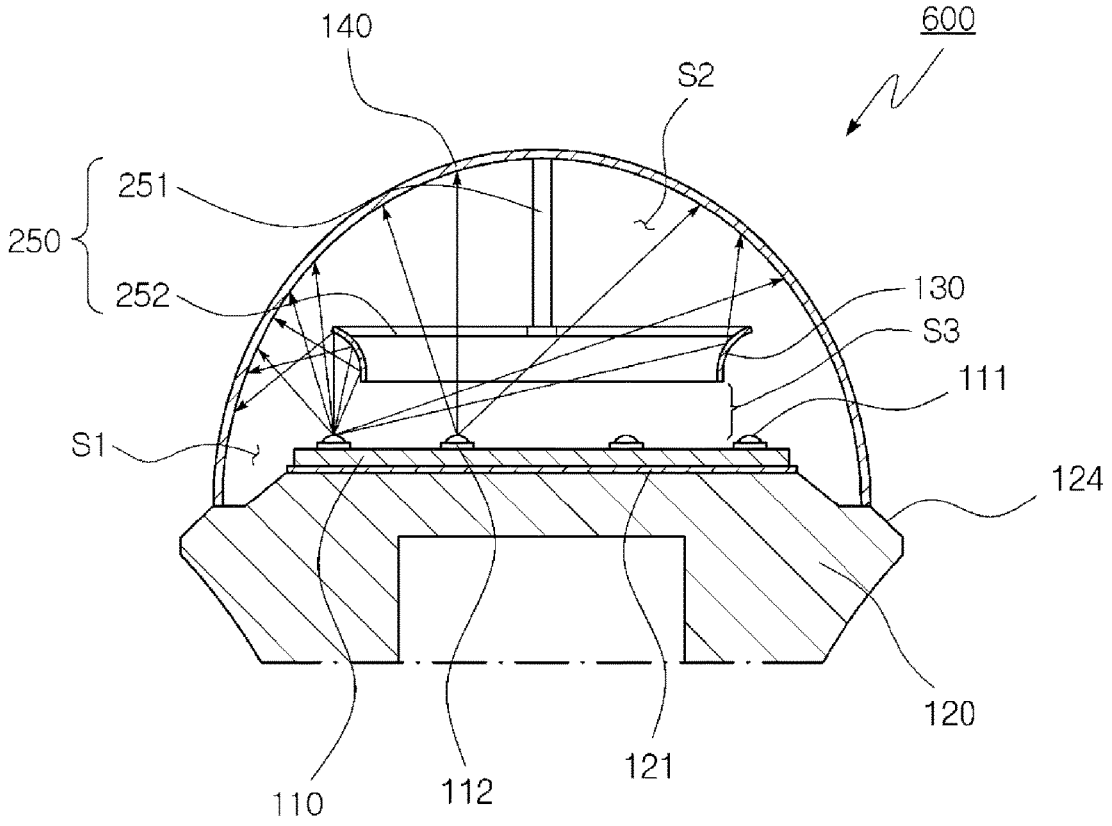
FIG. 20 is a detailed view that illustrates the reflection of light by the reflector and the travel of light in the LED illumination apparatus illustrated in FIG. 18.
Figure 23:
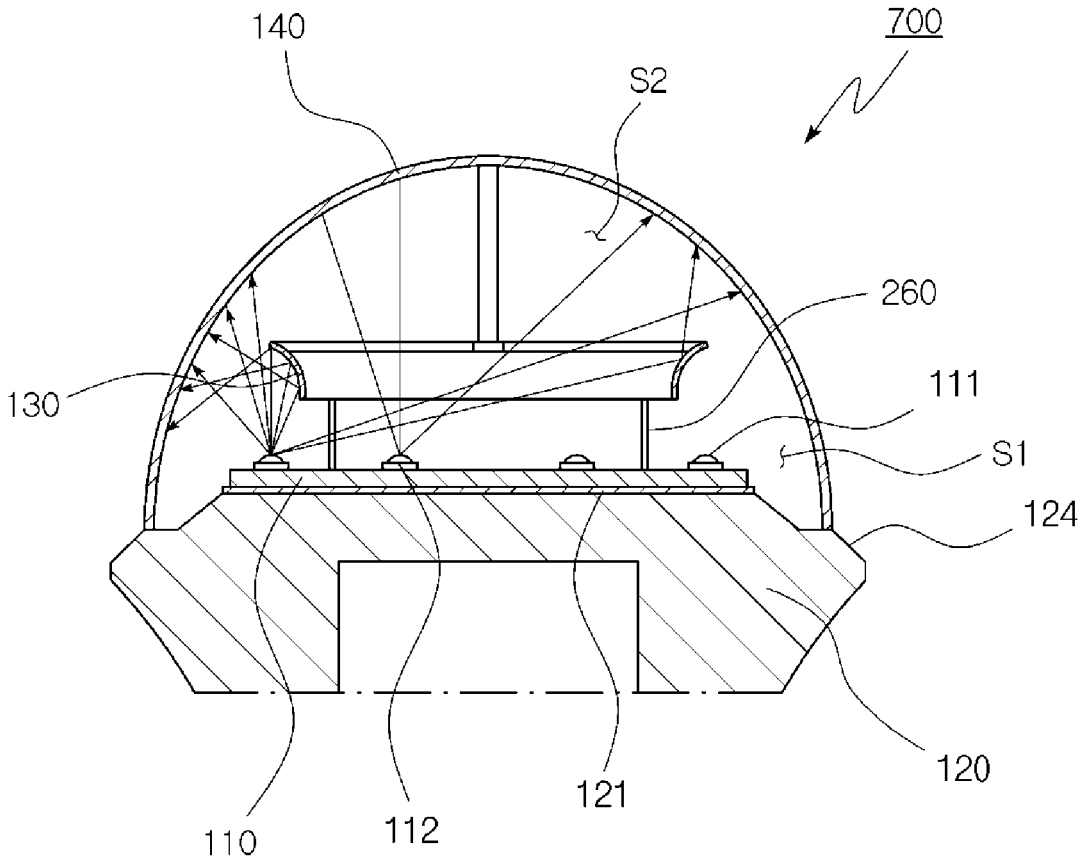
FIG. 23 is a detailed view that illustrates the reflection of light by the reflector and the travel of light in the LED illumination apparatus illustrated in FIG. 21.

FIG. 20 and FIG. 23 illustrate the light reflected by the reflector 130 in case the reflector 130 is spaced apart a certain height from the substrate 110 via the support members 250 or the spacer members 260.

As illustrated in FIG. 20 and FIG. 23, a portion of the light that is generated by the first light source 111 is radiated to the side and rear of the substrate 110 after being reflected by the outer surface of the reflector 130, and the remaining portion of the light L1 is radiated toward the area above the second light source 112 after being reflected from the inner surface of the reflector 130, or is directly radiated toward the area above the second light source 112. Consequently, the light that is generated by the first light source 111 is radiated on all of the center, side, and rear of the light-transmitting cover 140 without being reflected to the side and rear of the reflector. In this manner, the light can be uniformly radiated, rather than being concentrated in a specific area.

The LED illumination apparatuses 800 and 900 may be provided according to further exemplary embodiments of the present invention. As illustrated in FIG. 25 to FIG. 29, the light-transmitting cover 140 may include two sections, i.e. a first cover 141 and a second cover 142. The first and second covers 141 and 142 are coupled to each other via the upper end of the reflector 230.

The lower end of the reflector 230 is disposed on the boundary area between the first light source 111 and the second light source 112, and the upper end of the reflector 230 is fixedly connected to the light-transmitting cover 140. For this, the extension 231 of the reflector 230 diverges and extends a certain length toward the first cover 141 and toward the second cover 142.

The extension 231 is in contact with and meshed with an end of the first cover 141 and an end of the second cover 142, and serves to couple the first and second cover 141 and 142 to each other. For this, a stepped portion 232, which is depressed to a certain depth, is formed in an end of the first cover 141, which is coupled with the extension 231. The other stepped portion 232, having the same configuration, is formed in an end of the second cover 142, which is coupled with the extension 231.

It should be understood that the extension 231 may be fixed by a variety of structures, including a structure in which the extension 231 is fixed to the stepped portions of the first cover 141 and the second cover 142 via an adhesive, and a structure in which the extension 231 is fitted into the recesses that are respectively formed in an end of the first cover 141 and in an end of second cover 142.

In the reflector 230 having the upper end connected to the light-transmitting cover 140, the lower end of the reflector 230 is in contact with the upper surface of the substrate 110. More particularly, the lower end of the reflector 230 is in contact with the boundary area between the first light source 111 and the second light source 112, or is spaced apart a certain height from the substrate 110 while being disposed in the boundary area between the first and second light sources 111 and 112.

Figure 24:
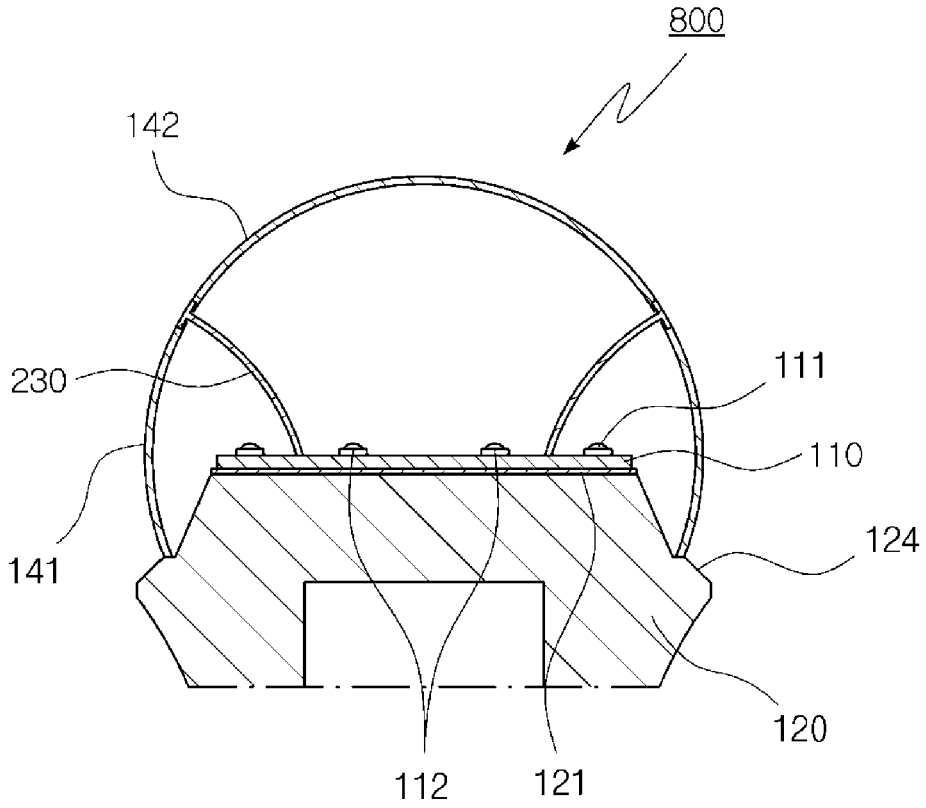
FIG. 24 is a cross-sectional view that illustrates the overall configuration of an LED illumination apparatus according to an eighth exemplary embodiment of the invention.
Figure 25:
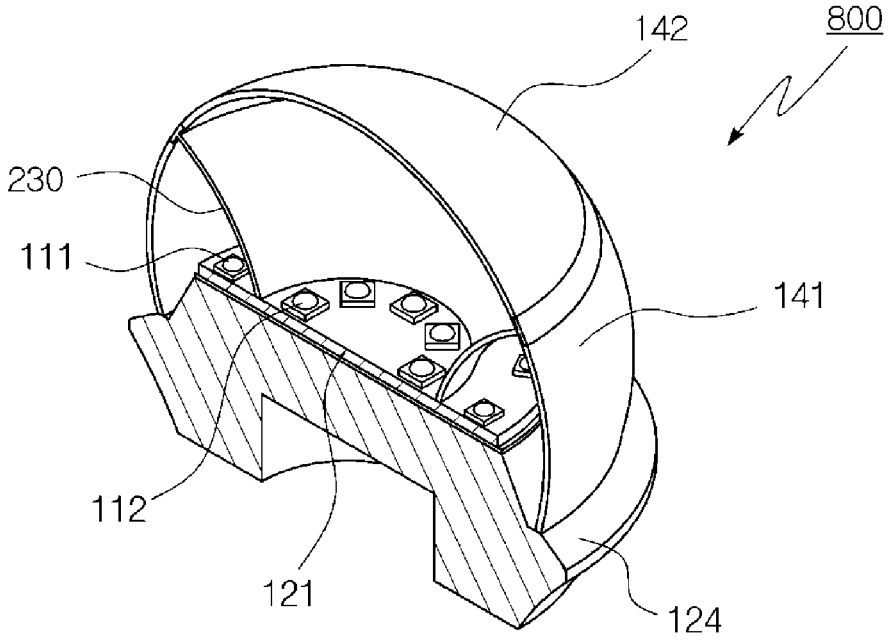
FIG. 25 is a perspective view of the LED illumination apparatus illustrated in FIG. 24.

In case the lower end of the reflector 230 is in contact with the substrate, as illustrated in FIG. 24 and FIG. 25, the space S inside the light-transmitting cover 140 is divided into two sections by the reflector 230. Consequently, the light L1 that is generated by the first light source 111 is radiated to the side and rear of the substrate 110 after being reflected by the outer surface of the reflector 230, whereas the light L2 that is generated by the second light source 112 is radiated toward the second cover 142 after being reflected by the inner surface of the reflector 230, or is directly radiated toward the second cover 142 (see FIG. 26).

Figure 27:
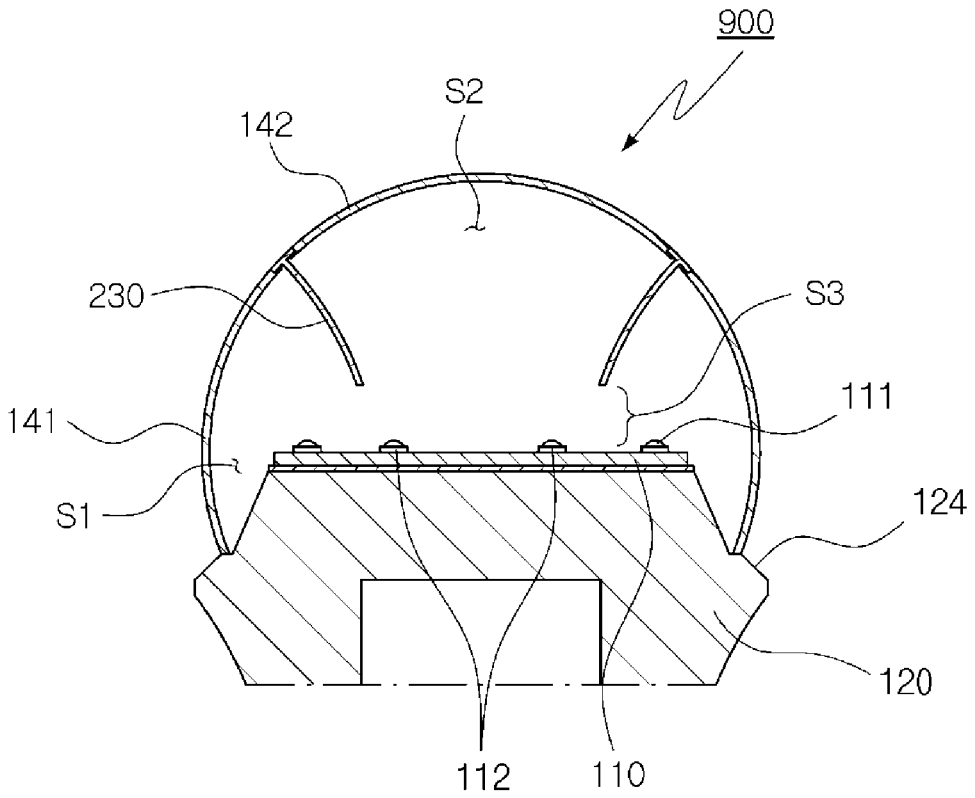
FIG. 27 is a cross-sectional view that illustrates the overall configuration of an LED illumination apparatus according to a ninth exemplary embodiment of the invention.
Figure 28:
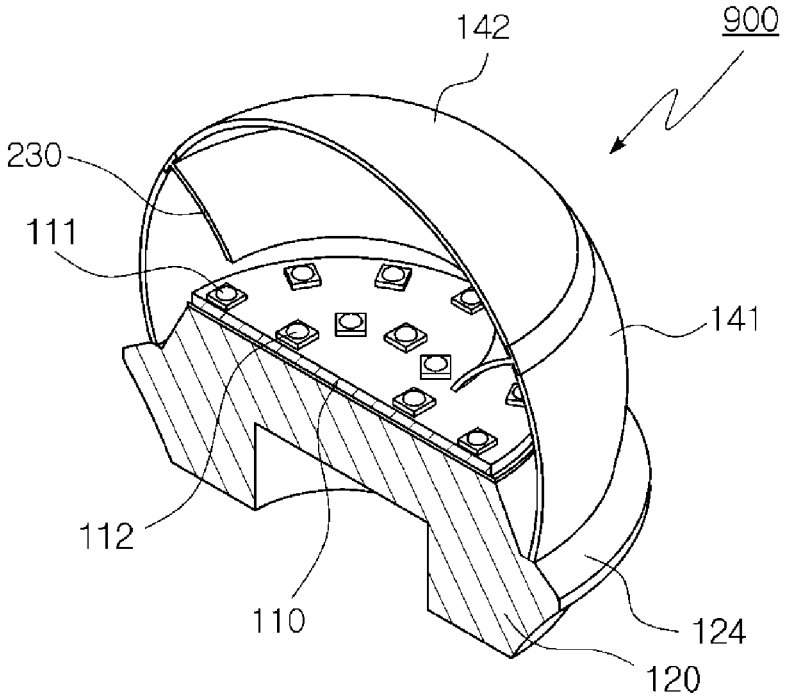
FIG. 28 is a perspective view of the LED illumination apparatus illustrated in FIG. 27.

In addition, as illustrated in FIG. 27 and FIG. 28, in case the lower end of the reflector 230 is located in the boundary area between the first light source 111 and the second light source 112 and is spaced apart a certain height from the substrate 110, the space S of the light-transmitting cover 140 is divided into the spaces S1, S2, and S3. In the space S1, the light that is generated by the first light source 111 is reflected to the side and rear by the outer surface of the reflector 230. In the space S2, the light is reflected by the inner surface of the reflector 230, or is directly radiated toward the second cover 142. In addition, the light that is generated by the first light source 111 is radiated toward the second cover 142 by passing through the space S3. The light that is generated by the first light source 111 and the second light source 112 is radiated along various paths illustrated in FIG. 29 toward the first cover 141 and the second cover 142.

In this embodiment, the lower end of the reflector 230 is spaced apart a certain height from the substrate 110 for the same reason as described in the aforementioned embodiments. Specifically, the light that is generated by the first light source 111 is also radiated toward the second cover 142 through the space S3 instead of being entirely reflected to the side and rear by the reflector. In this manner, the light can be uniformly radiated, rather than being concentrated in a specific area.

The reflectors 130 and 230 of these embodiments may have a plurality of cross-sectional shapes, as illustrated in FIG. 8.

Figure 8A:
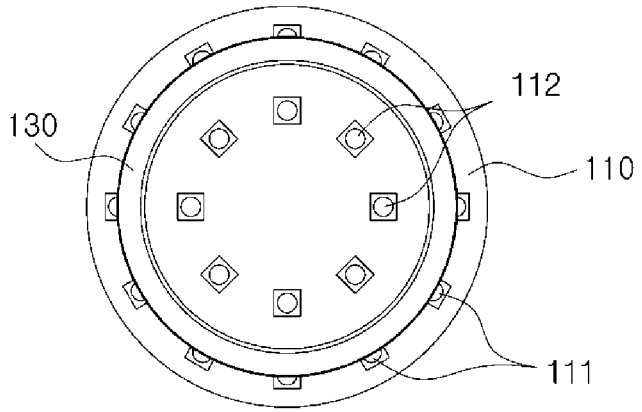

Specifically, as illustrated in FIG. 8A, the reflectors 130 and 230 may be configured as a reflector plate, which has a cavity along the circular boundary area defined between the first light source 111 and the second light source 112.

Figure 8B:
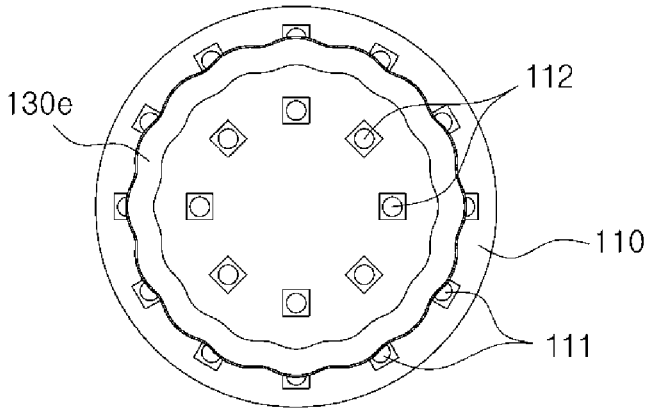

As illustrated in FIG. 8B, the reflector 130*e* may be configured as a reflector plate that has a wavy cross-sectional shape. Specifically, waves span for a certain period such that the light that is generated by the first light source 111 or the second light source 112 can be spread again in the direction parallel to the substrate 110.

Figure 8C:
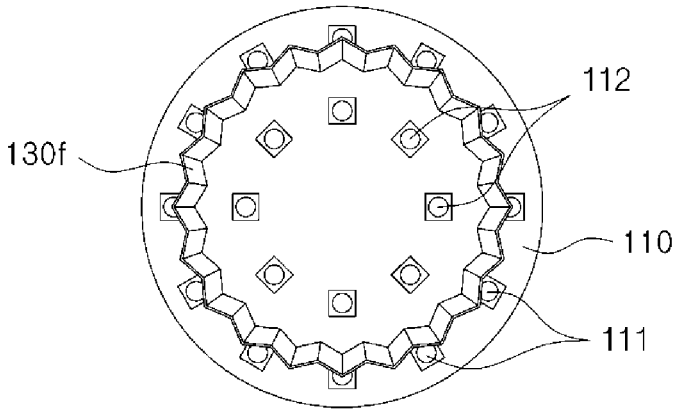
Figure 9A:
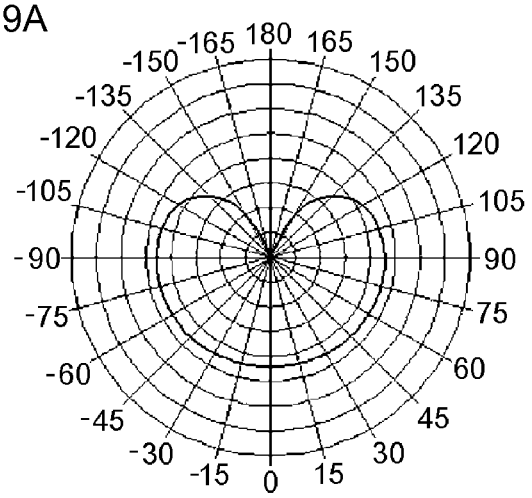
FIG. 9A, FIG. 9B, and FIG. 9C are graphs showing the distribution of light that is generated from a light source, in which an incandescent lamp was used in FIG. 9A, a typical LED illumination apparatus was used in FIG. 9A, and an LED illumination apparatus of the present invention was used in FIG. 9A.
Figure 9B:
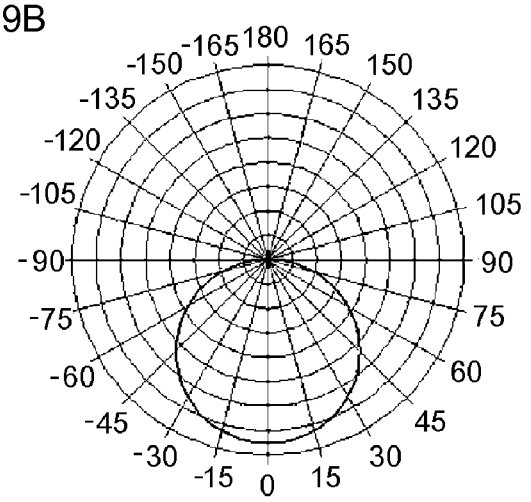
Figure 9C:
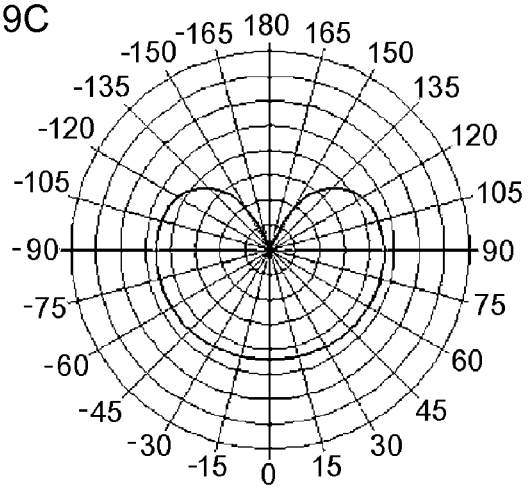

In addition, as illustrated in FIG. 8C, the reflector 130*f* may be configured as a reflector plate that has a toothed cross-sectional shape, in which teeth span for a certain period such that the light that is generated by the first light source 111 or the second light source 112 can be spread again in the direction parallel to the substrate 110.

In the LED illumination apparatuses 100, 200, 300, 400, 500, 600, 700, 800, 900, 1100, and 1200 according to exemplary embodiments, each of the reflectors 130 and 230 is disposed in the boundary area between the first light source 111 and the second light source 112. When the first light source 111 and the second light source 112 are turned on in response to the application of external power, a portion of the light L1 that is generated by the first light source 111 is reflected by the outer surface of the reflector, the cross section of which is curved or inclined toward the first light source 111, so that the portion of the light L1 travels toward the side or rear, whereas the remaining portion of the light L1 travels toward the light-transmitting cover 140 without being reflected by the reflector.

In addition, the light L2 that is generated by the second light source 112 travels toward the light-transmitting cover 140 after being reflected by the inner surface of the reflector or without being interfered by the reflector. Consequently, the LED illumination apparatuses 100, 200, 300, 400, 500, 600, 700, 800, 900, 1100, and 1200 of these embodiments can realize light distribution (FIG. 9C), which is the same as light distribution (FIG. 9B) that can be produced from an incandescent lamp, and produce an increased angular range of 270° or more.

Referring to FIG. 30 to FIG. 36, in the LED illumination apparatus 1000 according to another exemplary embodiment of the present invention, the reflector 1030 has an inclined surface, which reflects light that is generated by a light source, and a horizontal surface on which the light source is disposed.

Here, the LED illumination apparatus 1000 may include the substrate 110, the first light source 111, the second light source 112, and the reflector 1030.

In the reflector 1030 having the horizontal surface and the inclined surface, descriptions of the substrate on which the reflector 130 is disposed, the heat sink, and the light-transmitting cover are omitted since they are similar as those described above. In addition, the same reference numerals and symbols are used to designate the substrate, the heat sink, and the light-transmitting cover.

The reflector 1030 illustrated in FIG. 30 to FIG. 36 may be disposed on the upper portion of the substrate 110, and serve to reflect the light that is generated by the light sources 111 and 112 to the side and rear.

The reflector 1030 may be disposed in the inner area of the substrate 110 with a certain height, and a second light source 112 may be disposed on the upper surface of the reflector 1030. Consequently, a first light source 111 including a plurality of first LED devices may be disposed in the boundary area of the substrate 110, outside of the reflector 1030, and the second light source 112 including a plurality of second LED devices may be disposed on the upper surface of the reflector 1030. A second surface 1033, which forms the side surface of the reflector 1030, is inclined at a certain angle to the first light source 111 such that the light that is generated by the first light source 111 can be reflected to the side and rear of the substrate 110.

Figure 32:
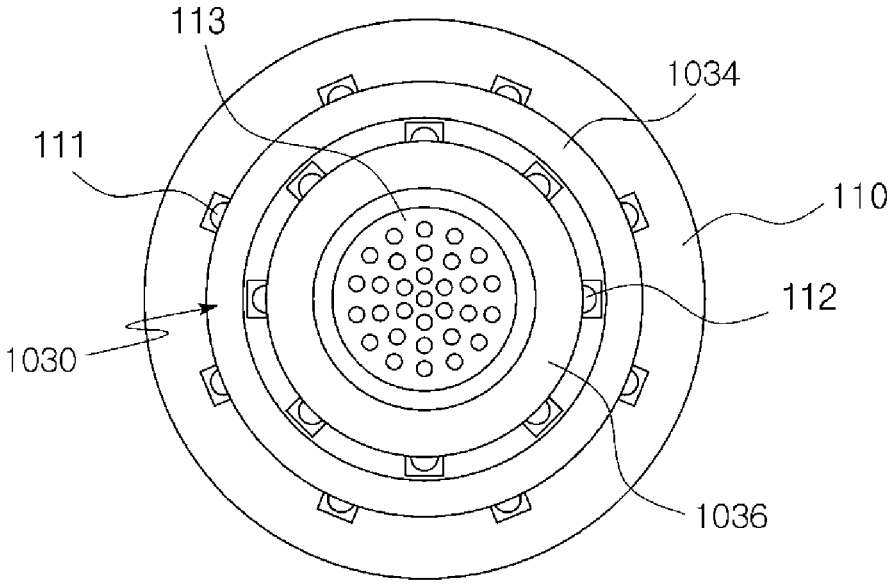
FIG. 32 is a top plan view that illustrates the arrangement of light sources in the LED illumination apparatus according to the tenth exemplary embodiment of the invention.

Here, the plurality of second LED light devices 112, which are disposed on the upper surface of the reflector 1030, may be disposed between respective first LED light devices 111, which are disposed along the periphery of the substrate 110, as illustrated in FIG. 32. This is intended to make the light that is generated by the first LED light devices 111 and the light that is generated by the second LED light devices 112 to share the entire area of the light-transmitting cover 140, so that overall intensity of light is uniform.

The reflector 1030 may have a multistage structure, which is bent inward. Specifically, a first surface 1034 is formed in the middle of the height of the reflector 1030, such that the LED light devices are disposed on the first surface 1034, and a second surface 1035 reflects the light that is generated by the LED light devices disposed on the first surface to the side and rear. This is intended to increase the uniformity of the overall intensity of light by disposing the LED light devices on the first surface 1034, which have different heights, such that the light that is generated by the LED light devices can be reflected by the second surface 1035.

In case the reflector 1030 has the multistage structure, an upper stage 1031 and a lower stage 1032 are arranged concentrically, with the cross-sectional area of the upper stage being smaller than that of the lower stage. This is intended to allow a portion of the light L2 that is generated by the LED light devices, which are disposed on the first surface 1034, to be reflected by the second surface 1035, which forms the side surface of the upper stage, to the side and rear, whereas the remaining portion of the light L2 is directly radiated toward the light-transmitting cover 140 without being reflected by the reflector 1030.

Although the reflector 1030 has been illustrated as having the two-stage structure, other configuration is also possible. For example, it should be understood that the reflector may have three or more stories in which the first surface 1034 and the second surfaces 1033 and 1035 are repeated. In addition, although the first surface 1034 has been illustrated as a horizontal surface, other configuration is also possible. For example, it should be understood that the first surface 1034 may be an inclined surface that has a downward slope at a certain angle.

For the sake of explanation, a description is given below of a two-stage structure of the reflector 1030. In the reflector 1030, a first stage 1032 has the first surface 1034 and the second surface 1033, and a second stage 1031 has the second surface 1035 and an upper surface 1036.

In this embodiment, the first light source 111 is disposed in the boundary area of the substrate 110, the second light source 112 is disposed on the first surface 1034 of the first stage 1032, and a third light source 113 is disposed on the upper surface 1036 of the second stage 1031. The first, second, and third light sources 111, 112, and 113 are electrically connected to the substrate 110. The second surface 1033, which forms the side surface of the first stage 1032, and the second surface 1035, which forms the side surface of the second stage 1031, have the same cross-sectional shape, and are inclined at the same certain angle toward the first light source 111 and the second light source 112.

Consequently, the second surface 1033, which forms the side surface of the first stage 1032, reflects a portion of the light that is generated by the first light source 111 to the side and rear, and the second surface 1035, which forms the side surface of the second stage 1031, reflects a portion of the light that is generated by the second light source 112 to the side and rear. Light that is generated by the third light source 113, which is disposed on the upper surface 1036 of the second stage 1031, is directly radiated toward the light-transmitting cover 140 without being reflected by the reflector 1030.

Figure 33:
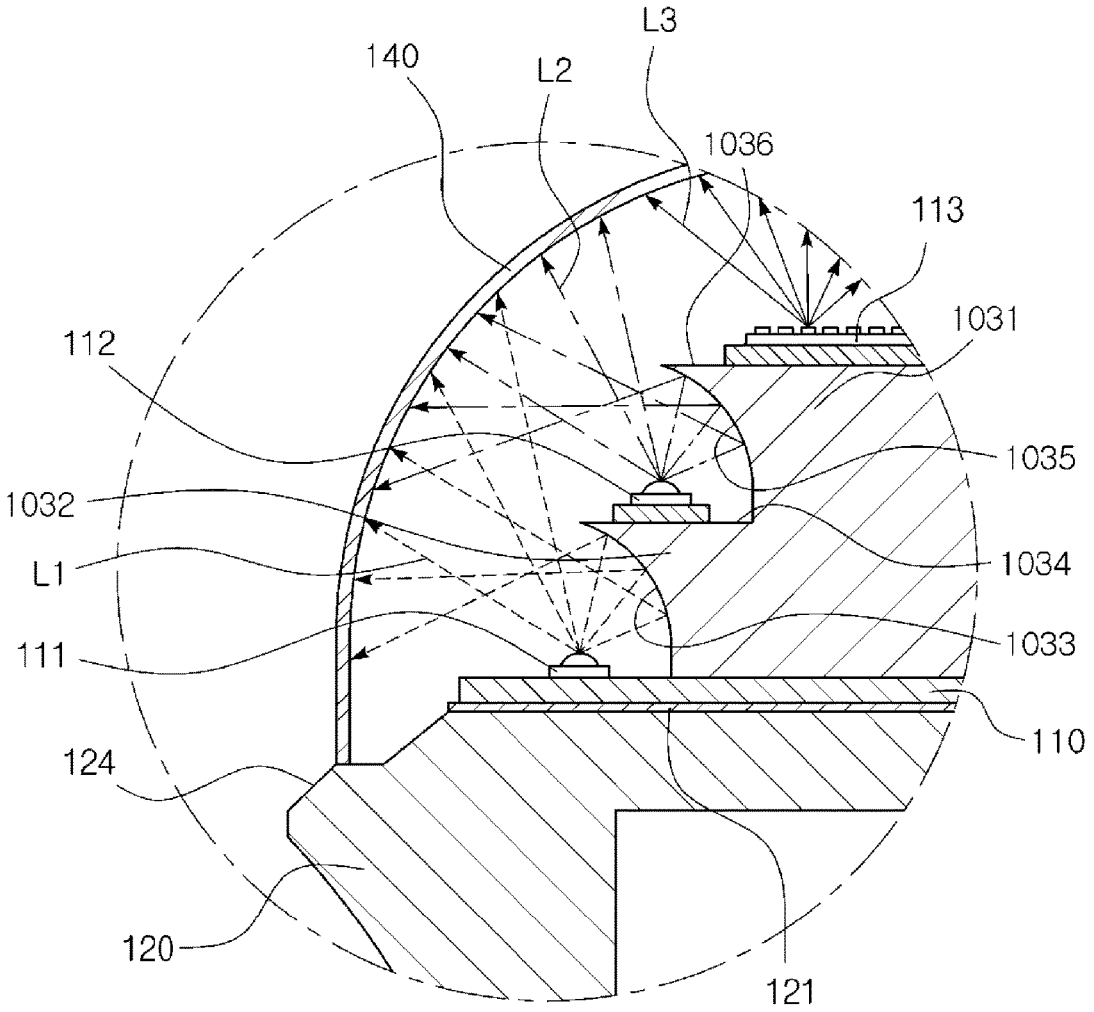
FIG. 33 is a detailed view that illustrates the reflection of light by the reflector and the travel of light in case the reflector is disposed on the top surface of the substrate in the LED illumination apparatus illustrated in FIG. 30.

In the LED illumination apparatus 1000 of this embodiment, the first light source 111, the second light source 112, and the third light source 113 are located at different heights, such that the light L1 that is generated by the first light source 111 is radiated on the lower portion of the light-transmitting cover 140 (as designated by dotted lines in FIG. 33), the light L2 that is generated by the second light source 112 is radiated on the intermediate portion of the light-transmitting cover 140 (as designated by dashed-dotted lines FIG. 33), and the light L3 that is generated by the third light source 113 is radiated on the central area of the light-transmitting cover 140 (as designated by solid lines in FIG. 33).

Consequently, in the LED illumination apparatus 1000 of this embodiment, the light that is generated by the light sources is radiated to the side and rear of the substrate 110 after being reflected by respective second surfaces 1033 and 1035, and the light sources are located at different heights to radiate light on the entire area of the light-transmitting cover 140. This, as a result, can increase the uniformity of the intensity of light and realize light distribution similar to that of an incandescent lamp.

Here, the light sources may be formed as a chip-on-board (COB) assembly, in which a plurality of LED chips are integrated on a board, an LED package including lead frames, or a combination thereof (See FIG. 10 to FIG. 15.)

In the reflectors 1030, 1030*a*, 1030*b*, 1030*c*, 1030*d*, and 1030*e* of this embodiment, the second surfaces 1033 and 1035, which form the side surface, may be provided in a variety of shapes that can realize an intended light distribution by allowing a portion of the light L1 and L2 that is generated by the first light source 111 and the second light source 112 to be radiated directly to the front of the substrate 110 while the remaining portion of the light L1 and L2 is reflected to the side and rear.

Figure 34A:
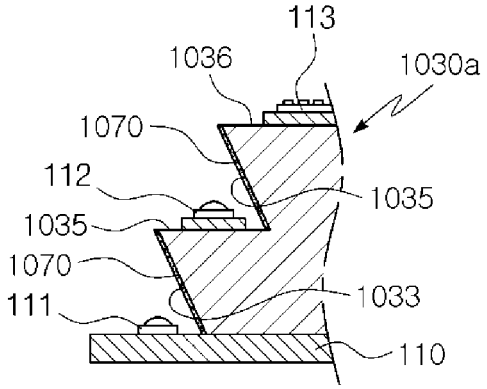

Specifically, as illustrated in FIG. 34A, the reflector 1030*a* may have a generally conical shape. Specifically, the second surface 1033, which forms the side surface of the first stage 1032, is a straight line that is inclined toward the first light source 111. The second surface 1035, which forms the side surface of the second stage 1031, is a straight line that is inclined toward the second light source 112.

Figure 34B:
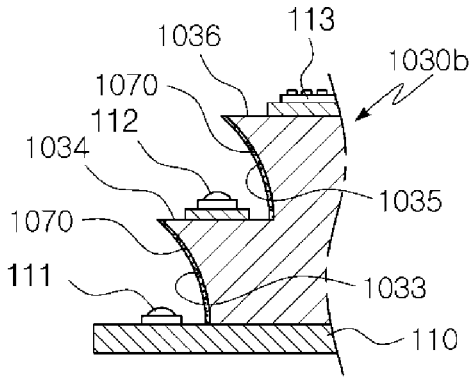

In the reflector 1030*b* illustrated in FIG. 34B, the second surface 1033 forms the side surface of the first stage 1032, and is curved such that the upper end thereof is oriented toward the first light source 111. The second surface 1035 forms the side surface of the second stage 1031, and is curved such that the upper end thereof is oriented toward the second light source 112.

Figure 34C:
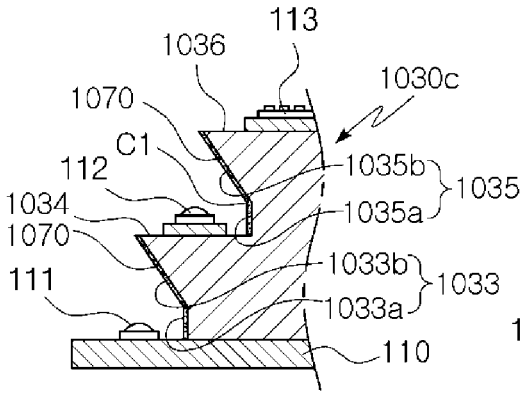

In the reflector 1030*c* illustrated in FIG. 34C, the second surface 1033 forms the side surface of the first stage 1032, and may include a vertical section 1033*a*, which extends a certain height from the lower end thereof, and an inclined section 1033*b*, which extends obliquely at a certain angle from the upper end of the vertical section 1033*a* toward the first light source 111. In addition, the second surface 1035 forms the side surface of the second stage 1031, and includes a vertical section 1035*a*, which extends a certain height from the lower end thereof, and an inclined section 1035*b*, which extends obliquely at a certain angle from the upper end of the vertical section 1035*a* toward the second light source 112.

Figure 34D:
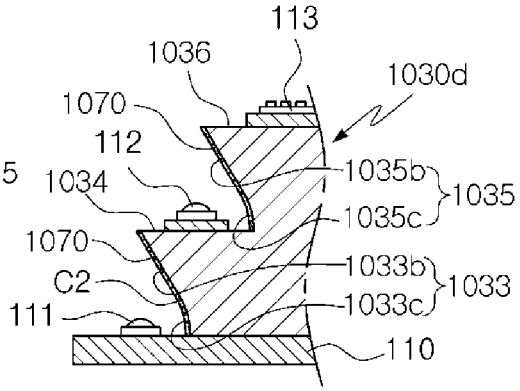

In the reflector 1030*d* illustrated in FIG. 34D, the second surface 1033 forms the side surface of the first stage 1032. The second surface 1033 may include a lower curved section 1033*c*, which is curved from the lower end thereof toward the first light source 111, and an inclined section 1033*b*, which extends obliquely at a certain angle from the upper end of the lower curved section 1033*c* toward the first light source 111. In addition, the second surface 1035 forms the side surface of the second stage 1031, and may include a lower curved section 1035*c*, which is curved from the lower end thereof toward the second light source 112, and an inclined section 1035*b*, which extends obliquely at a certain angle from the upper end of the lower curved section 1035*c* toward the second light source 112.

Figure 34E:
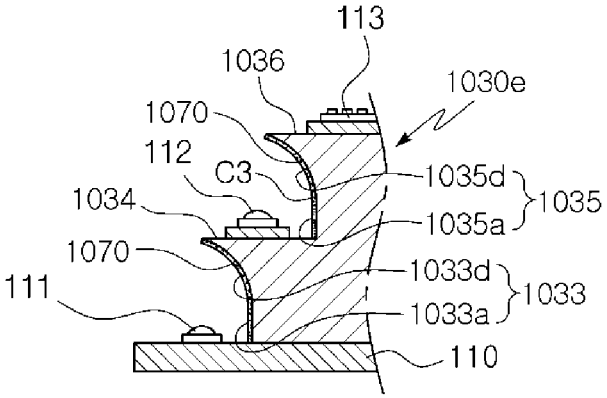

Furthermore, in the reflector 1030*e* illustrated in FIG. 34E, the second surface 1033 forms the side surface of the first stage 1032. The second surface 1033 may include a vertical section 1035*a*, which extends a certain height from the lower end thereof, and an upper curved section 1033*d*, which is curved from the upper end of the vertical section

1033*a* toward the first light source 111. In addition, the second surface 1035 forms the side surface of the second stage 1031, and may include a vertical section 1035*a*, which extends a certain height from the lower end thereof, and an upper curved section 1035*d*, which is curved from the upper end of the vertical section 1035*a* toward the second light source 112.

Here, a joint C1 at which the inclined section 1033*b* meets the vertical section 1033*a*, a joint C2 at which the inclined section 1033*a* meets the lower curved section 1033*c*, and a joint C3 at which the upper curved section 1033*d* meets the vertical section 1033*a* may be positioned at the same height as or higher than the first light source 111 so that the light L1 that is generated by the first light source 111 can be reflected to the side or rear. Also, a joint C1 at which the inclined section 1035*b* meets the vertical section 1035*a*, a joint C2 at which the inclined section 1035*b* meets the lower curved section 1035*c*, and a joint C3 at which the upper curved section 1035*d* meets the vertical section 1035*a* may be positioned at the same height as or higher than the second light source 112 so that the light L2 that is generated by the first light source 1022 can be reflected to the side or rear.

Although the joints C1, C2, and C3 have been described as being integrally formed with respective reflectors, other configuration is also possible. The joints C1, C2, and C3 may be assembled to the respective reflectors, depending on the design of the reflectors.

In each of the reflectors 1030, 1030*a*, 1030*b*, 1030*c*, 1030*d*, and 1030*e*, which are provided in a variety of shapes as described above, the free end of the first surface extends to the position directly above the first light source 111 and the free end of the second surface extends to the position directly above the second light source 112, such that a portion of the light L1 that is generated by the first light source 111 and a portion of the light L2 that is generated by the first light source 1022 are radiated to the side and rear after being reflected by the reflector while the remaining portions of the light L1 and L2 are radiated to the front.

The reflectors 1030, 1030*a*, 1030*b*, 1030*c*, 1030*d*, and 1030*e* may be made of a resin or a metal. One or more reflecting layers 1070 may be formed on the outer surface of the reflector to increase reflection efficiency when reflecting the light that is generated by the light source.

The reflecting layer 1070 may be formed on the surface of the reflector with a certain thickness. For this, a reflective material, such as aluminum (Al) or chromium (Cr), may be applied to the surface of the reflector by a variety of methods, such as deposition, anodizing, or plating.

In case the reflectors 1030, 1030*a*, 1030*b*, 1030*c*, 1030*d*, and 1030*e* are made of a metal, an insulating material or insulation may be provided between the surface of the substrate 110 and the lower end of the reflector in order to prevent short circuits.

The reflector 1030 of this embodiment has a multistage structure, as illustrated in FIG. 30 to FIG. 34. The lower end of the reflector may be fixedly assembled to the substrate 110 by a variety of methods. An exemplary method is illustrated in FIG. 35.

Figure 35A:
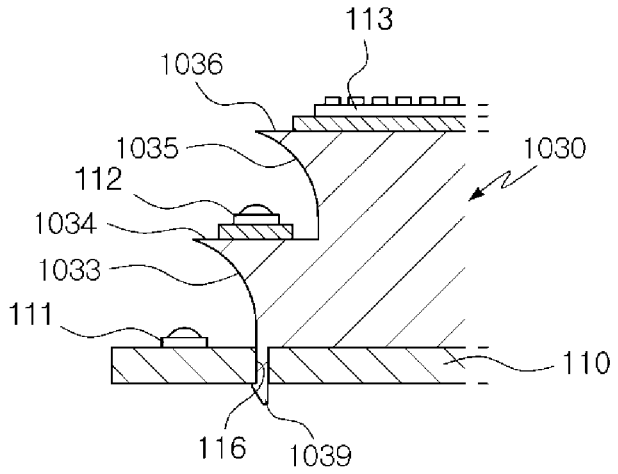

As illustrated in FIG. 35A, the reflector 1030 has a hook 1039 on the lower end thereof. The hook 136 is fitted into an assembly hole 116, which penetrates the substrate 110. In this configuration, the hook 1039 generates a holding force, thereby fixing the lower end of the reflector 1030 to the upper surface of the substrate 110.

Figure 35B:
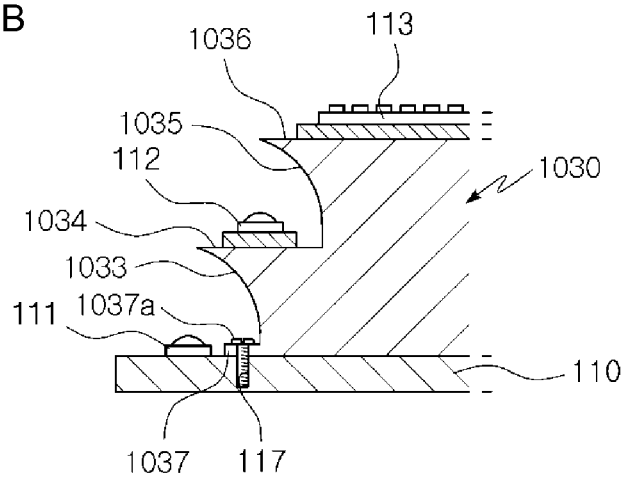

As illustrated in FIG. 35B, the reflector 1030 has a coupling section 1037, which is bent from the lower end thereof to the side. The coupling section 1037 may be fastened to a coupling hole 117, which penetrates the substrate 110, via a fastening member 1037*a*.

Figure 35C:
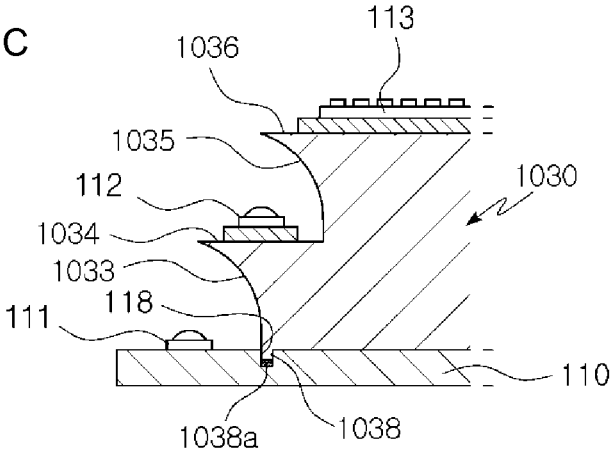

In addition, as illustrated in FIG. 35C, the reflector 1030 has a fitting protrusion 1038 on the lower end thereof. The fitting protrusion 1038 is fitted into a recess 118, which is depressed into the upper surface of the substrate 110 to a certain depth, and is fixedly bonded thereto via an adhesive 1038*a*.

Here, each of the assembly hole 116, the coupling hole 117, and the recess 118, which is formed in the substrate 110, should be configured such that it does not overlap a pattern circuit, which is printed on the upper surface of the substrate in order to supply electrical power to the light sources 111, 112, and 113. Two or more hooks 1039 corresponding to the assembly holes 116 may be provided on the lower end of the reflector 1030, such that they are spaced apart from each other at a certain interval. Two or more coupling sections 1037 corresponding to the coupling holes 117 and two or more fitting protrusions 1038 corresponding to the recesses 118 may be provided on the lower end of the reflector 1030 in a similar manner.

The reflector 1030 of this embodiment may have a plurality of cross-sectional shapes, as illustrated in FIG. 36.

Figure 36A:
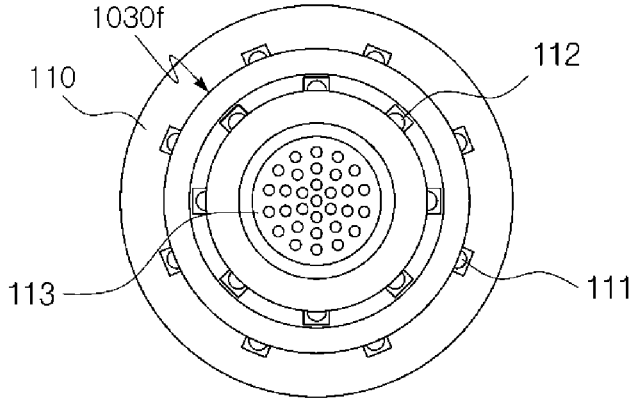

Specifically, in a reflector 1030*f* illustrated in FIG. 36A, the second surface 1033, which reflects a portion of the light that is generated by the first light source 111 to the front or rear, and the second surface 1035, which reflects a portion of the light that is generated by the second light source 112 to the front or rear, may have a conical cross-sectional shape.

Figure 36B:
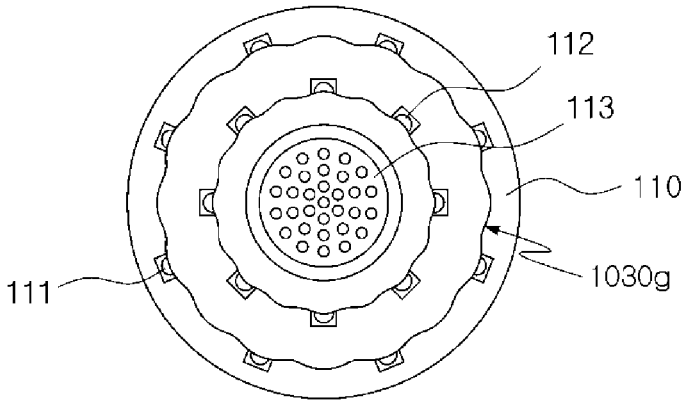

In a reflector 1030*g* illustrated in FIG. 36B, the second surface 1033 and the second surface 1035 may have a wavy cross-sectional shape. Specifically, waves span for a certain period such that the light that is generated by the first light source 111 and the light that is generated by the first light source 1022 can be spread again in the direction parallel to the substrate 110.

Figure 36C:
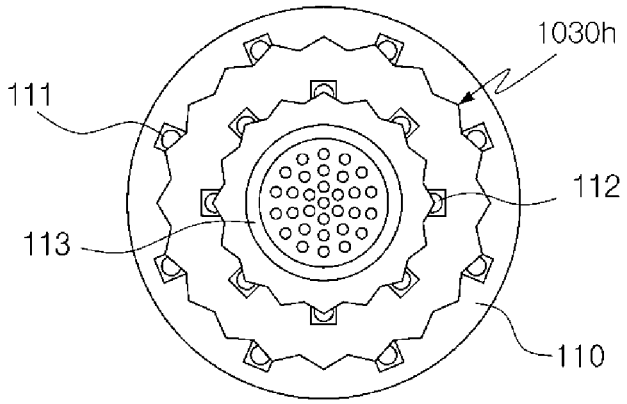
Figure 37:
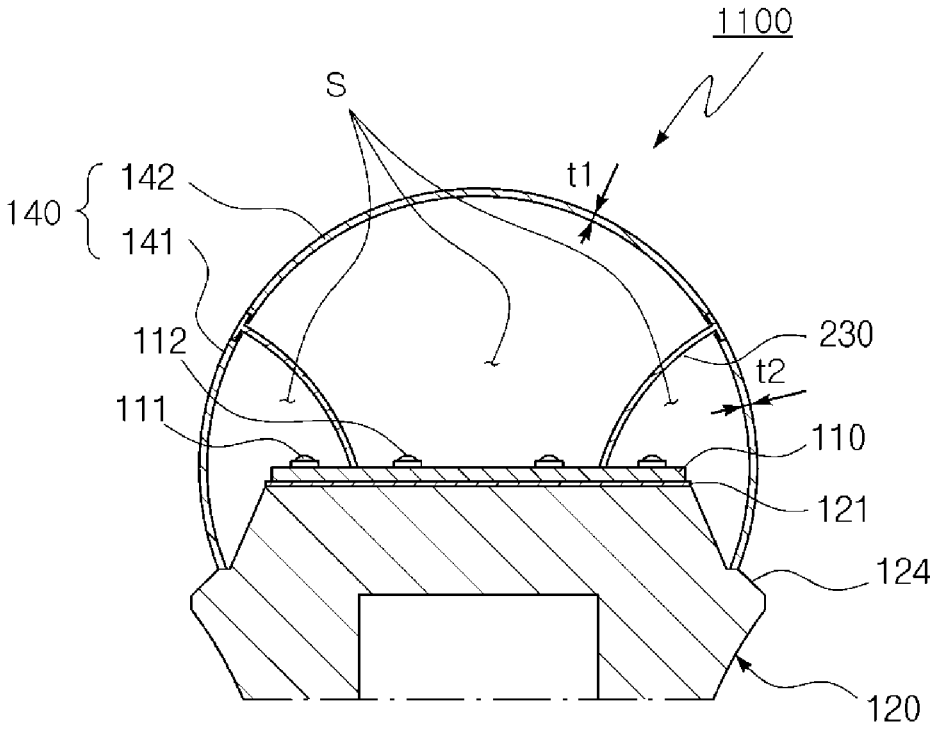
FIG. 37 is a cross-sectional view that illustrates the overall configuration of an LED illumination apparatus according to another embodiment of the present invention.
Figure 38:
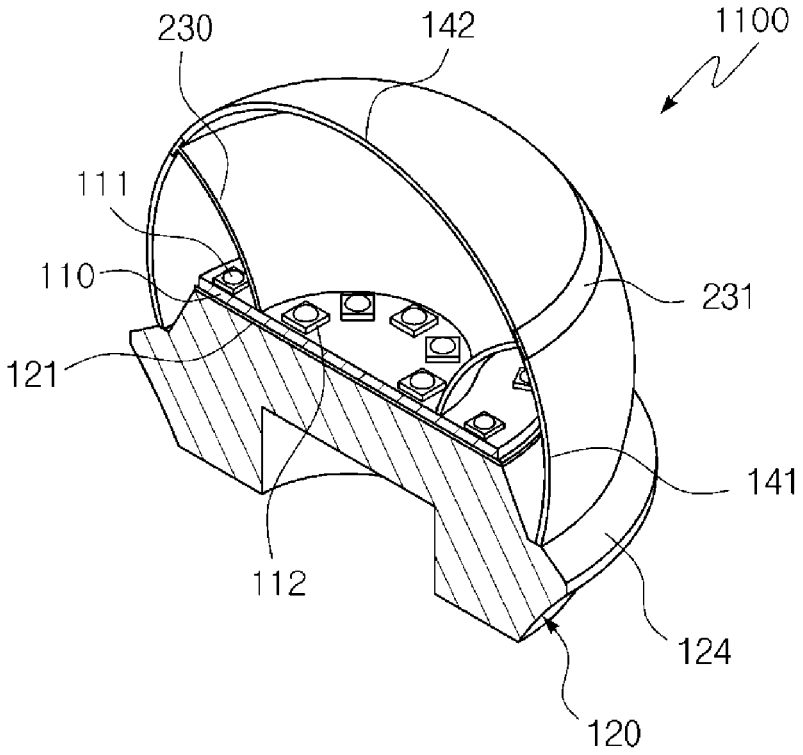
FIG. 38 is a perspective view of the LED illumination apparatus illustrated in FIG. 37.

In addition, in a reflector 1030*h* illustrated in FIG. 36C, the second surface 1033 and the second surface 1035 may have a toothed cross-sectional shape. Specifically, teeth span for a certain period such that the light that is generated by the first light source 111 and the light that is generated by the second light source 112 can be spread again in the direction parallel to the substrate 110.

In the LED illumination apparatus 1000 of this embodiment, the reflector 1030 is disposed in the inner area of the substrate 110. When the light sources are turned in response to the application of external power, a portion of the light L1 that is generated by the first light source 111 is reflected by the second surface 1033 of the reflector 1030, the cross section of which is curved or inclined toward the first light source 111, so that the portion of the light L1 travels to the side or rear, whereas the remaining portion of the light L1 travels toward the light-transmitting cover 140 without being reflected by the reflector 1030.

In addition, a portion of the light L2 that is generated by the second light source 112 travels to the side or rear of the substrate after being reflected by the second surface 1035 of the reflector 1030, the cross section of the second surface 1035 being curved or inclined toward the second light source 112, whereas the remaining portion of the light L2 travels toward the light-transmitting cover 140 without being reflected by the reflector 1030.

Furthermore, the light that is generated by the third light source 113, which is disposed on the upper surface 1036 in the highest stage, directly travels toward the transparent cover without being reflected by the reflector. Consequently, the LED illumination apparatus 1000 of this embodiment can realize light distribution (see FIG. 9C) similar to light distribution (see FIG. 9B) that can be produced from an incandescent lamp, and produce an increased angular range of 270° or more.

Moreover, the light sources 111, 112, and 113 are located at different heights due to the multistage structure of the reflector 1030. Consequently, the light that is generated by the light sources can be radiated toward the light-transmitting cover 140, thereby realizing uniform intensity of light.

FIG. 37 to FIG. 43 illustrate an LED illumination apparatus 1100 according to another exemplary embodiment of the present invention. The LED illumination apparatus 1100 according to another embodiment of the present invention is technically characterized in that the first light source 111 and the second light source 112, which are disposed on the substrate 110, are separated from each other by the reflector 230 such that light that is generated by the first light source 111 and light that is generated by the second light source 112 pass through portions of a cover 140 having different transmittances, thereby realizing a variety of light distribution patterns.

As illustrated in FIG. 37 to FIG. 43, the LED illumination apparatus 1100 may include the light sources 111 and 112, the reflector 230, and the cover 140.

The light sources 111 and 112, including a plurality of first LED devices 111 and a plurality of second LED devices 112, which are disposed on the substrate 110, generate light in response to the application of electrical power. The first light source 111 and the second light source 112 are separated by the reflector 230 such that the first light source 111 is disposed on the peripheral portion of the substrate 110 and the second light source 112 is disposed on the central portion of the substrate.

Consequently, the light that is generated by the second light source 112 is radiated forward, that is, through the second cover 142. A portion of the light that is generated by the first light source 111 is directly radiated toward the first cover 141, through which the light portion is then radiated to the outside, and another portion of the light that is generated by the first light source 111 is reflected by the reflector 230 toward the first cover 141, through which the light portion is then radiated to the side and the rear.

Here, the light that is generated by the first light source 111 and the light that is generated by the second light source 112 are divided by the reflector 230 so that the light generated by the first light source 111 is radiated toward the first cover 141 and the light generated by the second light source 112 is radiated toward the second cover 142.

Here, as shown in FIG. 10 to FIG. 15, the first light source 111 and the second light source 112 may be formed as a chip-on-board (COB) assembly, in which a plurality of LED chips are integrated on the board, an LED package including lead frames, or a combination thereof.

The substrate 110 may be a circuit board member, which has a certain circuit pattern formed on the upper surface thereof, such that the circuit pattern is electrically connected to external power, which is supplied through a power cable (not shown), and is electrically connected to the light sources.

The substrate 110 may be disposed on the upper surface of a heat sink 120, with the heat dissipation pad 121 being interposed between the substrate 110 and the heat sink 120. Although the substrate 110 has been illustrated and described as having the form of a disc conforming to the shape of the mounting area, i.e. the upper surface of the heat sink 120, other configuration is also possible. Alternatively, the substrate 110 may be formed as a polygonal plate, such as a triangular or rectangular plate.

In addition, although the substrate 110 has been illustrated and described as being bonded to the upper surface of the heat sink via the heat dissipation pad 121, other configuration is also possible. It should be understood that the substrate 110 may be detachably assembled to the upper surface of the heat sink 120 using a fastening member.

The heat sink 120 may be made of a metal having excellent heat conductivity, such as Al, such that it can dissipate the heat that is generated when the light sources 111 and 112, which are disposed on the substrate 110, emit light to the outside.

The heat sink 120 may have a plurality of heat dissipation fins on the outer surface thereof to increase heat dissipation efficiency by increasing the heat dissipation area.

Here, the shape of the heat sink 120 should be optimally designed to reduce interference with the portion of the light that is generated by the first light source 111. Otherwise, the portion of the light encounters interference by colliding with the heat sink 120 while traveling backward after being reflected by the outer surface of the reflector 230.

For this, the heat sink 120 may have the guide surface 124 on the outer circumference thereof, the guide surface 124 being inclined downward at a certain angle to guide the light that is generated by the first light source 11 in the backward direction. The guide surface 124 serves to increase the area through which the light travels in the backward direction, thereby increasing the angular range of radiation of the light while a portion of the light that is generated by the light sources is reflected to the side and rear by the reflector 230.

The reflector 230 may be disposed on the surface of the substrate 110, and may serve to reflect light that is generated by the first light source 111 to the side and rear.

The reflector 230 may be formed as a reflector plate having a certain height. The lower end of the reflector 230 may be disposed on the boundary area between the second light source 112, which is disposed on the inner area of the substrate 110, and the first light source 111, which is disposed on the peripheral area of the substrate, and the upper end of the reflector 230 connects the first and second covers 141 and 142 of the cover 140 to each other.

The reflector 230 may have an extension 231 at the upper end thereof. The extension 231 may be bent, diverge, and extend a certain length toward the first cover 141 and toward the second cover 142, respectively, such that they connect the first and the second covers 141 and 142 to each other. Consequently, the space S defined inside the cover 140 is partitioned by the reflector 230.

The light that is generated by the first light source 111 is radiated to the outside through the first cover 141, whereas the light that is generated by the second light source 112 is radiated to the outside through the second cover 142.

The reflector 230 may be provided in a variety of shapes that can realize the intended light distribution by allowing a portion of the light that is generated by the first light source 111 to be radiated directly toward the first cover 141 while the remaining portion of the light is reflected to the side and rear.

The reflector 230 may be configured as a curved reflector plate, in which the lower end thereof is fixed to the substrate 110, and the upper end thereof is oriented toward the second light source 112.

However, it should be understood that the shape of the reflector 230 of this embodiment is not limited thereto, but the reflector 230 may be provided in a variety of shapes that include at least one of a vertical section, an inclined section and a curve section as shown in FIG. 6.

The reflector 230 may be made of a resin or a metal, and one or more reflecting layers may be attached on the outer surface of the reflector 230 to increase reflection efficiency when reflecting light that is generated by the light source.

The reflecting layer may be formed on the surface of the reflector with a certain thickness. For this, a reflective material, such Al or Cr, can be applied to the surface of the reflector by a variety of methods, such as deposition, anodizing, or plating.

The reflecting layer may be formed with a certain thickness on the entire outer surface of the reflector such that it can reflect a large portion of the light that is generated by the first and second light sources 111 and 112, or may be formed only on the outer surface of the reflector 230, which corresponds to the first light source 111, such that only the light that is generated by the first light source 111 is reflected.

In case the reflector 230 is made of a metal, an insulating material or insulation may be provided between the surface of the substrate 110 and the lower end of the reflector 230 in order to prevent short circuits.

It should also be understood that the lower end of the reflector 230, which is disposed on the boundary area between the peripheral area and the inner area of the substrate 110, can be fixed and/or assembled to the substrate using a variety of methods.

As an example thereof, a holding force may be generated by fitting a hook, which is provided on the lower end of the reflector, into an assembly hole, which is formed in the substrate. Alternatively, the reflector may have a coupling section on the lower end thereof, the coupling section being bent to a side. The coupling section may be screwed into the substrate using a fastening member such as a bolt. The lower end of the reflector may also be fixedly bonded to the upper surface of the substrate using an insulating adhesive as illustrated in FIG. 7.

A light-transmitting cover 140 having a space S therein is provided on the upper surface of the outer circumference of the heat sink 120. The light-transmitting cover 140 radiates the light that is emitted from the first and second light sources 111 and 112 to the outside while protecting the light sources from the external environment.

The cover 140 may include two parts, i.e. a first cover 141, which radiates the light that is generated by the first light source 111 to the outside, and a second cover 142, which radiates the light that is generated by the second light source 112 to the outside. The first and second covers 141 and 142 are coupled to each other via the upper end of the reflector 230, that is, the extension 231 of the reflector 230.

The space S is then divided into a first space, which is surrounded by the second cover 142 and the inner surface of the reflector 230, and a second space which is surrounded by the first cover 142 and the outer surface of the reflector 230.

Figure 39:
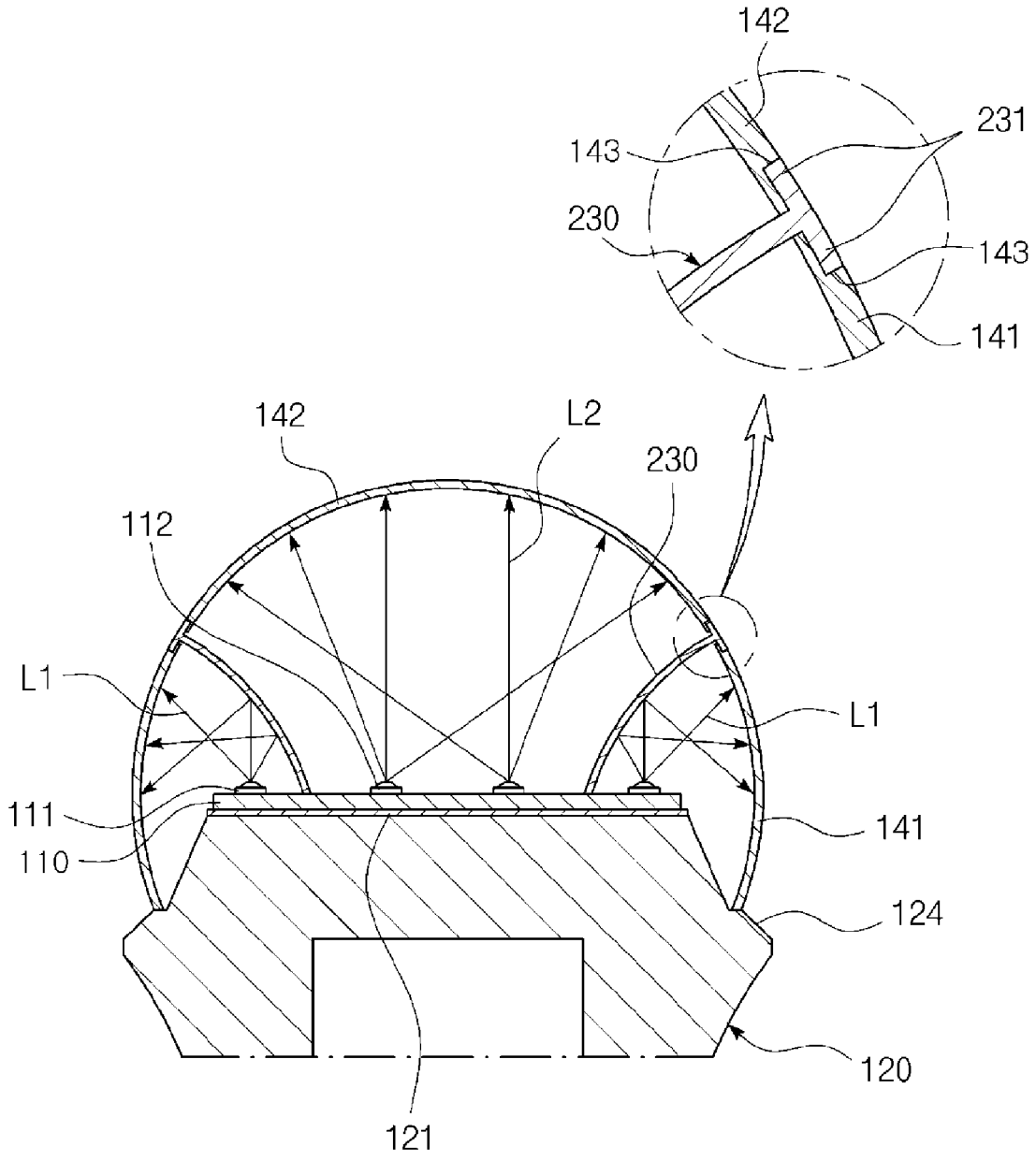
FIG. 39 is a detailed view that illustrates the reflection of light by the reflector and the travel of light in the LED illumination apparatus illustrated in FIG. 37.

The extension 231 may be formed on the upper end of the reflector 230 such that it diverges and extends a certain length toward the first cover 141 and the second cover 142. The extension 231 is in contact with and meshed with an end of the first cover 141 and an end of the second cover 142, and serves to couple the first and second cover 141 and 142 to each other as shown in FIG. 39.

For this, stepped portions 143, which are depressed to a certain depth, may be formed in corresponding ends of the first cover 141 and the second cover 142, such that the extension 231 can be meshed with the stepped portions 143.

As the extension 231 is meshed with the stepped portions 143 formed in the ends of the first and second covers 141 and 142, the covers 141 and 142 may be connected to each other via the extension 231.

The first and second covers 141 and 142 may serve as light-transmitting covers. The first and second covers 141 and 142 may also serve as light spreading covers in order to radiate light that is generated by the first and second light sources 111 and 112 to the outside by spreading it.

With the first and second covers 141 and 142 being connected together, the lower end of the cover 140 is positioned below the substrate 110, which is disposed on the heat sink 120, such that the light that is generated by the first light source 111 can be reflected by the reflector 230 to the rear of the substrate 110 so that it can be radiated across a wider angular range of radiation.

Here, it should be understood that the extension 231 may be fixed by a variety of structures, including a structure by which the extension 231 is fixed to the stepped portions 143 of the first cover 141 and the second cover 142 via an adhesive, and a structure by which the extension 231 is fitted into the recesses that are respectively formed in the end of the first cover 141 and in the end of second cover 142.

The stepped portions 143 may be coupled with the extension 231 by ultrasonic fusion, which has the advantages that fusion time is short, bonding strength is excellent, operation is very simple since additional components, such as a bolt or screw, are not required, and a very clear appearance can be obtained.

Furthermore, since neither a process nor a space for fastening a bolt, a screw, or the like is required, the thickness of the connection in which the extension 231 and the stepped portion 143 are coupled to each other may be formed such that it has the same thickness as that of the first or second cover 141 or 142.

Figure 43A:
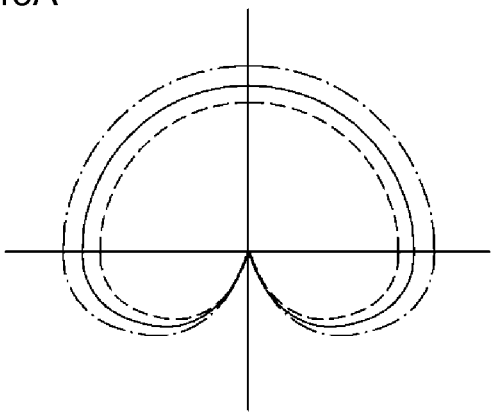

In the cover 140, which radiates light that is generated by the light source to the outside, the distribution of the light that is radiated to the outside varies depending on the transmittance of the cover 140. As illustrated in FIG. 43A, the light that has passed through the cover 140 exhibits a common light distribution pattern (solid line). When the transmittance of the cover 140 is decreased, the light distribution pattern is changed to the shape indicated by the dotted line in FIG. 43A. In contrast, when the transmittance of the cover 140 is increased, the light distribution pattern is changed to the shape indicated by the dashed-dotted line in FIG. 43A.

Based on this principle, this embodiment may realize a variety of light distribution patterns by imparting different transmittances to the first and second covers 141 and 142.

Figure 43B:
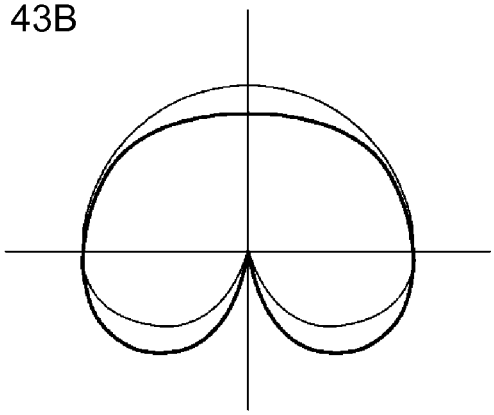

The second cover 142 may have a transmittance that is lower than that of the first cover 141 in order to realize the light distribution pattern that is indicated by the solid line in FIG. 43B. Alternatively, the second cover 142 may have a transmittance that is higher than that of the first cover 141 in order to realize the light distribution pattern that is indicated by the solid line in FIG. 43C.

In this embodiment, it is easy to impart the first and second covers 141 and 142 of the cover 140 with different transmittances, since the cover 140 is divided into the two covers 141 and 142, and the two covers 141 and 142 are connected to each other via the upper end of the reflector 230.

Figure 43C:
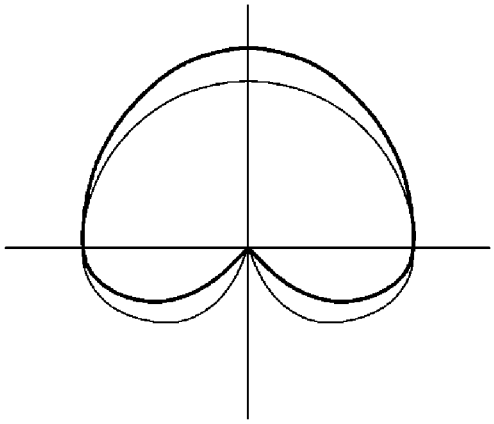

Here, the first and second covers 141 and 142 may be configured such that they have different transmittances by imparting the first cover 141 and the second cover 142 with different thicknesses t1 and t2, respectively, although the material of the first cover 141 has the same transmittance as that of the material of the second cover 142. Then, the light distribution pattern illustrated in FIG. 43*b* is realized by setting the thickness t1 of the second cover 142 to be greater than the thickness t2 of the first cover 141, or the light distribution pattern illustrated in FIG. 43*c* is realized by setting the thickness t1 of the second cover 142 to be less than the thickness t2 of the first cover 141. This is because a thicker cover has lower transmittance, whereas a thinner cover has higher transmittance.

As an alternative, covers having different transmittances may be used as the first and second covers 141 and 142. The cover typically serves to spread light by allowing the light to pass through, and the transmittance of the cover varies depending on the content of the spreading agent and multiple additives, which are mixed in the course of manufacturing the cover.

Therefore, the first and second covers 141 and 142 may be implemented as two types of covers having different content of the spreading agent and additives, and may then be connected to each other via the upper end of the reflector 230.

Accordingly, the LED illumination apparatus of this embodiment can realize multiple light distribution patterns in a product.

If the transmittance of the cover is increased, degree of spreading decreases even though light transmission efficiency increases. If the transmittance of the cover is decreased, light transmission efficiency decreases even though degree of spreading increases. In this embodiment, it is possible to realize an LED illumination apparatus that has various light distribution patterns by implementing the first and second covers 141 and 142 using the covers having different transmittances.

The cover 140 that radiates light that is generated by the light source to the outside may contain a fluorescent material 170, which converts the light that is generated by light source into white light. LEDs that are typically used as the light source are implemented as at least one of red, green and blue LEDs. While the light that is generated by the LEDs is passing through the fluorescent material, it undergoes frequency conversion and is then converted into white light.

In order to realize the white light, an LED that generates red, green or blue color was mounted on the substrate, and the fluorescent material may be injected into the space that is formed by the cover.

However, this embodiment can produce white light by disposing the fluorescent material 170, which can convert the color of the light that is generated by the LED into white, inside the cover 140.

Figure 40:
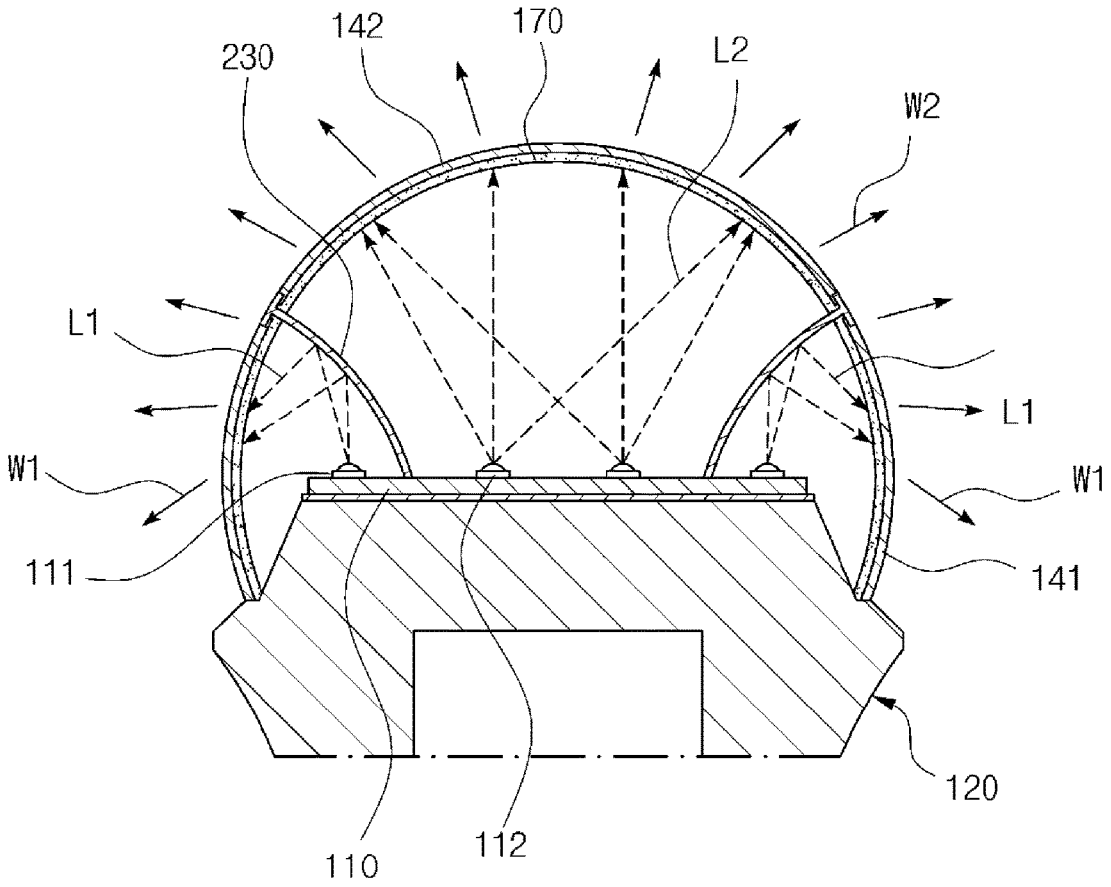
FIG. 40 is a configuration view of the LED illumination apparatus illustrated in FIG. 37, which contains the fluorescent material in the cover.

As an example thereof, as illustrated in FIG. 40, the first light source 111 and the second light source 112, which are mounted on the substrate 110, are implemented as LEDs that generate blue light, and a yellow phosphor having a certain thickness is applied on the inner surface of the first and second covers 141 and 142 in order to radiate white light to the outside.

Accordingly, blue light L1 that is generated by the first light source 111 and blue light L2 that is generated by the second light source 112 undergo frequency conversion while they are passing through the fluorescent material 170, which is applied on the inner surfaces of the first and second covers 141 and 142. As a result, white light W is radiated to the outside.

As an alternative, it is possible to produce white light by adding a fluorescent material, which is selected according to the color of light that is generated by the LEDs, to the first and second covers 141 and 142 in the process of fabricating the first and second covers 141 and 142.

Figure 41:
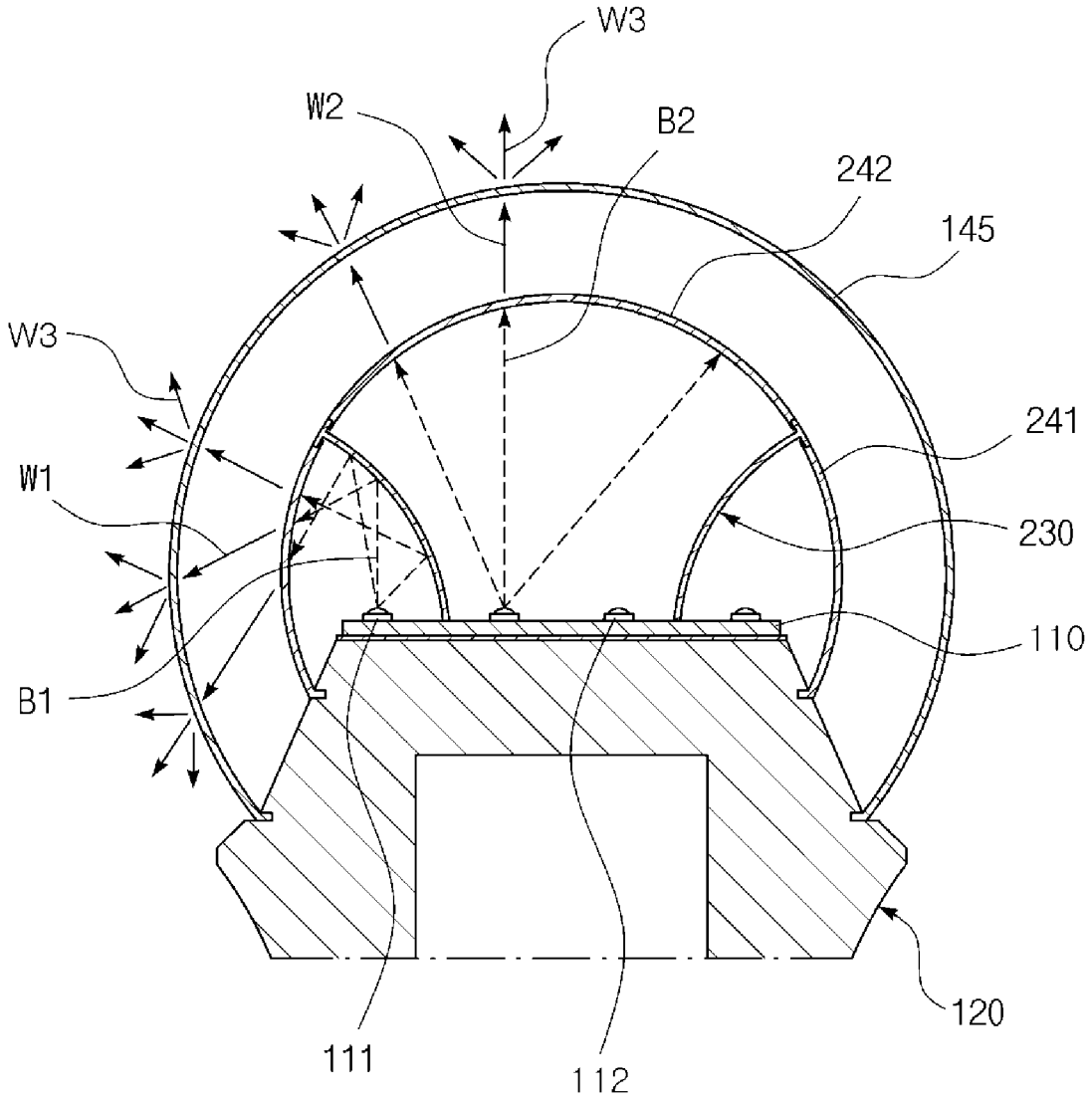
FIG. 41 is a view that illustrates a variation of the LED illumination apparatus illustrated in FIG. 37.

Another shape is illustrated in FIG. 41. Specifically, a first frequency conversion cover 241 and a second frequency conversion cover 242 are employed in place of the respective first and second covers 141 and 142 such that they can convert light that is generated by the first and second light sources 111 and 112 into white light, and a separate light spreading cover 145 is disposed outside the first and second frequency conversion covers 241 and 242.

Consequently, light B1 that is generated by the first light source 111 and light B2 that is generated by the second light source 112 are converted into respective white light W1 and W2 while passing through the first frequency conversion cover 241 and the second frequency conversion cover 242. The white light W1 and W2 is spread while passing through the light spreading cover 145, thereby being radiated to the outside as spread white light W3.

The first and second light sources 111 and 112 may be implemented as LED light sources, each of which may include at least one of red, green and blue LEDs, and the first and second frequency conversion covers 241 and 242 may contain a fluorescent material, which converts light that is generated by the LEDs into white light.

Figure 42:
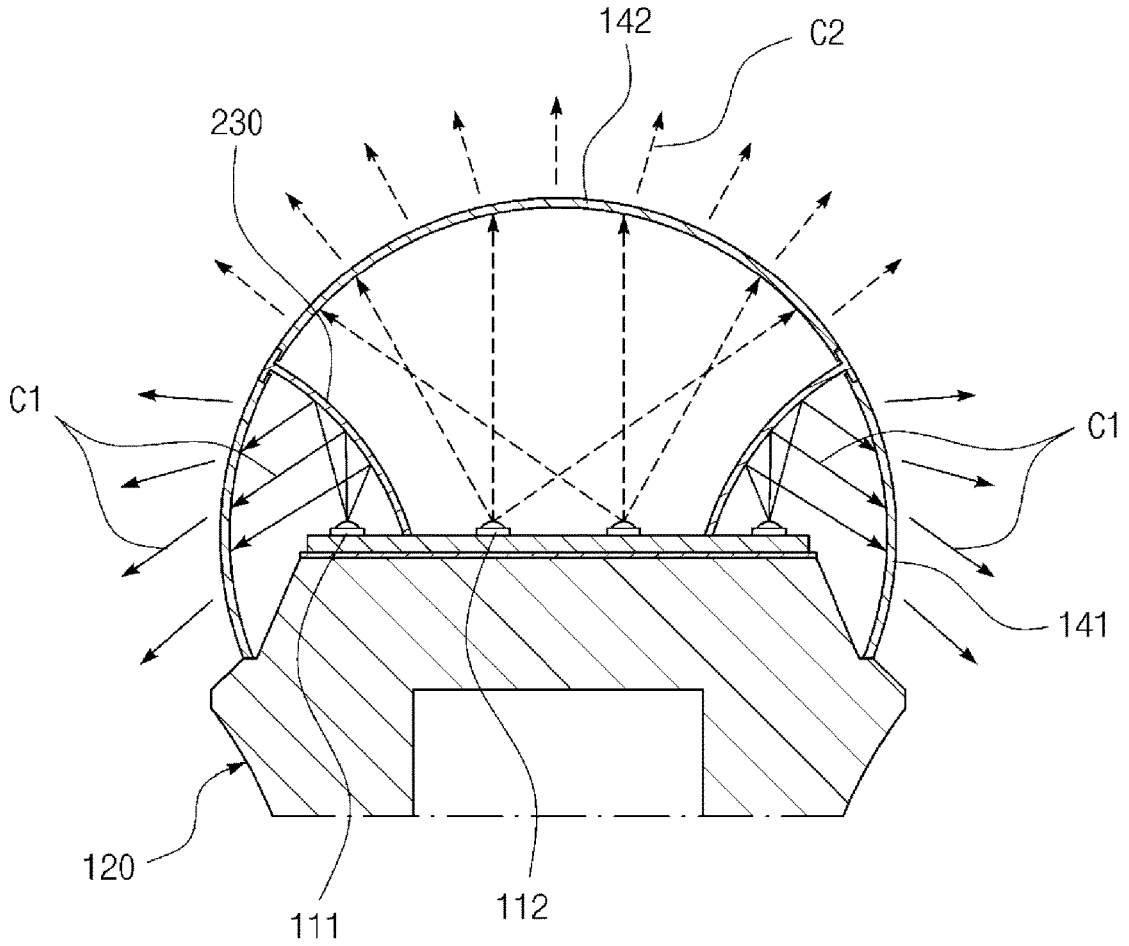
FIG. 42 is a configuration view that illustrates an LED illumination apparatus according to another embodiment of the present invention, in which a first light source and a second light source are implemented as LEDs having different colors.

In the LED illumination apparatus 1100 of this embodiment, as illustrated in FIG. 42, the first light source 111 and the second light source 112, which are separated by the reflector 230 such that the first light source 111 is disposed on the peripheral portion of the substrate 110 and the second light source 112 is disposed on the central portion of the substrate 110, may be implemented with respective LED types that generate different colors of light or have different color temperatures.

That is, in this embodiment, the cover 140 is divided into the two parts, i.e. the first cover 141 and the second cover 142, and the space S inside the cover 140 is partitioned by the reflector 230, such that the light that is generated by the first light source 111 is radiated towards the first cover 141 and the light that is generation by the second light source 112 is radiated towards the second cover 142.

Accordingly, when the first light source 111 and the second light source 112 are implemented with respective LED types that emit different colors of light or different color temperatures, the light that is radiated towards the first cover 141 and the light that is radiated towards the second cover 142 form different types of light.

As an example, the first light source may be implemented as blue LEDs, whereas the second light source may be implemented as red LEDs. The LED illumination apparatus 1100 of this embodiment then radiates blue light to the front of the substrate 110 (i.e. in the upward direction in FIG. 42) and red light to the side and rear of the substrate 110 (i.e. in the lateral and downward directions in FIG. 42).

As another example, the first light source may be implemented as warm white LEDs, whereas the second light source may be implemented as cool white LEDs. The LED illumination apparatus 1100 of this embodiment then radiates warm white light to the front of the substrate 110 (i.e. in the upward direction in FIG. 42) and cool white light to the side and rear of the substrate 110 (i.e. in the lateral and downward directions in FIG. 42).

As such, this embodiment makes it possible to produce a variety of illumination patterns by radiating a variety of colors or color temperatures by mounting different types of light sources on the inner area and on the peripheral area of the substrate 110.

According to this embodiment as above, it is possible to radiate a portion of light that is generated by the light sources toward the side and rear of the illumination apparatus, thereby increasing the angular range of radiation. Consequently, the distribution of light may be made similar to that of an incandescent lamp.

In addition, since the light that is generated by the first light source and the light that is generated by the second light source are radiated to the outside through the respective first and second covers, which are partitioned by the reflector and have different transmittances, a variety of light distribution patterns can be realized.

Furthermore, this embodiment can facilitate fabrication and increase productivity, since the fluorescent material, which converts the light that is generated by the LED into white light, is contained in the cover.

Moreover, in this embodiment, one LED illumination apparatus can achieve a variety of illumination patterns according to the mood, since the light that is generated by the first light source and the light that is generated by the second light source are separated from each other by the reflector, and the first and second light sources are designed to generate different types of light.

As illustrated in FIG. 44 to FIG. 50, the LED illumination apparatus according to another embodiment of the present invention may include the light sources 111 and 112, the reflector 230, the cover 140, and the heat sink 120.

The light sources 111 and 112 may disposed on the substrate 110 to generate light in response to the application of electrical power, and include a plurality of first LED devices and a plurality of second LED devices. The first light source 111 and the second light source 112 are separated from each other by the lower portion of the reflector 230 such that the first light source 111 is disposed in the peripheral area of the substrate 110 and the second light source 112 is disposed in the inner area of the substrate 110.

Then, light that is generated by the second light source 112 is radiated to the front through the cover 140, that is, the second cover 142. A portion of light that is generated by the first light source 111 is radiated directly toward the first cover 141, through which it is radiated to the outside, and another portion of the light that is generated by the first light source 111 is reflected by the reflector 230 toward the first cover 141, through which it is then radiated to the side and rear.

The light that is generated by the first light source 111 and the light that is generated by the second light source 112 are divided by the reflector 230 so that the light from the first light source 111 is radiated toward the first cover 141 and the light from the second light source 112 is radiated toward the second cover 142.

Here, the light sources may be provided as a chip-on-board (COB) assembly, in which a plurality of LED chips are integrated on a board, an LED package including lead frames, or a combination thereof (See FIG. 10 to FIG. 15.)

The substrate 110 is a circuit board member, which has a certain circuit pattern formed on the upper surface thereof, such that the circuit pattern is electrically connected to external power, which is supplied through a power cable (not shown), and is electrically connected to the light sources. The substrate 110 is disposed on the mounting area 122, i.e. the upper surface of the heat sink 120 via a fastening member.

Although the substrate 110 has been illustrated and described as having the form of a disc conforming to the shape of the mounting area 122, i.e. the upper surface of the heat sink 120, other configuration is also possible. Alternatively, the substrate 110 may be formed as a polygonal plate, such as a triangular or rectangular plate.

In addition, although the substrate 110 has been illustrated and described as being bonded to the mounting area of the heat sink 120 via the fastening member, other configuration is also possible. It should be understood that the substrate 110 may be detachably assembled to the mounting area of the heat sink 120 using a heat dissipation pad.

The heat sink 120 may be made of a metal, such as Al, having excellent heat conductivity, such that it can dissipate heat that is generated when the light sources 111 and 112 emit light to the outside.

The upper surface of the heat sink 120 described above forms the flat mounting area 122 such that the substrate 110 may be disposed thereon. The guide surface 124 may be formed on the upper portion of the heat sink 120 and have a downward slope at a certain angle to reduce the interference of a portion of the light that would otherwise collide with the heat sink 120 while traveling backward after being reflected by the reflector.

The guide surface 124 may be gradually inclined from the edge of the mounting surface 122 to the bottom of guide surface 124 to reduce the interference of a portion of the light that is generated by the first light source 111, which is disposed in the peripheral area of the substrate 110. Otherwise, the portion of the light would encounter interference by colliding with the heat sink 120 while traveling backward after being reflected by the reflector.

Consequently, this can increase the area illuminated by the light that is traveling backward after being reflected by the reflector, thereby increasing the angular range of the light. Since the guide surface 124 has a downward slope at a certain angle or more, even though a portion of the light that is reflected by the reflector 230 collides with the guide surface 124, it can still sustain its function to guide the light portion to the rear.

Here, one or more reflecting layers may be formed on the guide surface 124 to reduce the loss of the light that collides with the guide surface 124.

The guide surface 124 may be formed on top of the heat sink 120 such that the maximum outer diameter of the guide surface 124 is the same as or smaller than the maximum outer diameter of the cover 140.

Figure 44:
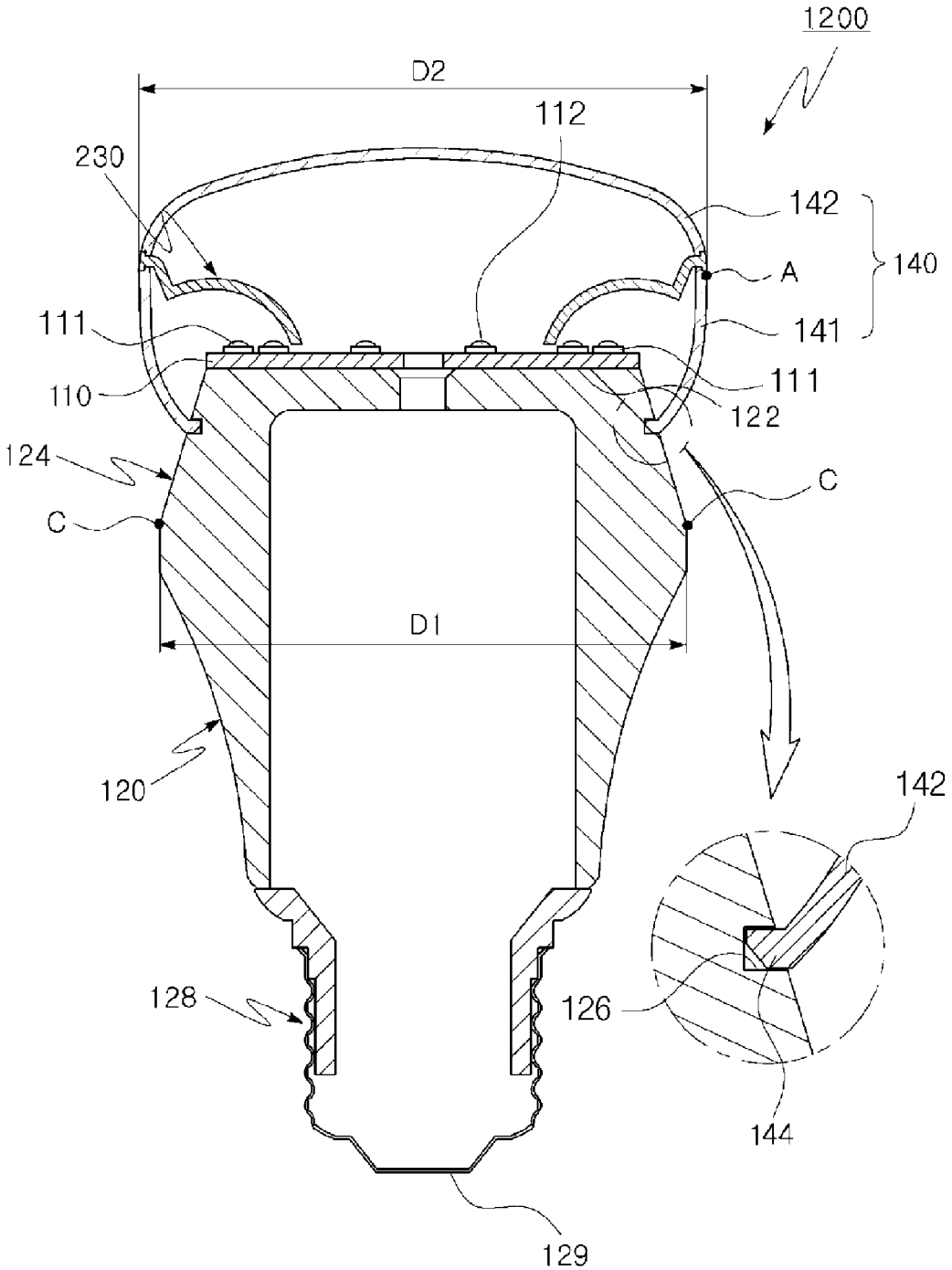
FIG. 44 is a cross-sectional view that illustrates an overall LED illumination apparatus according to another embodiment of the present invention.
Figure 45:
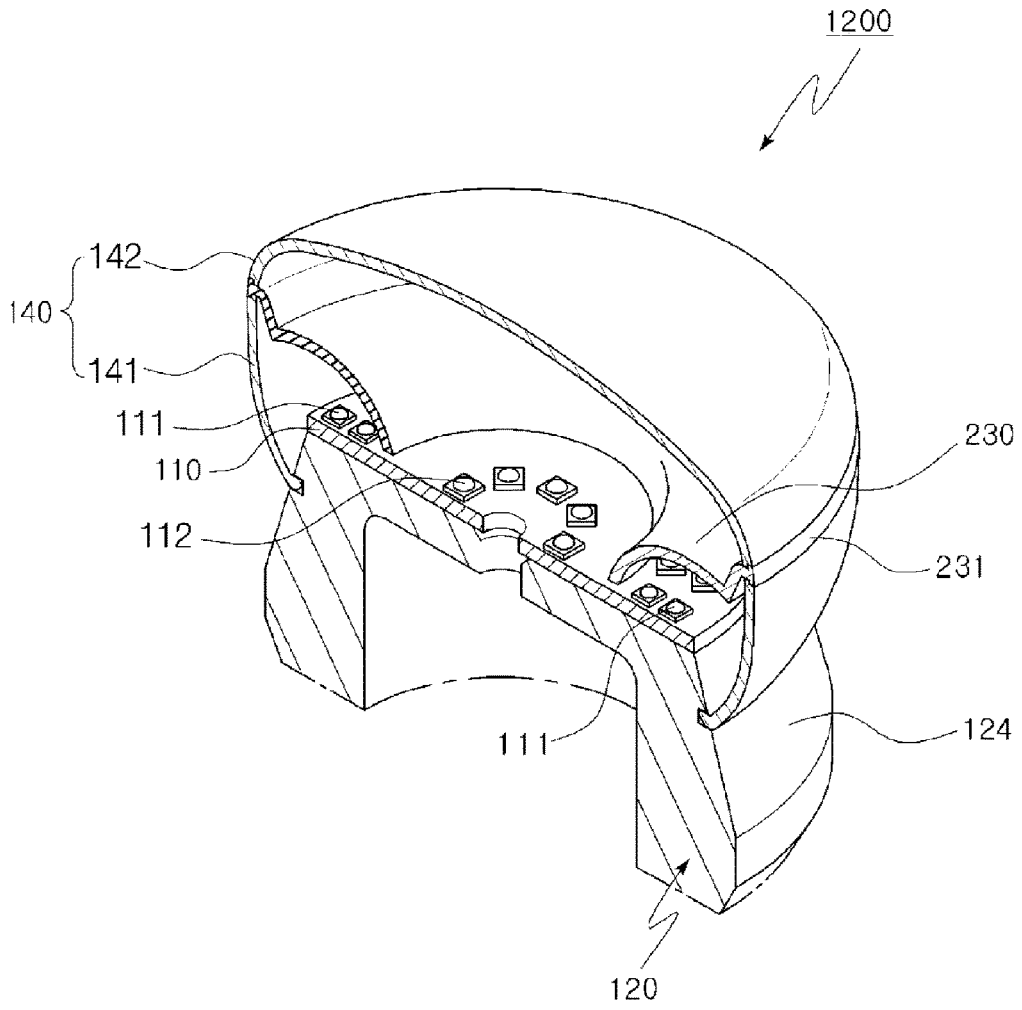
FIG. 45 is a perspective view of the LED illumination apparatus illustrated in FIG. 44.
Figure 46:
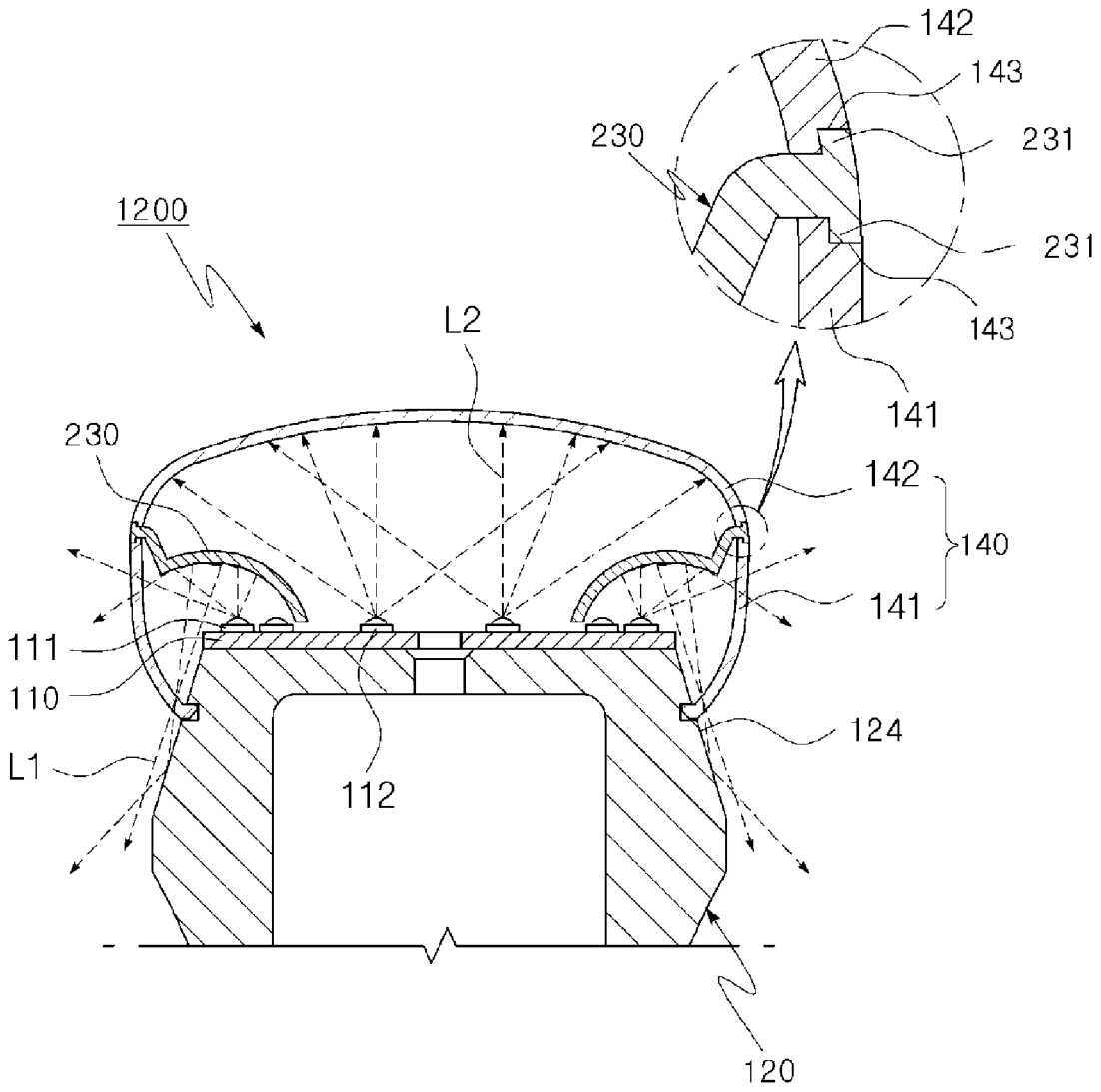
FIG. 46 is a detailed view that illustrates the reflection of light by the reflector and the travel of light in the LED illumination apparatus illustrated in FIG. 44.

As illustrated in FIG. 44, in the guide surface 124 that has a downward slope from the mounting surface 122, the point C at which the lower end of the guide surface 124 is formed is positioned on the same vertical plane as that of the outermost point A in the side of the cover 140 or is positioned inside the outermost point A.

This is intended to decrease the total loss of light by reducing interference of the light that travels backward after being reflected by the reflector 230. Otherwise, the light encounters interference by colliding with the guide surface 124.

A base 128 is coupled to the lower end of the heat sink 120, and is provided with a sock like connector 129, which can supply external power to a power supply (not shown). The connector 129 is fabricated such that it has the same shape as that of the socket of an incandescent lamp, so that the LED illumination apparatus can substitute a typical incandescent lamp.

The reflector 230 may be disposed on the upper portion of the substrate 110, and serve to reflect the light that is generated by the first light source 111 to the side and rear.

The reflector 230 may be formed as a reflector plate having a certain height, and may be disposed on the boundary area between the first light source 111, which is disposed on the peripheral area of the substrate 110, and the second light source 112, which is disposed on the inner area of the substrate 110. The upper end of the reflector 230 connects the first and second covers 141 and 142 of the cover 140 to each other.

The reflector 230 may have the extension 231 on the upper end thereof, which diverges and extends a certain length toward the first cover 141 and toward the second cover 142. The extension 231 is meshed with the stepped portion 143 in an end of the first cover 141 and with the stepped portion 143 in an end of the second cover 142, thereby connecting the first and second covers 141 and 142 to each other.

The reflector 230 may be provided in a variety of shapes that can realize an intended light distribution by allowing a portion of the light that is generated by the second light source 112 to be radiated directly to the front of the substrate 110 while the remaining portion of the light is reflected to the side and rear so that the angular range of radiation is increased.

Specifically, the reflector 230 may be implemented as a reflector plate, which has a curved section such that the upper end thereof is bent more toward the second light source that the lower end thereof, which is disposed on the boundary area between the first and second light sources 111 and 112.

However, it should be understood that the shape of the reflector 230 of this embodiment is not limited thereto, but the reflector 230 may be provided in a variety of shapes that include at least one of a vertical section, an inclined section, a curve section and combinations thereof as shown in FIG. 6.

The reflector 230 may be made of a resin or a metal, and one or more reflecting layers may be attached on the outer surface of the reflector 230 to increase reflection efficiency when reflecting light that is generated by the light source.

The reflecting layer may be formed on the surface of the reflector 230 with a certain thickness. For this, a reflective material, such Al or Cr, may be applied to the surface of the reflector by a variety of methods, such as deposition, anodizing, or plating.

Figure 29:
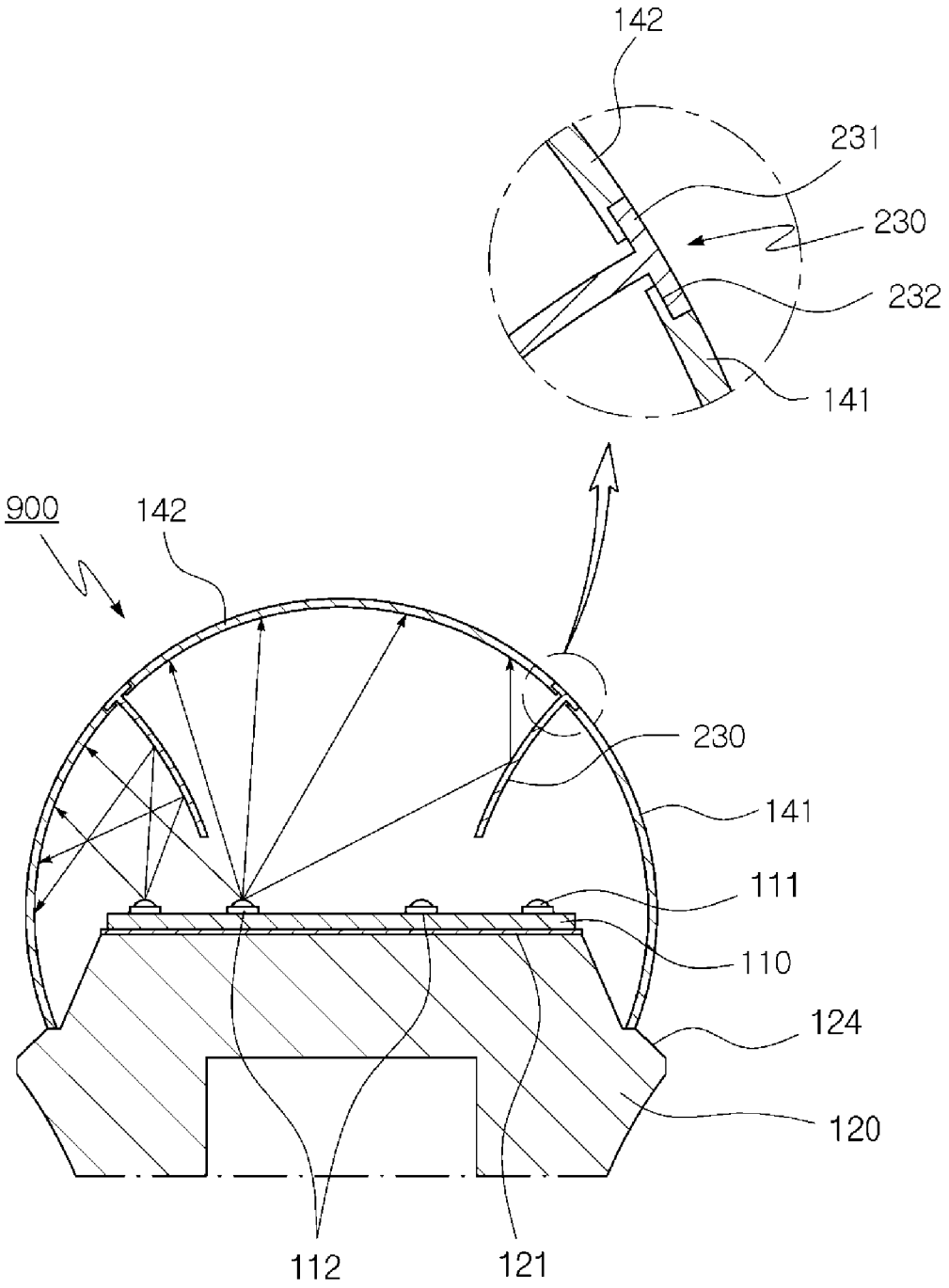
FIG. 29 is a detailed view that illustrates the reflection of light by the reflector and the travel of light in the LED illumination apparatus illustrated in FIG. 27.
Figure 30:
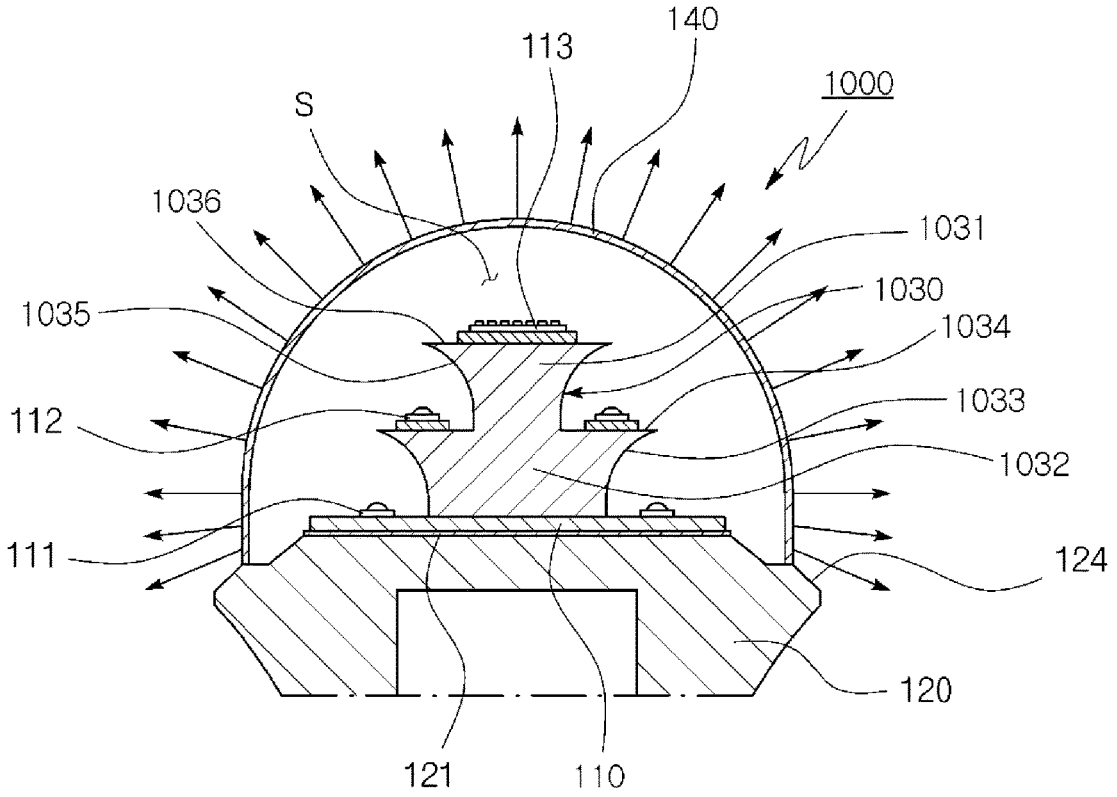
FIG. 30 is a cross-sectional view that illustrates the overall configuration of an LED illumination apparatus according to a tenth exemplary embodiment of the invention.
Figure 31:
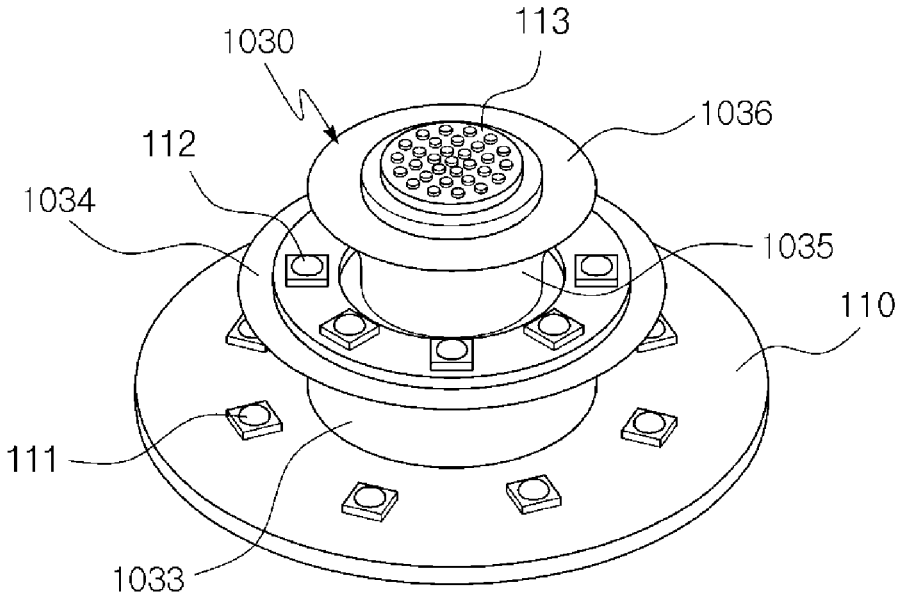
FIG. 31 is a perspective view that illustrates the LED illumination apparatus according to the tenth exemplary embodiment of the invention.

It should also be understood that the lower end of the reflector 230 may be spaced apart at a certain interval from the substrate 110 even though it may be fixed to the substrate 110, as shown in FIG. 27 to FIG. 29.

The cover 140, which radiates light that is generated by the first and second light sources 111 and 112 to the outside while protecting the light sources 111 and 112 from external environment, is provided over the heat sink 120.

The cover 140 may include the first cover 141, which radiates the light that is generated by the first light source 111 to the outside, and the second cover 142, which radiates the light that is generated by the second light source 112 to the outside. The first and second covers 141 and 142 may be coupled to each other via the upper end of the reflector 230, that is, the extension 231 of the reflector 230.

The extension 231, which is formed on the upper end of the reflector 230, may be meshed with an end of the first cover 141 and an end of the second cover 142. For this, a stepped portion 232, which is depressed to a certain depth, may be formed in an end of the first cover 141, and the other stepped portion 232, having the same configuration, may be formed in an end of the second cover 142.

Since the extension 231 is meshed with the stepped portions 143 formed in the ends of the first and second covers 141 and 142, the first and second covers 141 and 142 may be connected to each other via the extension 231.

The extension 231 may be fixed by a variety of structures, including a structure by which the extension 231 is fixed to the stepped portions of the first cover 141 and the second cover 142 via an adhesive, and a structure by which the extension 231 is fitted to a certain depth into an end of the first cover 141 and into an end of second cover 142.

The stepped portions 143 may be coupled with the extension 231 by ultrasonic fusion which has the advantages that fusion time is short, bonding strength is excellent, operation is very simple since additional components, such as a bolt or screw, are not required, and a very clear appearance can be obtained.

The first and second covers 141 and 142 may be implemented as light-transmitting covers, and/or be formed as a light spreading cover in order to radiate light that is generated by the first and second light sources 111 and 112 to the outside by spreading.

As illustrated in FIGS. 44 to 49, with the first and second covers 141 and 142 being connected together, the lower end of the cover 140 may be positioned below the substrate 110, which is disposed on the heat sink 120, and be coupled to the portion of the guide surface 124 that lies between the ends of the guide surface 124. Alternatively, as illustrated in FIG. 50, the lower end of the cover 141 may be coupled to the mounting area 122.

For this, a fitting section 144 may be formed on the lower end of the cover 140, i.e. the lower end of the first cover 141. As illustrated in FIG. 44, the fitting section 144 extends inward a certain length. In the corresponding portion of the guide surface 124, a coupling groove 126 may be provided. The coupling groove 126 is formed along the outer circumference and is depressed inward to a certain depth. When the heat sink 120 and the cover 140 are coupled to each other, the fitting section 144 is fitted into the coupling groove 126, such that the cover 140 can stay in the fixed position above the heat sink 120.

Figure 49:
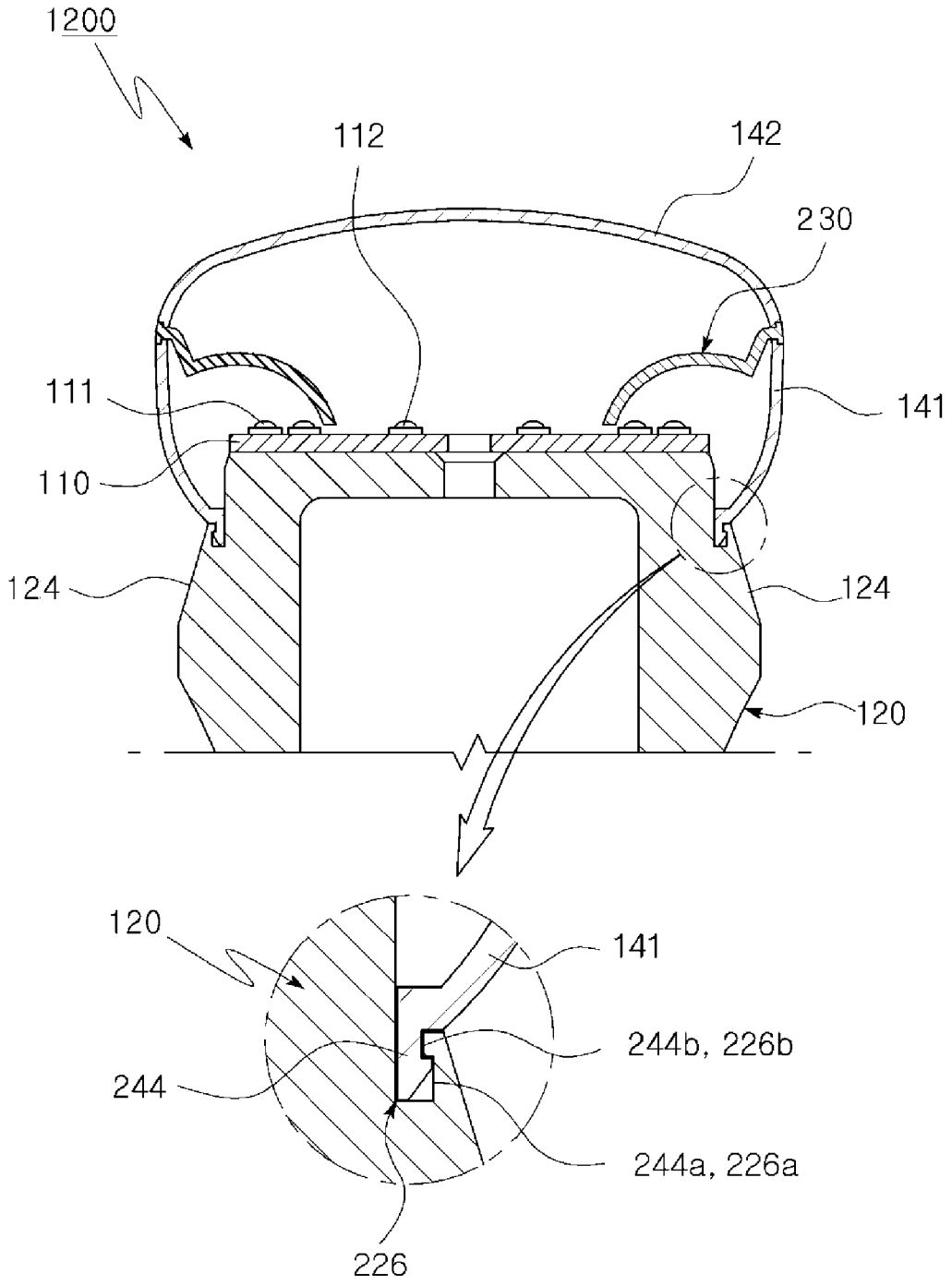
FIG. 49 is a view that illustrates another coupling relationship between the cover and the heat sink in the LED illumination apparatus illustrated in FIG. 46.
Figure 50:
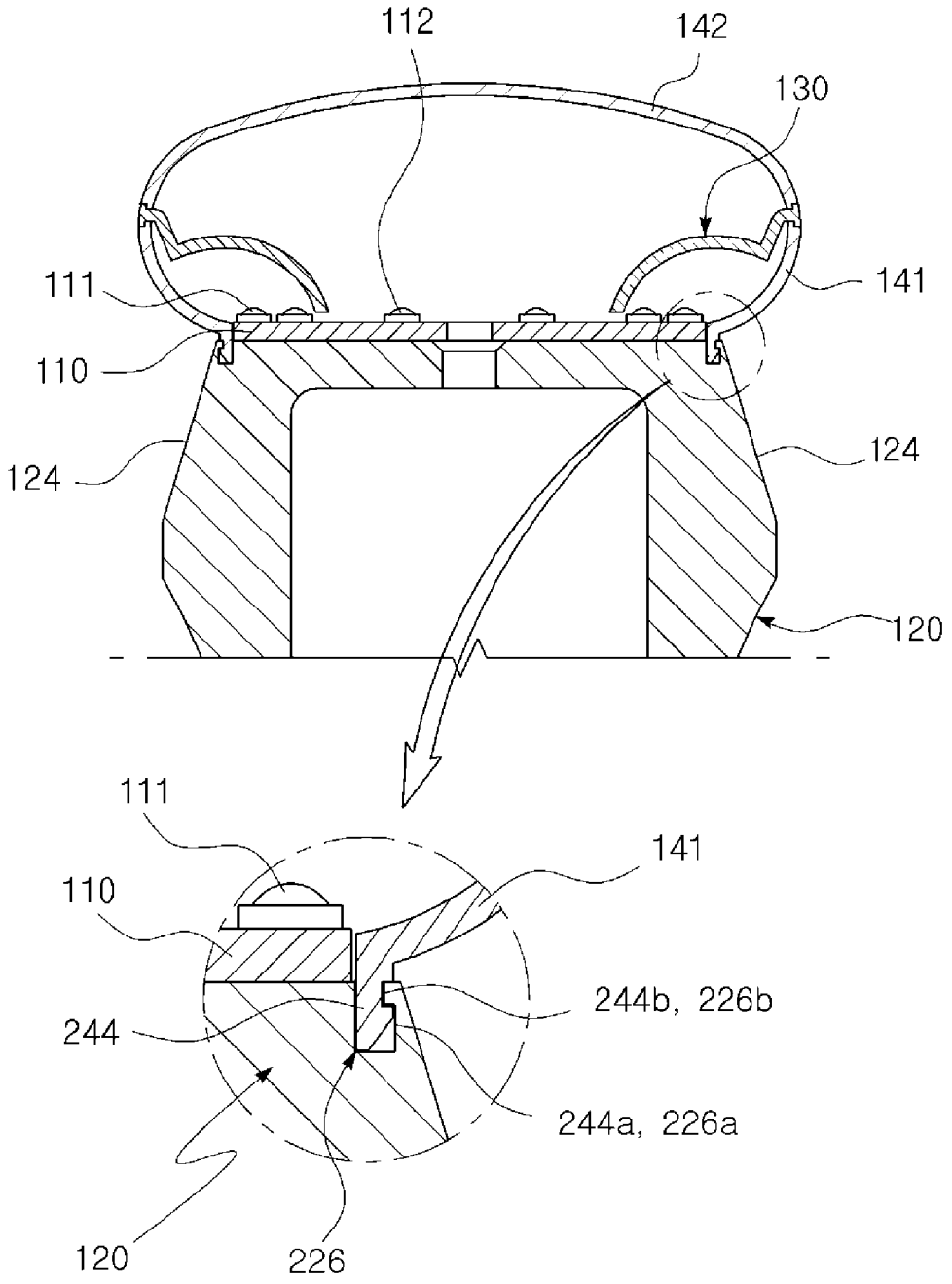
FIG. 50 is an overall configuration view of the LED illumination apparatus illustrated in FIG. 46, which has the cover coupled to the mounting surface of the heat sink.

As another shape, as illustrated in FIG. 49, a coupling recess 226 may be formed between the two ends of the guide surface 124 of the heat sink 10 such that it is depressed inward to a certain depth. As illustrated in FIG. 50, the coupling recess 226 may be formed adjacent to the edge of the mounting surface 122 such that it is depressed downward to a certain depth. The lower end of the first cover 141 has a vertical section 244, which extends downward a certain length such that it can be fitted into the coupling groove 226. The coupling groove 226 has at least one fitting recess **226*a* and at least one fitting lug 226*b*, and the vertical section 244 has a fitting lug 244*a* and a fitting recess 244*b*, which correspond to the fitting recess 226*a* and the fitting lug 226*b*, respectively. When the heat sink 120 and the cover 140 are coupled to each other, the vertical section 244 is fixedly inserted into the coupling groove 226 such that the fitting lug 244*a* and the fitting recess 244*b* of the vertical section 244 are engaged with the fitting recess 226*a* and the fitting lug 226*b* of the coupling groove 226**.

Even though the cover 140 may have a hemispherical overall shape, the cover 140 may have an aspheric overall shape, as illustrated in FIG. 44 to FIG. 50.

In particular, the second cover 142, which is positioned above the second light source 112, may have an aspheric shape. Typically, in LED illumination apparatuses, the cover that surrounds the light source is hemispherical. When the second cover 142 is aspheric, the length between the second light source 112, which is disposed on the substrate 110, and the second cover 142 is relatively decreased. This, as a result, decreases the distance that the light that is generated by the second light source 112 travels before colliding with the second cover 142, thereby increasing the overall light efficiency of the illumination apparatus.

The cover 140 that radiates the light that is generated by the light source to the outside may contain the fluorescent material 170, which converts the light that is generated by light source into white light. LEDs that are typically used as the light source are implemented as at least one of red, green and blue LEDs. While the light that is generated by the LEDs is passing through the fluorescent material, it undergoes frequency conversion and is then converted into white light.

In order to realize the white light, an LED that generates red, green or blue color may be mounted on the substrate, and the fluorescent material was injected into the space that is formed by the cover.

However, this embodiment can produce white light by disposing the fluorescent material 170, which can convert the color of the light that is generated by the LED into white, inside the cover 140.

Figure 47:
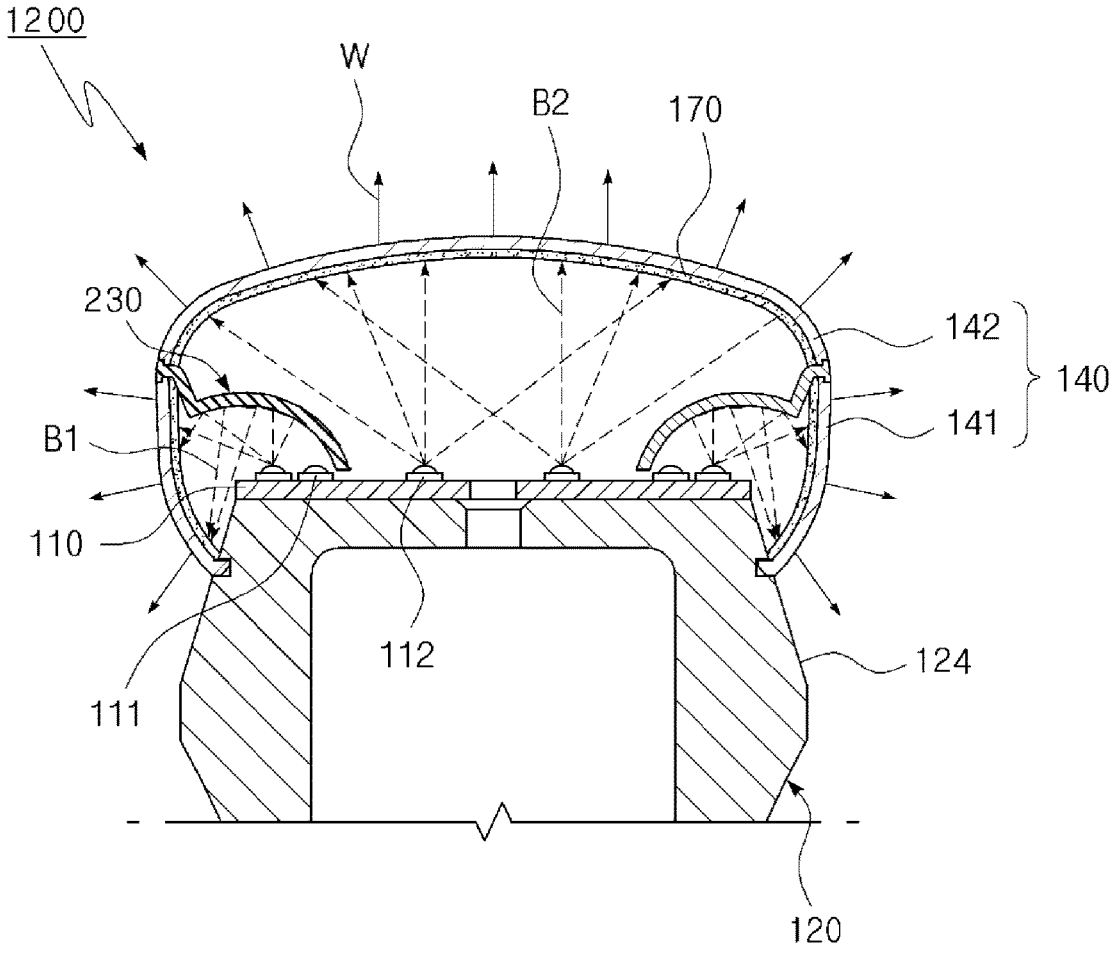
FIG. 47 is a configuration view of the LED illumination apparatus illustrated in FIG. 44, which contains the fluorescent material in the cover.
Figure 48:
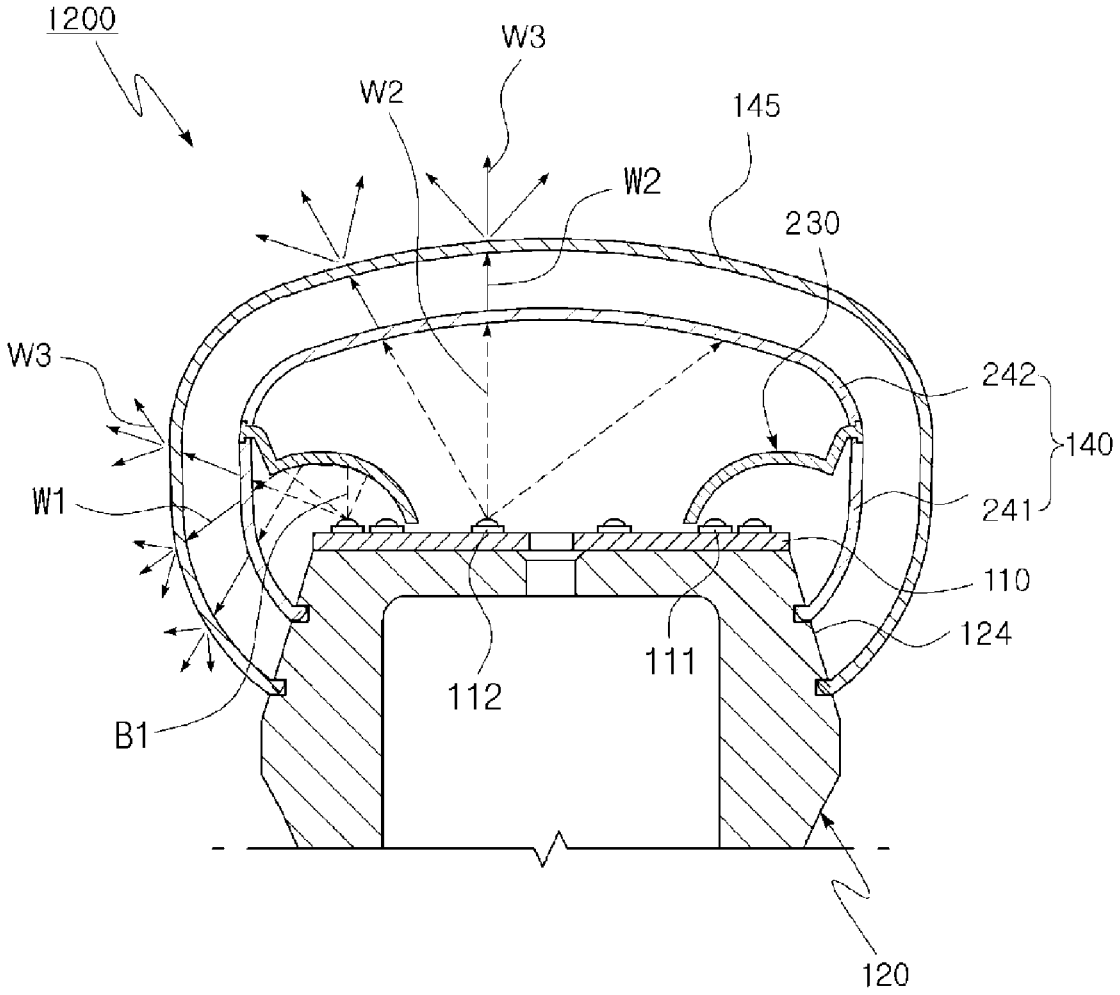
FIG. 48 is a view that illustrates a variation of the LED illumination apparatus illustrated in FIG. 46.

An example thereof, as illustrated in FIG. 47, the first light source 111 and the second light source 112, which are mounted on the substrate 110, are implemented as LEDs that generate blue light B1 and B2, and a yellow phosphor having a certain thickness is applied on the inner surface of the first and second covers 141 and 142 in order to radiate white light W to the outside.

Accordingly, blue light B1 that is generated by the first light source 111 and blue light B2 that is generated by the second light source 112 undergo frequency conversion while they are passing through the fluorescent material 170, which is applied on the inner surfaces of the first and second covers 141 and 142. As a result, the white light W is radiated to the outside.

As an alternative, it is possible to produce white light by adding a fluorescent material, which is selected according to the color of light that is generated by the LEDs, to the first and second covers 141 and 142 in the process of fabricating the first and second covers 141 and 142.

Another shape is illustrated in FIG. 47. Specifically, the first frequency conversion cover 241 and the second frequency conversion cover 242 are employed in place of the respective first and second covers 141 and 142 such that they can convert the light that is generated by the first and second light sources 111 and 112 into white light, and the separate light spreading cover 145 is disposed outside the first and second frequency conversion cover 241 and 242.

Consequently, light B1 that is generated by the first light source 111 and light B2 that is generated by the second light source 112 are converted into respective white light W1 and W2 while passing through the first frequency conversion cover 241 and the second frequency conversion cover 242. The white light W1 and W2 is then spread while passing through the light spreading cover 145, thereby being radiated to the outside as spread white light W3.

The first and second light sources 111 and 112 are implemented as LED light sources each of which may include at least one of red, green and blue LEDs, and the first and second frequency conversion covers 241 and 242 contain a fluorescent material, which converts light that is generated by the LEDs into white light.

Even though the first and second frequency conversion covers 241 and 242 may contain the same type of fluorescent material, a person having ordinary skill in the art may add different types of fluorescent materials in order to adjust the color temperature of illumination. In an example, when the first and second light sources 111 and 112 generate blue light, the first frequency conversion cover 241 contains yellow phosphor, whereas the second frequency conversion cover 242 contains green phosphor.

According to this embodiment as above, it is possible to radiate a portion of light that is generated by the light sources toward the side and rear of the illumination apparatus, thereby increasing the angular range of radiation. Consequently, the distribution of light can be made similar to that of an incandescent lamp.

In addition, in this embodiment, the cover is provided above the heat sink on which the substrate is mounted in order to guide the light that is generated by the light source to the rear and reduce the interference of the light so that the loss of the light that is radiated to the rear is reduced, thereby increasing the entire light efficiency.

Furthermore, in this embodiment, the cover, which surrounds the light source, is formed aspheric to decrease the distance between the light source and the cover so that the loss of the light that is radiated to the front is reduced, thereby increasing the entire light efficiency.

Moreover, in this embodiment, the fluorescent material, which converts the light that is generated by the light source into white light, is contained in the cover side. This, consequently, facilitates fabrication and improves productivity.

While the present invention has been illustrated and described with reference to the certain exemplary embodiments thereof, it will be apparent to those skilled in the art that various changes in form and details may be made therein without departing from the spirit and scope of the present invention and such changes fall within the scope of the appended claims.

What is claimed is:

1. An illumination apparatus, comprising:

a substrate;

a light source disposed on the substrate;

a cover unit covering the substrate and comprising a first cover unit and a second cover unit; and a reflector disposed inside of the cover unit and configured to reflect a portion of light emitted from the light source toward an area beside at least one of a side surface of the substrate and an area in front of a bottom surface of the substrate, wherein the first cover unit and the second cover unit comprise a wavelength converting material, respectively.

2. The illumination apparatus of claim 1, wherein at least one of the first and second cover units further comprise a light spreading agent.

3. The illumination apparatus of claim 1, wherein the cover unit is configured to convert a wavelength of light passing through the cover unit, and the cover unit is further configured to scatter light passing through the cover unit, refract light passing through the cover unit, or filter light passing through the cover unit.

4. The illumination apparatus of claim 1, wherein the wavelength converting material comprises a phosphor.

5. The illumination apparatus of claim 4, wherein the phosphor is dispersed inside of the cover unit.

6. The illumination apparatus of claim 4, wherein the cover unit comprises a wavelength converting layer disposed on a surface of the cover unit, and the phosphor is disposed in the wavelength converting layer.

7. The illumination apparatus of claim 6, wherein the wavelength converting layer has a certain thickness.

8. The illumination apparatus of claim 6, wherein the wavelength converting layer is disposed on an inner surface of the first cover unit and the second cover unit.

9. The illumination apparatus of claim 4, wherein the phosphor comprises a first phosphor and a second phosphor, and wherein the first cover unit and second cover unit comprise the first phosphor and second phosphor, respectively.

10. The illumination apparatus of claim 9, wherein a wavelength configured to be converted by the first phosphor is different from a wavelength configured to be converted by the second phosphor.

11. The illumination apparatus of claim 9, wherein the light source comprises a first light source and a second light source, and wherein the first cover unit is configured to change a characteristic of light emitted from the first light source, and the second cover unit is configured to change a characteristic of light emitted from the second light source.

12. The illumination apparatus of claim 11, wherein the reflector is disposed between the first light source and the second light source.

13. The illumination apparatus of claim 12, wherein the reflector extends toward an area between the first and second cover units from an area between the first and second light sources.

14. The illumination apparatus of claim 11, wherein the cover unit further comprises a third cover unit comprising a light spreading agent, and the third cover unit covers the first and second cover units.

15. The illumination apparatus of claim 1, wherein the cover unit further comprises a third cover unit, and wherein the first cover unit further comprises a light spreading agent.

16. The illumination apparatus of claim 15, wherein the third cover unit comprises a wavelength converting material and a light spreading agent.

17. The illumination apparatus of claim 16, wherein the third cover unit is spaced apart from the first cover unit.

18. The illumination apparatus of claim 1, wherein the wavelength converting material is spaced apart from the light source.

19. An illumination apparatus, comprising:

a substrate;

a light source disposed on the substrate;

a cover unit covering the substrate and comprising a first cover unit and a second cover unit connected to each other; and a reflector disposed inside of the cover unit and configured to reflect a portion of light emitted from the light source toward an area beside of a side surface of the substrate and an area in front of a bottom surface of the substrate, wherein the first and second cover units comprise a wavelength converting material, respectively, and wherein a thickness of the first cover unit is different from a thickness of the second cover unit.

20. An illumination apparatus, comprising:

a substrate;

a light source disposed on the substrate;

a cover unit covering the substrate and comprising a first cover unit and a second cover unit; and a reflector disposed inside of the cover unit and configured to reflect a portion of light emitted from the light source toward an area beside at least one of a side surface of the substrate and an area in front of a bottom surface of the substrate, wherein the first cover unit and the second cover unit comprise a wavelength converting material, respectively, wherein the light source includes a first light source and a second light source, wherein the first cover unit is configured to change a characteristic of light emitted from the first light source, and the second cover unit is configured to change a characteristic of light emitted from the second light source, and wherein the light characteristic-changed by the first cover unit has a different color or a different color temperature from the light characteristic-changed by the first cover unit.

* * * * *